US010428588B2

(12) United States Patent
Chen et al.

(10) Patent No.: US 10,428,588 B2
(45) Date of Patent: Oct. 1, 2019

(54) METHODS AND DRILL BIT DESIGNS FOR PREVENTING THE SUBSTRATE OF A CUTTING ELEMENT FROM CONTACTING A FORMATION

(71) Applicant: Halliburton Energy Services, Inc., Houston, TX (US)

(72) Inventors: Shilin Chen, Montgomery, TX (US); Eric Lawrence Helgesen, Edmond, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 99 days.

(21) Appl. No.: 15/311,085

(22) PCT Filed: Jun. 17, 2014

(86) PCT No.: PCT/US2014/042749

§ 371 (c)(1),
(2) Date: Nov. 14, 2016

(87) PCT Pub. No.: WO2015/195097

PCT Pub. Date: Dec. 23, 2015

(65) Prior Publication Data

US 2017/0081922 A1 Mar. 23, 2017

(51) Int. Cl.

| | |
|---|---|
| ***E21B 10/43*** | (2006.01) |
| ***E21B 10/55*** | (2006.01) |
| *E21B 10/42* | (2006.01) |

(52) U.S. Cl.

CPC ..... *E21B 10/43* (2013.01); *E21B 10/55* (2013.01); *E21B 2010/425* (2013.01)

(58) Field of Classification Search

CPC ..... E21B 10/43; E21B 10/55; E21B 2010/425
See application file for complete search history.

(56) References Cited

U.S. PATENT DOCUMENTS

| | | | |
|---|---|---|---|
| 4,932,484 | A | 6/1990 | Warren et al. |
| 6,298,930 | B1 | 10/2001 | Sinor et al. |

(Continued)

FOREIGN PATENT DOCUMENTS

| | | |
|---|---|---|
| IN | 200904010 P1 | 4/2009 |
| WO | 2012064948 | 5/2002 |
| WO | 2014012038 | 1/2014 |

OTHER PUBLICATIONS

International Search Report and Written Opinion, Application No. PCT/US2014/042749; 18 pgs, dated Mar. 20, 2015.

(Continued)

*Primary Examiner* — David J Bagnell
*Assistant Examiner* — Brandon M Duck
(74) *Attorney, Agent, or Firm* — Baker Botts L.L.P.

(57) ABSTRACT

In accordance with some embodiments of the present disclosure, a method of designing a drill bit comprises determining placements on a drill bit for a plurality of cutting elements at a plurality of radial coordinates of the drill bit. The method further comprises determining a substrate-based critical depth of cut for a substrate of each cutting element and generating a substrate-based critical depth of cut control curve based on the substrate-based critical depth of cut at each radial coordinate. The method also comprises comparing the substrate-based critical depth of cut control curve and the threshold critical depth of cut control curve and adjusting a drill bit design parameter if the substrate-based critical depth of cut control curve is less than or equal to the threshold critical depth of cut control curve at a radial coordinate.

20 Claims, 25 Drawing Sheets

(56) References Cited

U.S. PATENT DOCUMENTS

| | | | | |
|---|---|---|---|---|
| 6,302,223 | B1 | 10/2001 | Sinor | |
| 7,000,715 | B2 | 2/2006 | Sinor et al. | |
| 7,814,998 | B2 | 10/2010 | Patel et al. | |
| 8,112,258 | B2 | 2/2012 | Durairajan et al. | |
| 8,172,008 | B2 | 5/2012 | Dykstra et al. | |
| 2002/0071729 | A1* | 6/2002 | Middlemiss | B23C 5/202 407/114 |
| 2008/0041629 | A1 | 2/2008 | Aronstam et al. | |
| 2010/0263937 | A1 | 10/2010 | Overstreet et al. | |
| 2011/0284294 | A1 | 11/2011 | Cox | |
| 2012/0168231 | A1 | 7/2012 | Ganz | |
| 2013/0013267 | A1 | 1/2013 | Chen et al. | |
| 2013/0035903 | A1 | 2/2013 | Prevost et al. | |
| 2013/0081880 | A1 | 4/2013 | Schweffe et al. | |
| 2015/0122551 | A1* | 5/2015 | Chen | E21B 10/43 175/426 |

OTHER PUBLICATIONS

International Preliminary Report on Patentability, Application No. PCT/US2014/042749, dated Dec. 20, 2016, 13 pages.
Office Action, Canadian Application No. 2,948,308, dated Nov. 3, 2017, 4 pages.
Office Action, Chinese Application No. 201480078947.2, dated Jan. 24, 2018, 27 pages.

* cited by examiner

METHODS AND DRILL BIT DESIGNS FOR PREVENTING THE SUBSTRATE OF A CUTTING ELEMENT FROM CONTACTING A FORMATION

RELATED APPLICATIONS

This application is a U.S. National Stage Application of International Application No. PCT/US2014/042749 filed Jun. 17, 2014, which designates the United States, and which is incorporated herein by reference in its entirety.

TECHNICAL FIELD

The present disclosure relates generally to downhole drilling tools and, more particularly, to systems and methods of designing drilling tools to prevent the substrate of a cutting element from contacting a subterranean formation during drilling.

BACKGROUND

Various types of tools are used to form wellbores in subterranean formations for recovering hydrocarbons such as oil and gas lying beneath the surface. Examples of such tools include rotary drill bits, hole openers, reamers, and coring bits. Rotary drill bits include, but are not limited to, fixed cutter drill bits, such as polycrystalline diamond compact (PDC) drill bits, drag bits, matrix drill bits, rock bits, and roller cone drill bits. A fixed cutter drill bit typically includes multiple blades each having multiple cutting elements, such as the PDC cutting elements on a PDC bit.

Cutting elements of a drill bit may be configured to cut into a subterranean formation, and may include primary cutting elements, back-up cutting elements, secondary cutting elements, or any combination thereof. Cutting elements may include substrates with a layer of hard cutting material disposed on one end of each substrate. The hard cutting layer of cutting elements may provide a cutting surface that may engage adjacent portions of a subterranean formation to form wellbore during drilling. A drilling tool may also include one or more depth of cut controllers (DOCCs) configured to control the amount that the cutting elements of a drilling tool cut into a subterranean formation.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Systems and methods are disclosed, directed to calculating a substrate-based critical depth of cut of a drill bit in order to ensure that the substrate of a cutting element on the drill bit does not contact the formation (including, but not limited to rock, dirt, sand, and/or shale) during drilling of a wellbore. In the present disclosure, a method for calculating the substrate-based critical depth of cut at which a substrate of a cutting element would contact formation during drilling is disclosed. This substrate-based critical depth of cut may be compared, for example, to a DOCC-based critical depth of cut, to determine whether a substrate of a cutting element may contact formation before the DOCC. Upon determination of any radial locations on the drill bit at which a substrate of a cutting element may contact formation during drilling, various drill bit design parameters (e.g., cutter density, DOCC density, and the back rake and/or side rake of the cutting elements) may be modified to prevent the substrate of a cutting element from contacting the formation during drilling of the wellbore.

Embodiments of the present disclosure and its advantages are best understood by referring to FIGS. 1 through 15, where like numbers are used to indicate like and corresponding parts.

Figure 1:
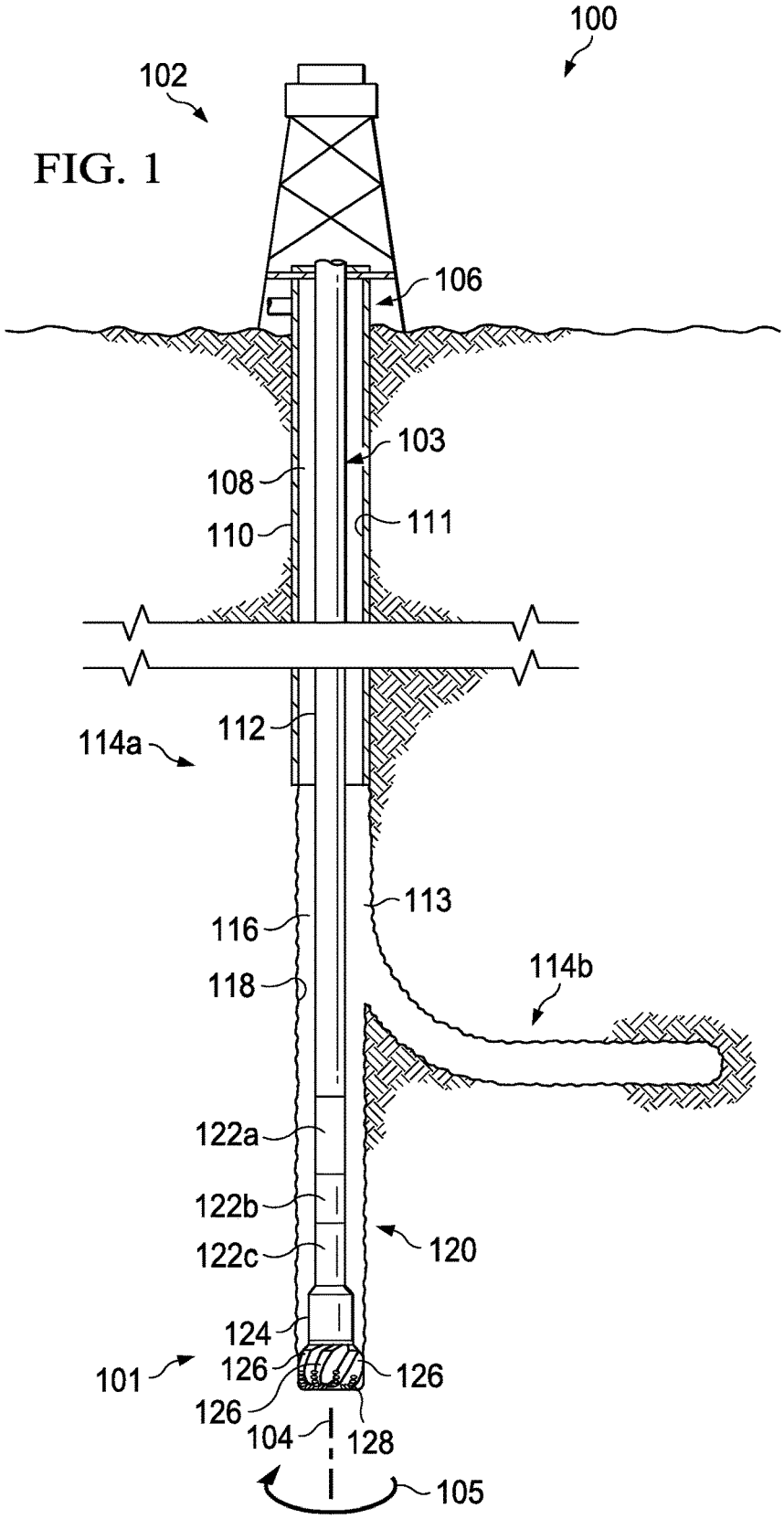
FIG. 1 illustrates an elevation view of an example embodiment of a drilling system, in accordance with some embodiments of the present disclosure.

FIG. 1 illustrates an elevation view of an example embodiment of drilling system 100, in accordance with some embodiments of the present disclosure. Drilling system 100 may include well surface or well site 106. Various types of drilling equipment such as a rotary table, drilling fluid pumps and drilling fluid tanks (not expressly shown) may be located at well surface or well site 106. For example, well site 106 may include drilling rig 102 that may have various characteristics and features associated with a "land drilling rig." However, downhole drilling tools incorporating teachings of the present disclosure may be satisfactorily used with drilling equipment located on offshore platforms, drill ships, semi-submersibles and drilling barges (not expressly shown).

Drilling system 100 may also include drill string 103 associated with drill bit 101 that may be used to form a wide variety of wellbores or bore holes such as generally vertical wellbore 114*a* or generally horizontal wellbore 114*b* or any combination thereof. Various directional drilling techniques and associated components of bottom hole assembly (BHA) 120 of drill string 103 may be used to form horizontal wellbore 114*b*. For example, lateral forces may be applied to BHA 120 proximate kickoff location 113 to form generally horizontal wellbore 114*b* extending from generally vertical wellbore 114*a*. The term "directional drilling" may be used to describe drilling a wellbore or portions of a wellbore that extend at a desired angle or angles relative to vertical. The desired angles may be greater than normal variations associated with vertical wellbores. Direction drilling may also be described as drilling a wellbore deviated from vertical. The term "horizontal drilling" may be used to include drilling in a direction approximately ninety degrees (90°) from vertical.

BHA 120 may be formed from a wide variety of components configured to form wellbore 114. For example, components 122*a*, 122*b* and 122*c* of BHA 120 may include, but are not limited to, drill bits (e.g., drill bit 101), coring bits, drill collars, rotary steering tools, directional drilling tools, downhole drilling motors, reamers, hole enlargers or stabilizers. The number and types of components 122 included in BHA 120 may depend on anticipated downhole drilling conditions and the type of wellbore that will be formed by drill string 103 and rotary drill bit 101. BHA 120 may also include various types of well logging tools (not expressly shown) and other downhole tools associated with directional drilling of a wellbore. Examples of logging tools and/or directional drilling tools may include, but are not limited to, acoustic, neutron, gamma ray, density, photoelectric, nuclear magnetic resonance, rotary steering tools and/or any other commercially available well tool. Further, BHA 120 may also include a rotary drive (not expressly shown) connected to components 122*a*, 122*b* and 122*c* and which rotates at least part of drill string 103 together with components 122*a*, 122*b* and 122*c*.

Wellbore 114 may be defined in part by casing string 110 that may extend from well surface 106 to a selected downhole location. Portions of wellbore 114, as shown in FIG. 1, that do not include casing string 110 may be described as "open hole." Various types of drilling fluid may be pumped from well surface 106 through drill string 103 to attached drill bit 101. The drilling fluids may be directed to flow from drill string 103 to respective nozzles (depicted as nozzles 156 in FIG. 2) passing through rotary drill bit 101. The drilling fluid may be circulated back to well surface 106 through annulus 108 defined in part by outside diameter 112 of drill string 103 and inside diameter 118 of wellbore 114*a*. Inside diameter 118 may be referred to as the "sidewall" of wellbore 114*a* Annulus 108 may also be defined by outside diameter 112 of drill string 103 and inside diameter 111 of casing string 110. Open hole annulus 116 may be defined as sidewall 118 and outside diameter 112.

Drilling system 100 may also include rotary drill bit ("drill bit") 101. Drill bit 101, discussed in further detail in FIG. 2, may include one or more blades 126 that may be disposed outwardly from exterior portions of rotary bit body 124 of drill bit 101. Blades 126 may be any suitable type of projections extending outwardly from rotary bit body 124. Drill bit 101 may rotate with respect to bit rotational axis 104 in a direction defined by directional arrow 105. Blades 126 may include one or more cutting elements 128 disposed outwardly from exterior portions of each blade 126. Blades 126 may also include one or more depth of cut controllers (not expressly shown) configured to control the depth of cut of cutting elements 128. Blades 126 may further include one or more gage pads (not expressly shown) disposed on blades 126. Drill bit 101 may be designed and formed in accordance with teachings of the present disclosure and may have many different designs, configurations, and/or dimensions according to the particular application of drill bit 101.

The configuration of cutting elements 128 on drill bit 101 and/or other downhole drilling tools may also contribute to the drilling efficiency of the drill bit. Cutting elements 128 may be laid out according to two general principles: single-set and track-set. In a single-set configuration, each of cutting elements 128 on drill bit 101 may have a unique radial position with respect to bit rotational axis 104. In a track-set configuration, at least two of cutting elements 128 of drill bit 101 may have the same radial position with respect to bit rotational axis 104. In some embodiments, the track-set cutting elements may be located on different blades of the drill bit. In other embodiments, the track-set cutting elements may be located on the same blade. Drill bits having cutting elements laid out in a single-set configuration may drill more efficiently than drill bits having a track-set configuration while drill bits having cutting elements laid out in a track-set configuration may be more stable than drill bits having a single-set configuration.

While drilling into different types of geological formations it may be advantageous to control the amount that a drill bit cuts into a geological formation in order to reduce wear on the cutting elements of the drill bit, prevent uneven cutting into the formation, increase control of penetration rate, reduce tool vibration, etc. It may also be advantageous to control the design of a drill bit to prevent the substrates of cutting elements, as opposed to the hard cutting layer of the cutting elements, from contacting the formation during drilling.

As disclosed in further detail below and according to some embodiments of the present disclosure, cutting elements and other elements (e.g., DOCCs) on a drill bit may be configured such that the substrates of the cutting elements of a drill bit do not contact formation during drilling. Thus, a drill bit designed according to the present disclosure may prevent excess friction, loss of cutters, and instable bit runs associated with drill bit designs whereby one or more substrates of cutting elements contact the formation during the drilling of a wellbore.

Figure 2:
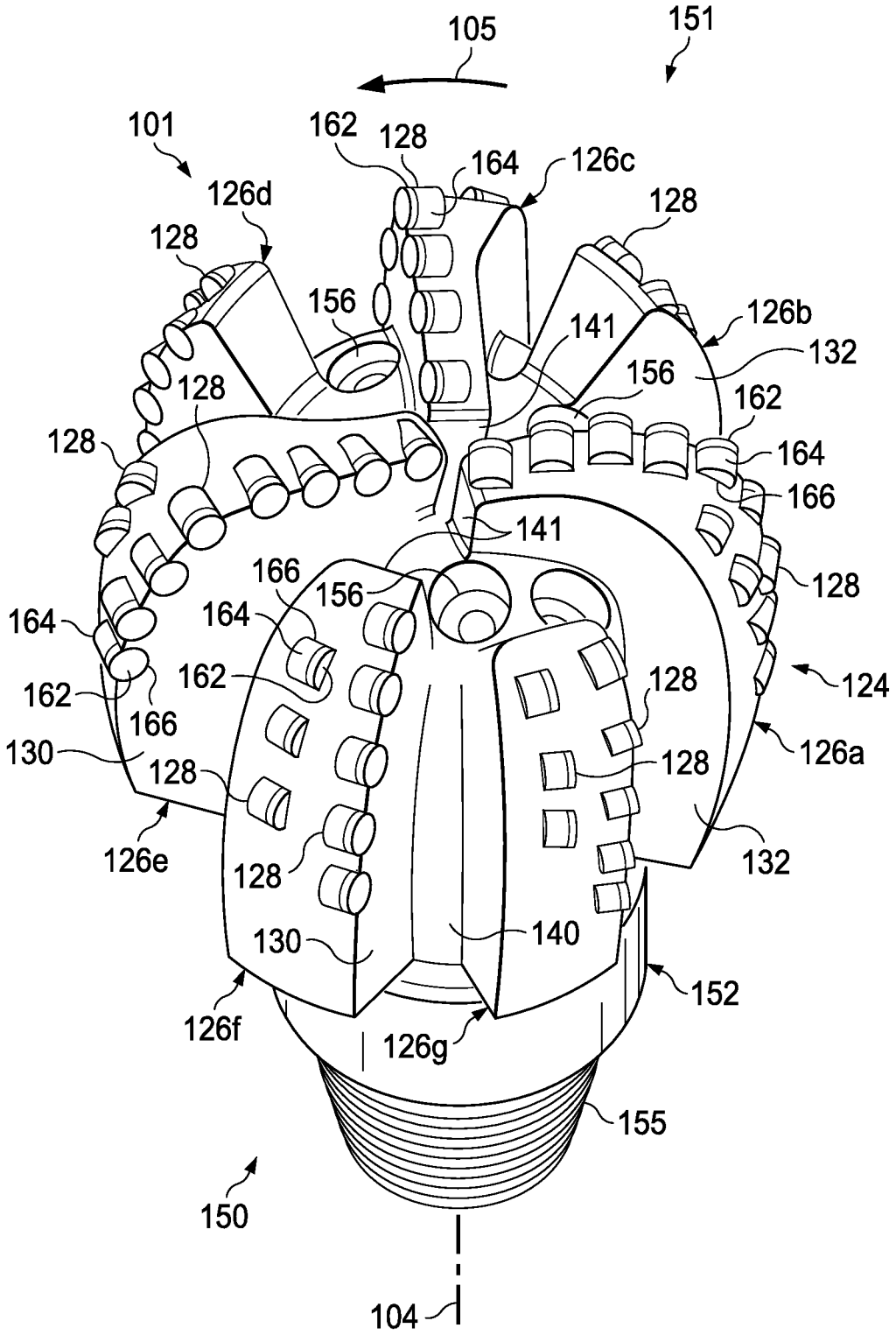
FIG. 2 illustrates an isometric view of a rotary drill bit oriented upwardly in a manner often used to model or design fixed cutter drill bits, in accordance with some embodiments of the present disclosure.

FIG. 2 illustrates an isometric view of rotary drill bit 101 oriented upwardly in a manner often used to model or design fixed cutter drill bits, in accordance with some embodiments of the present disclosure. Drill bit 101 may be any of various types of rotary drill bits, including fixed cutter drill bits, polycrystalline diamond compact (PDC) drill bits, drag bits, matrix drill bits, and/or steel body drill bits operable to form a wellbore (e.g., wellbore 114 as illustrated in FIG. 1) extending through one or more downhole formations. Drill bit 101 may be designed and formed in accordance with teachings of the present disclosure and may have many different designs, configurations, and/or dimensions according to the particular application of drill bit 101.

Drill bit 101 may include one or more blades 126 (e.g., blades 126*a*-126*g*) that may be disposed outwardly from exterior portions of rotary bit body 124 of drill bit 101. Blades 126 may be any suitable type of projections extending outwardly from rotary bit body 124. For example, a portion of blade 126 may be directly or indirectly coupled to an exterior portion of bit body 124, while another portion of blade 126 may be projected away from the exterior portion of bit body 124. Blades 126 formed in accordance with some embodiments of the present disclosure may have a wide variety of configurations including, but not limited to, substantially arched, generally helical, spiraling, tapered, converging, diverging, symmetrical, and/or asymmetrical. In some embodiments, one or more blades 126 may have a substantially arched configuration extending from proximate rotational axis 104 of drill bit 101. The arched configuration may be defined in part by a generally concave, recessed shaped portion extending from proximate bit rotational axis 104. The arched configuration may also be defined in part by a generally convex, outwardly curved portion disposed between the concave, recessed portion and exterior portions of each blade which correspond generally with the outside diameter of the rotary drill bit.

Each of blades 126 may include a first end disposed proximate or toward bit rotational axis 104 and a second end disposed proximate or toward exterior portions of drill bit 101 (e.g., disposed generally away from bit rotational axis 104 and toward uphole portions of drill bit 101). The terms "uphole" and "downhole" may be used to describe the location of various components of drilling system 100 relative to the bottom or end of wellbore 114 shown in FIG. 1. For example, a first component described as uphole from a second component may be further away from the end of wellbore 114 than the second component. Similarly, a first component described as being downhole from a second component may be located closer to the end of wellbore 114 than the second component.

Blades 126*a*-126*g* may include primary blades disposed about the bit rotational axis. For example, blades 126*a*, 126*c*, and 126*e* may be primary blades or major blades because respective first ends 141 of each of blades 126*a*, 126*c*, and 126*e* may be disposed closely adjacent to bit rotational axis 104 of drill bit 101. In some embodiments, blades 126*a*-126*g* may also include at least one secondary blade disposed between the primary blades. In the illustrated embodiment, blades 126*b*, 126*d*, 126*f*, and 126*g* on drill bit 101 may be secondary blades or minor blades because respective first ends 141 may be disposed on downhole end 151 of drill bit 101 a distance from associated bit rotational axis 104. The number and location of primary blades and secondary blades may vary such that drill bit 101 includes more or less primary and secondary blades. Blades 126 may be disposed symmetrically or asymmetrically with regard to each other and bit rotational axis 104 where the location of blades 126 may be based on the downhole drilling conditions of the drilling environment. In some embodiments, blades 126 and drill bit 101 may rotate about rotational axis 104 in a direction defined by directional arrow 105.

Each of blades 126 may have respective leading or front surfaces 130 in the direction of rotation of drill bit 101 and trailing or back surfaces 132 located opposite of leading surface 130 away from the direction of rotation of drill bit 101. In some embodiments, blades 126 may be positioned along bit body 124 such that they have a spiral configuration relative to bit rotational axis 104. In other embodiments, blades 126 may be positioned along bit body 124 in a generally parallel configuration with respect to each other and bit rotational axis 104.

Blades 126 may include one or more cutting elements 128 disposed outwardly from exterior portions of each blade 126. For example, a portion of cutting element 128 may be directly or indirectly coupled to an exterior portion of blade 126 while another portion of cutting element 128 may be projected away from the exterior portion of blade 126. By way of example and not limitation, cutting elements 128 may be various types of cutters, compacts, buttons, inserts, and gage cutters satisfactory for use with a wide variety of drill bits 101. Although FIG. 2 illustrates two rows of cutting elements 128 on blades 126, drill bits designed and manufactured in accordance with some embodiments of the present disclosure may have one row of cutting elements or more than two rows of cutting elements.

Cutting elements 128 may be any suitable device configured to cut into a formation, including but not limited to, primary cutting elements, back-up cutting elements, secondary cutting elements or any combination thereof. Cutting elements 128 may include respective substrates 164 with a layer of hard cutting material (e.g., cutting table 162) disposed on one end of each respective substrate 164. The hard layer of cutting elements 128 may provide a cutting surface that may engage adjacent portions of a downhole formation to form wellbore 114 as illustrated in FIG. 1. The contact of the cutting surface with the formation may form a cutting zone associated with each of cutting elements 128, as described in further detail with respect to FIGS. 4A-4D. The edge of the cutting surface located within the cutting zone may be referred to as the cutting edge of a cutting element 128.

Each substrate 164 of cutting elements 128 may have various configurations and may be formed from tungsten carbide or other suitable materials associated with forming cutting elements for rotary drill bits. Tungsten carbides may include, but are not limited to, monotungsten carbide (WC), ditungsten carbide ($W_2C$), macrocrystalline tungsten carbide and cemented or sintered tungsten carbide. Substrates may also be formed using other hard materials, which may include various metal alloys and cements such as metal borides, metal carbides, metal oxides and metal nitrides. For some applications, the hard cutting layer may be formed from substantially the same materials as the substrate. In other applications, the hard cutting layer may be formed from different materials than the substrate. Examples of materials used to form hard cutting layers may include polycrystalline diamond materials, including synthetic polycrystalline diamonds. Blades 126 may include recesses or bit pockets 166 that may be configured to receive cutting elements 128. For example, bit pockets 166 may be concave cutouts on blades 126.

In some embodiments, blades 126 may also include one or more depth of cut controllers (DOCCs) (not expressly shown) configured to control the depth of cut of cutting elements 128. A DOCC may include an impact arrestor, a back-up or second layer cutting element and/or a Modified Diamond Reinforcement (MDR). Exterior portions of blades 126, cutting elements 128 and DOCCs (not expressly shown) may form portions of the bit face.

Blades 126 may further include one or more gage pads (not expressly shown) disposed on blades 126. A gage pad may be a gage, gage segment, or gage portion disposed on exterior portion of blade 126. Gage pads may contact adjacent portions of a wellbore (e.g., wellbore 114 as illustrated in FIG. 1) formed by drill bit 101. Exterior portions of blades 126 and/or associated gage pads may be disposed at various angles (e.g., positive, negative, and/or parallel) relative to adjacent portions of generally vertical wellbore 114*a*. A gage pad may include one or more layers of hardfacing material.

Uphole end 150 of drill bit 101 may include shank 152 with drill pipe threads 155 formed thereon. Threads 155 may be used to releasably engage drill bit 101 with BHA 120 whereby drill bit 101 may be rotated relative to bit rotational axis 104. Downhole end 151 of drill bit 101 may include a plurality of blades 126*a*-126*g* with respective junk slots or fluid flow paths 140 disposed therebetween. Additionally, drilling fluids may be communicated to one or more nozzles 156.

Drill bit operation may be expressed in terms of depth of cut per revolution as a function of drilling depth. Depth of cut per revolution, or "depth of cut," may be determined by rate of penetration (ROP) and revolution per minute (RPM). ROP may represent the amount of formation that is removed as drill bit 101 rotates and may be in units of ft/hr. Further, RPM may represent the rotational speed of drill bit 101. For example, drill bit 101 utilized to drill a formation may rotate at approximately 120 RPM. Actual depth of cut (Δ) may represent a measure of the depth that cutting elements cut into the formation during a rotation of drill bit 101. Thus, actual depth of cut may be expressed as a function of actual ROP and RPM using the following equation:

$$\Delta = ROP/(5*RPM).$$

Actual depth of cut may have a unit of in/rev.

The rate of penetration (ROP) of drill bit 101 is often a function of both weight on bit (WOB) and revolutions per minute (RPM). Drill string 103 may apply weight on drill bit 101 and may also rotate drill bit 101 about rotational axis 104 to form a wellbore 114 (e.g., wellbore 114*a* or wellbore 114*b*). For some applications a downhole motor (not expressly shown) may be provided as part of BHA 120 to also rotate drill bit 101. In some embodiments, the drilling efficiency of drill bit 101 may depend on the location or configuration of cutting elements 128 or blades 126. Accordingly, a downhole drilling tool model may take into consideration the location, orientation and configuration cutting elements 128, blades 126, or other components of drill bit 101 in order to model interactions of downhole drilling tools with formations.

Figure 3A:
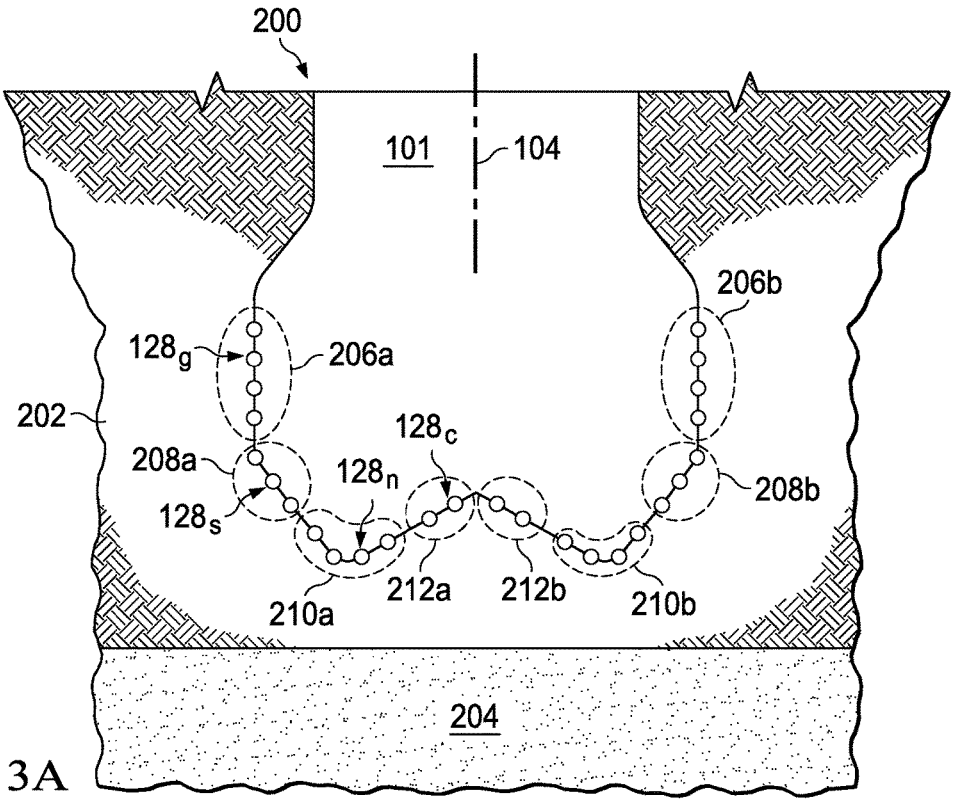
FIG. 3A illustrates a drawing in section and in elevation with portions broken away showing the drill bit of FIG. 2 drilling a wellbore through a first downhole formation and into an adjacent second downhole formation, in accordance with some embodiments of the present disclosure.

FIG. 3A illustrates a drawing in section and in elevation with portions broken away showing drill bit 101 of FIG. 2 drilling a wellbore through a first downhole formation and into an adjacent second downhole formation, in accordance with some embodiments of the present disclosure. Exterior portions of blades (not expressly shown) and cutting elements 128 may be projected rotationally onto a radial plane to form bit face profile 200. In the illustrated embodiment, formation layer 202 may be described as "softer" or "less hard" when compared to downhole formation layer 204. As shown in FIG. 3A, exterior portions of drill bit 101 that contact adjacent portions of a downhole formation may be described as a "bit face." Bit face profile 200 of drill bit 101 may include various zones or segments. Bit face profile 200 may be substantially symmetric about bit rotational axis 104 due to the rotational projection of bit face profile 200, such that the zones or segments on one side of rotational axis 104 may be substantially similar to the zones or segments on the opposite side of rotational axis 104.

For example, bit face profile 200 may include gage zone 206*a* located opposite gage zone 206*b*, a shoulder zone 208*a* located opposite a shoulder zone 208*b*, a nose zone 210*a* located opposite a nose zone 210*b*, and a cone zone 212*a* located opposite a cone zone 212*b*. Cutting elements 128 included in each zone may be referred to as cutting elements of that zone. For example, cutting elements $\mathbf{128}_g$ included in gage zones 206 may be referred to as gage cutting elements, cutting elements $\mathbf{128}_s$ included in shoulder zones 208 may be referred to as shoulder cutting elements, cutting elements $\mathbf{128}_n$ included in nose zones 210 may be referred to as nose cutting elements, and cutting elements $\mathbf{128}_c$ included in cone zones 212 may be referred to as cone cutting elements.

Cone zones 212 may be may be formed on exterior portions of each blade (e.g., blades 126 as illustrated in FIG. 1) of drill bit 101, adjacent to and extending out from bit rotational axis 104. Nose zones 210 may be generally convex and may be formed on exterior portions of each blade of drill bit 101, adjacent to and extending from each cone zone 212. Shoulder zones 208 may be formed on exterior portions of each blade 126 extending from respective nose zones 210 and may terminate proximate to a respective gage zone 206. As shown in FIG. 3A, the area of bit face profile 200 may depend on the cross-sectional areas associated with zones or segments of bit face profile 200 rather than on a total number of cutting elements, a total number of blades, or cutting areas per cutting element.

Figure 3B:
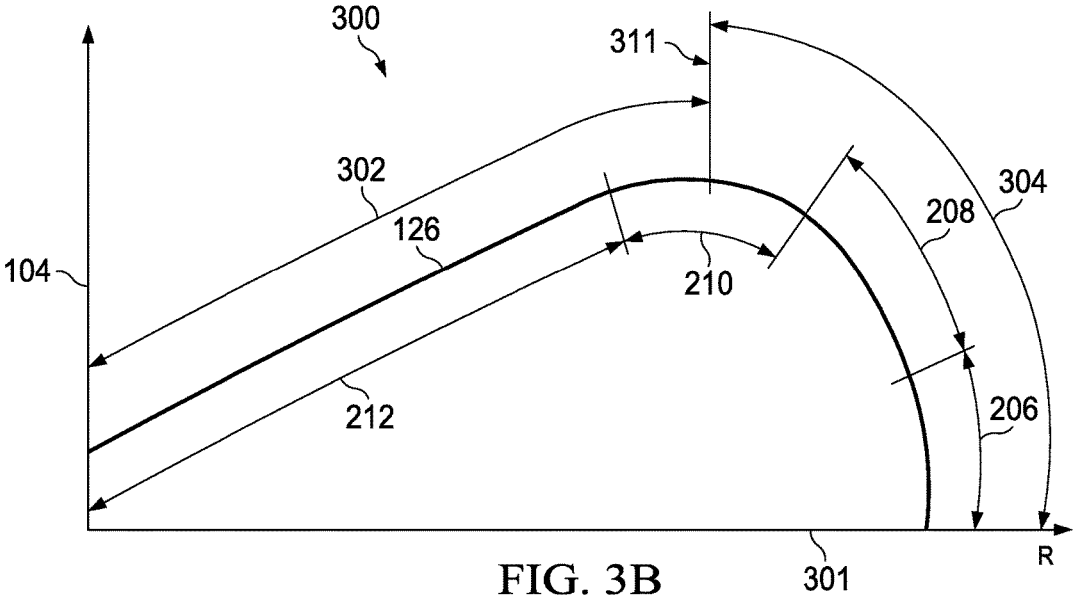
FIG. 3B illustrates a blade profile that represents a cross-sectional view of a blade of a drill bit, in accordance with some embodiments of the present disclosure.

FIG. 3B illustrates blade profile 300 that represents a cross-sectional view of blade 126 of drill bit 101, in accordance with some embodiments of the present disclosure.

Blade profile 300 includes cone zone 212, nose zone 210, shoulder zone 208 and gage zone 206 as described above with respect to FIG. 2. Cone zone 212, nose zone 210, shoulder zone 208 and gage zone 206 may be based on their location along blade 126 with respect to rotational axis 104 and horizontal reference line 301 that indicates a distance from rotational axis 104 in a plane perpendicular to rotational axis 104. A comparison of FIGS. 3A and 3B shows that blade profile 300 of FIG. 3B is upside down with respect to bit face profile 200 of FIG. 3A.

Blade profile 300 may include inner zone 302 and outer zone 304. Inner zone 302 may extend outward from rotational axis 104 to nose point 311. Outer zone 304 may extend from nose point 311 to the end of blade 126. Nose point 311 may be the location on blade profile 300 within nose zone 210 that has maximum elevation as measured by bit rotational axis 104 (vertical axis) from reference line 301 (horizontal axis). A coordinate on the graph in FIG. 3B corresponding to rotational axis 104 may be referred to as an axial coordinate or position. A coordinate on the graph in FIG. 3B corresponding to reference line 301 may be referred to as a radial coordinate or radial position that may indicate a distance extending orthogonally from rotational axis 104 in a radial plane passing through rotational axis 104. For example, in FIG. 3B rotational axis 104 may be placed along a z-axis and reference line 301 may indicate the distance (R) extending orthogonally from rotational axis 104 to a point on a radial plane that may be defined as the ZR plane.

FIGS. 3A and 3B are for illustrative purposes only and modifications, additions or omissions may be made to FIGS. 3A and 3B without departing from the scope of the present disclosure. For example, the actual locations of the various zones with respect to the bit face profile may vary and may not be exactly as depicted.

FIGS. 4A-4D illustrate cutting edges 406 and cutting zones 404 of various cutting elements 402 disposed along a blade 400, as modeled by a downhole drilling tool model. The location and size of cutting zones 404 (and consequently the location and size of cutting edges 406) may depend on factors including the ROP and RPM of the bit, the size of cutting elements 402, and the location and orientation of cutting elements 402 along the blade profile of blade 400, and accordingly the bit face profile of the drill bit.

Figure 4A:
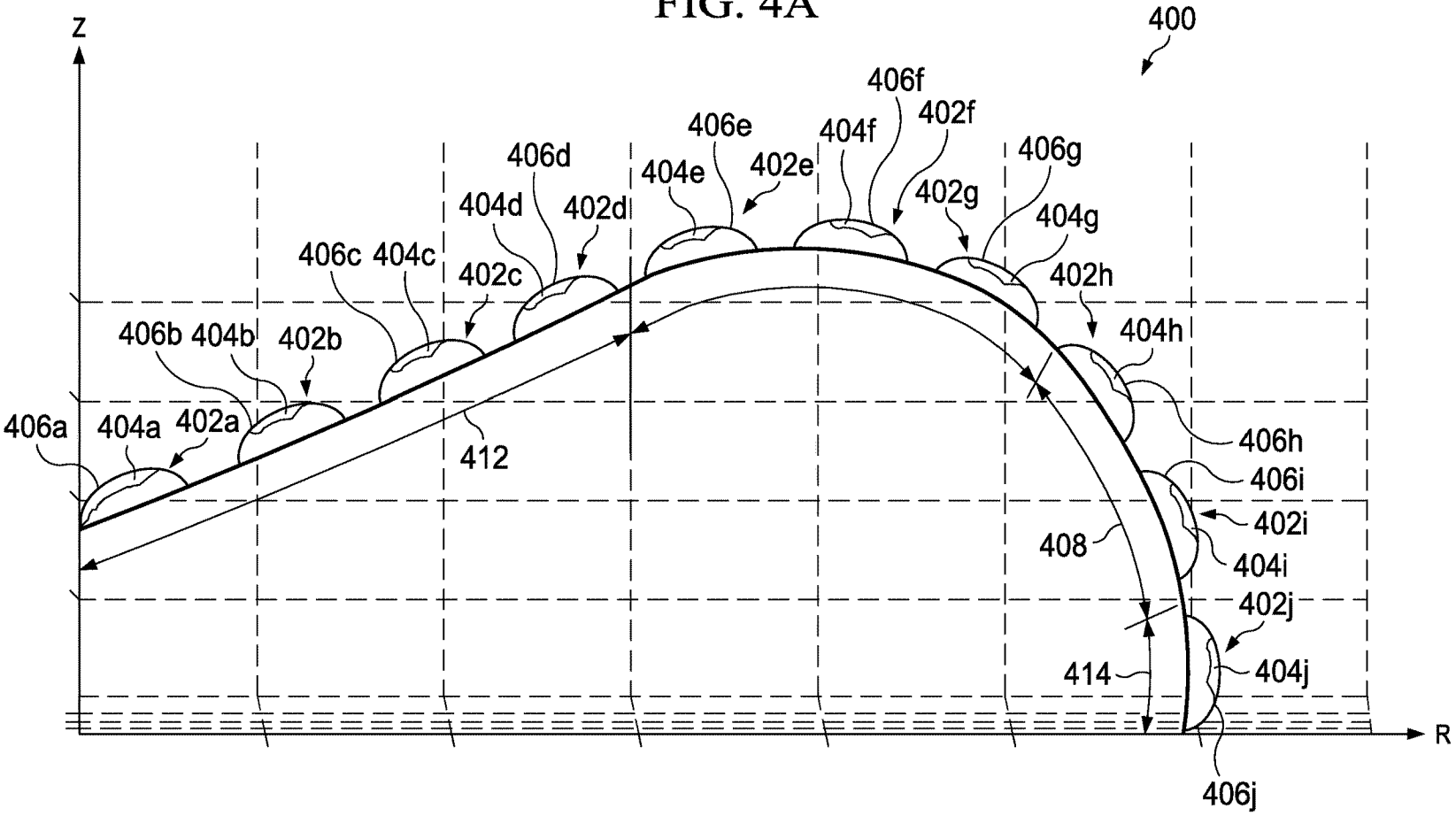
FIGS. 4A-4D illustrate cutting zones of various cutting elements disposed along a blade, in accordance with some embodiments of the present disclosure.

FIG. 4A illustrates a graph of a profile of blade 400 indicating radial and axial locations of cutting elements 402*a*-402*j* along blade 400. The vertical axis ("Z") depicts the axial position of blade 400 along a bit rotational axis and the horizontal axis ("R") depicts the radial position of blade 400 from the bit rotational axis in a radial plane passing through the bit rotational axis. Blade 400 may be substantially similar to one of blades 126 described with respect to FIGS. 1-3 and cutting elements 402 may be substantially similar to cutting elements 128 described with respect to FIGS. 1-3. In the illustrated embodiment, cutting elements 402*a*-402*d* may be located within a cone zone 412 of blade 400 and cutting elements 402*e*-402*g* may be located within a nose zone 410 of blade 400. Additionally, cutting elements 402*h*-402*j* may be located within a shoulder zone 408 of blade 400 and cutting element 402*j* may be located within a gage zone 414 of blade 400. Cone zone 412, nose zone 410, shoulder zone 408 and gage zone 414 may be substantially similar to cone zone 212, nose zone 210, shoulder zone 208 and gage zone 206, respectively, described with respect to FIGS. 3A and 3B.

FIG. 4A illustrates cutting zones 404*a*-404*j*, with each cutting zone 404 corresponding with a respective cutting element 402. As mentioned above, each cutting element 402 may have a cutting edge (not expressly shown) located within a cutting zone 404. From FIG. 4A it can be seen that the cutting zone 404 of each cutting element 402 may be based on the axial and radial locations of the cutting element 402 on blade 400, which may be related to the various zones of blade 400.

Figure 4B:
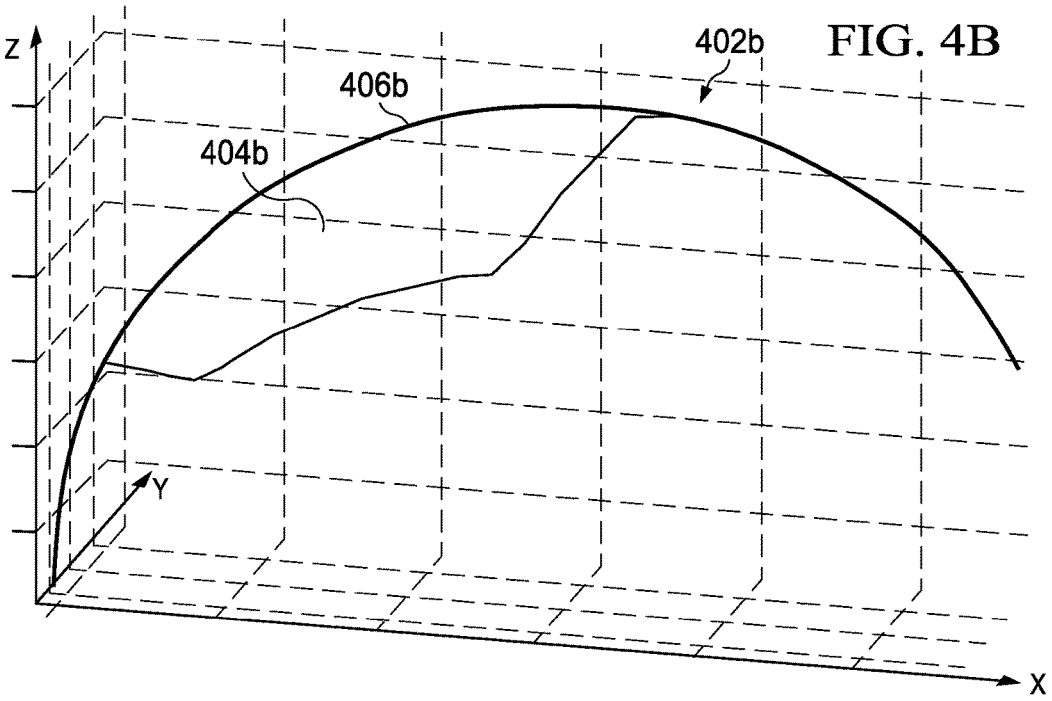

FIG. 4B illustrates an exploded graph of cutting element 402*b* of FIG. 4A to further detail cutting zone 404*b* and cutting edge 406*b* associated with cutting element 402*b*. From FIG. 4A it can be seen that cutting element 402*b* may be located in cone zone 412. Cutting zone 404*b* may be based at least partially on cutting element 402*b* being located in cone zone 412 and having axial and radial positions corresponding with cone zone 412. As mentioned above, cutting edge 406*b* may be the edge of the cutting surface of cutting element 402*b* that is located within cutting zone 404*b*.

Figure 4C:
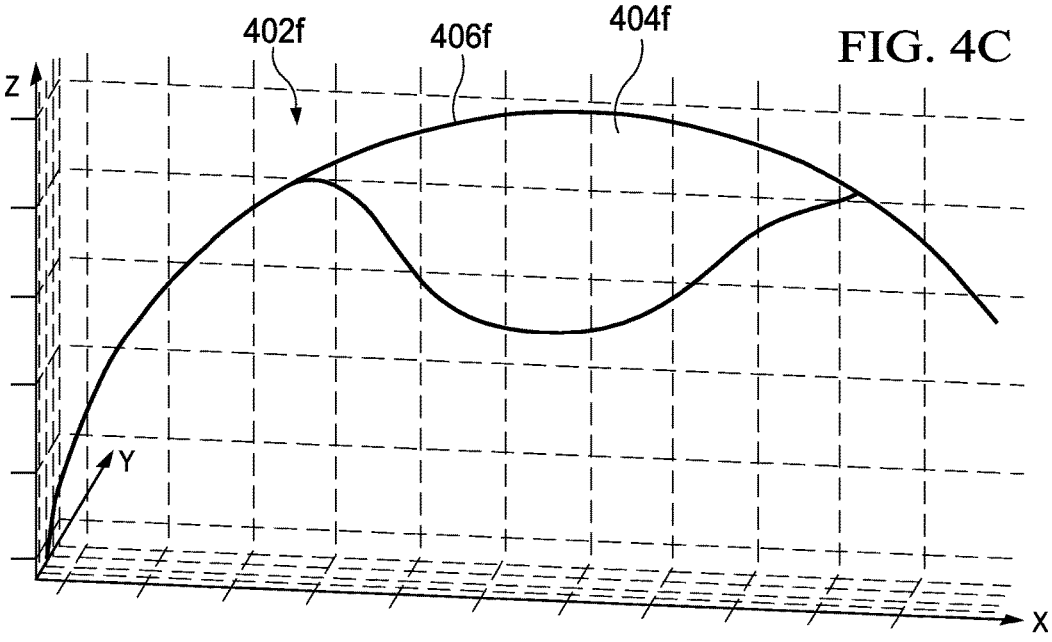

FIG. 4C illustrates an exploded graph of cutting element 402*f* of FIG. 4A to further detail cutting zone 404*f* and cutting edge 406*f* associated with cutting element 402*f*. From FIG. 4A it can be seen that cutting element 402*f* may be located in nose zone 410. Cutting zone 404*f* may be based at least partially on cutting element 402*f* being located in nose zone 410 and having axial and radial positions corresponding with nose zone 410.

Figure 4D:
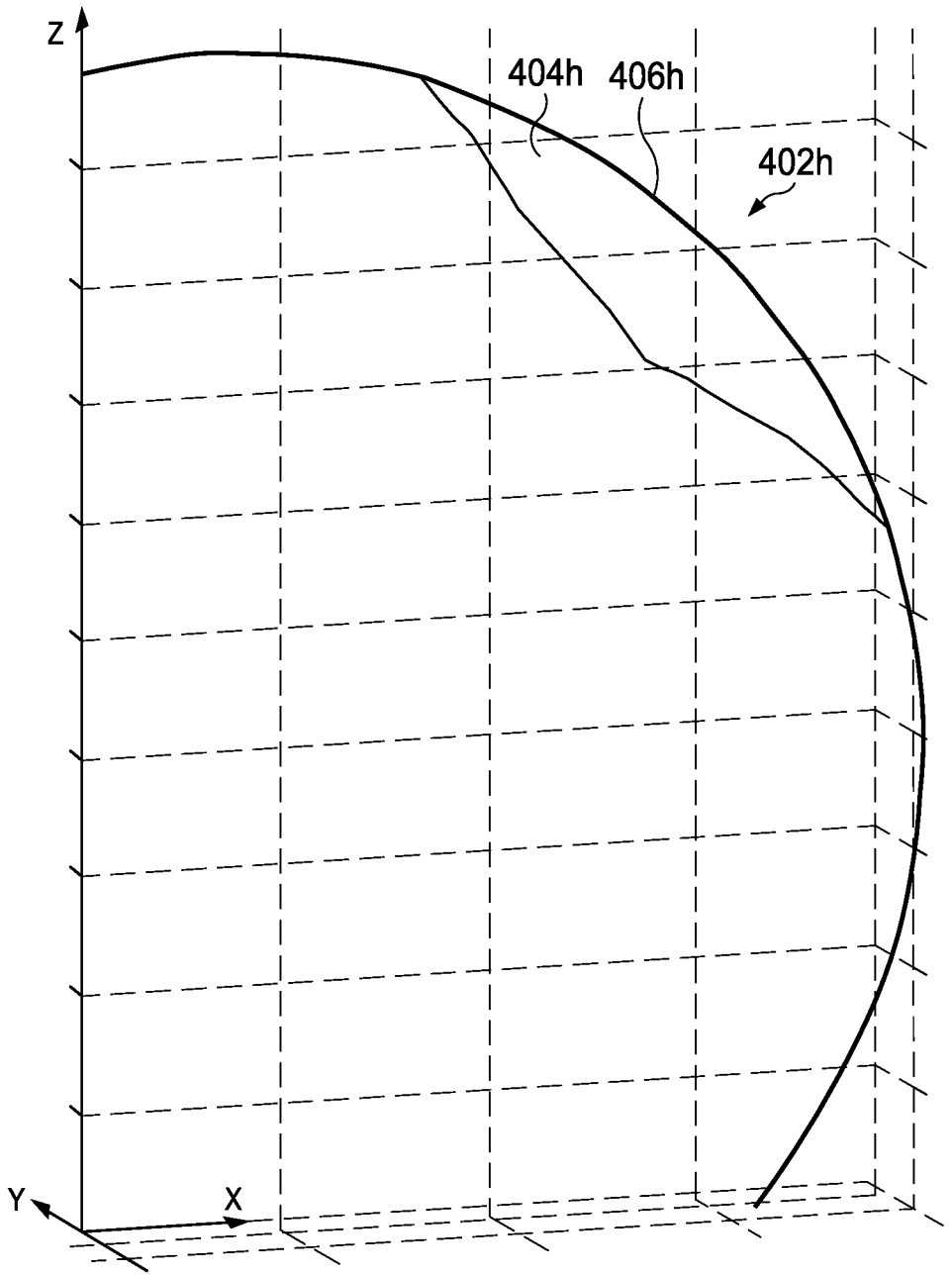

FIG. 4D illustrates an exploded graph of cutting element 402*h* of FIG. 4A to further detail cutting zone 404*h* and cutting edge 406*h* associated with cutting element 402*h*. From FIG. 4A it can be seen that cutting element 402*h* may be located in shoulder zone 408. Cutting zone 404*h* may be based partially on cutting element 402*h* being located in shoulder zone 408 and having axial and radial positions corresponding with shoulder zone 408.

An analysis of FIG. 4A and a comparison of FIGS. 4B-4D reveal that the locations of cutting zones 404 of cutting elements 402 may vary at least in part on the axial and radial positions of cutting elements 402 with respect to rotational axis 104. Accordingly, a downhole drilling tool model may take into consideration the location, orientation and configuration cutting elements 402 of a drill bit in order to incorporate interactions of downhole drilling tools with formations.

Figure 5A:
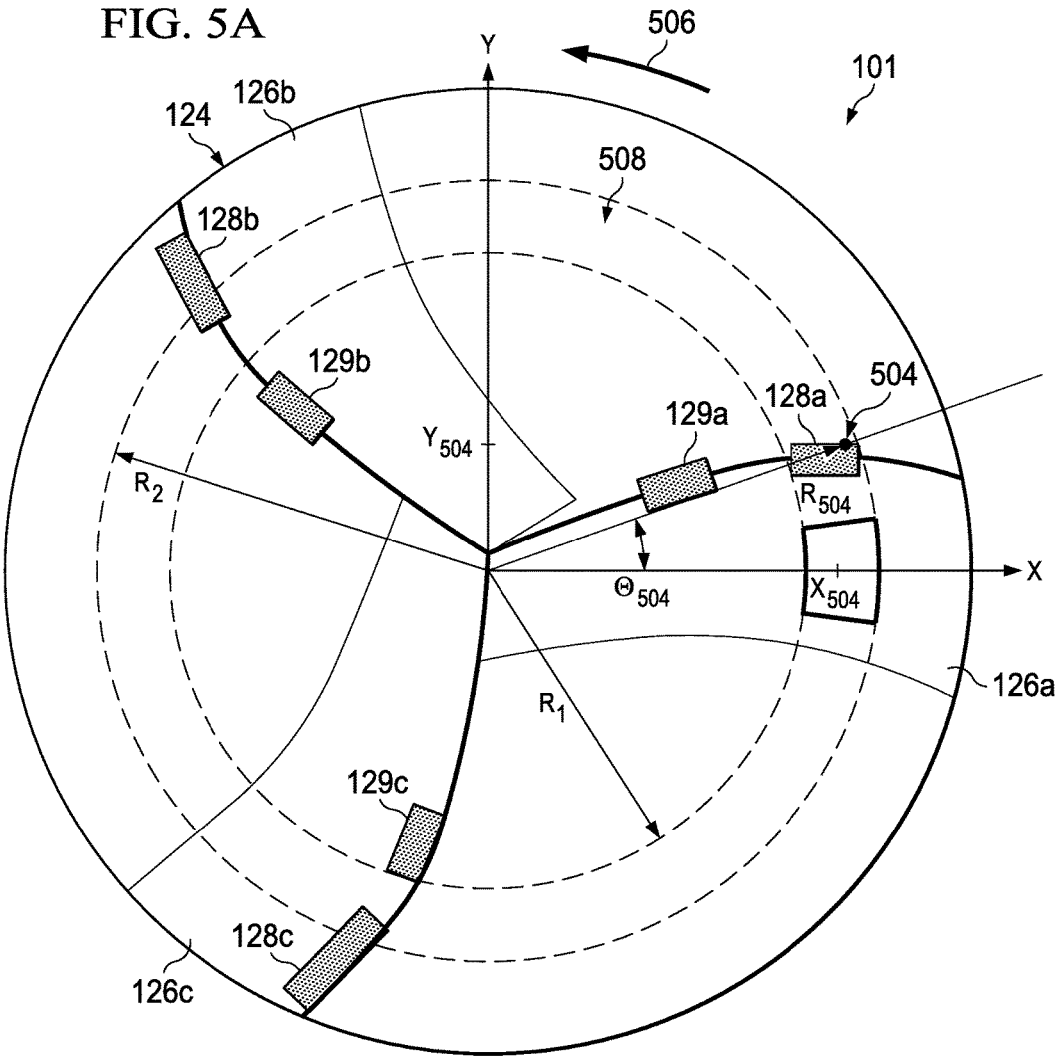
FIG. 5A illustrates the face of a drill bit that may be designed and manufactured to provide an improved depth of cut control, in accordance with some embodiments of the present disclosure.
Figure 5B:
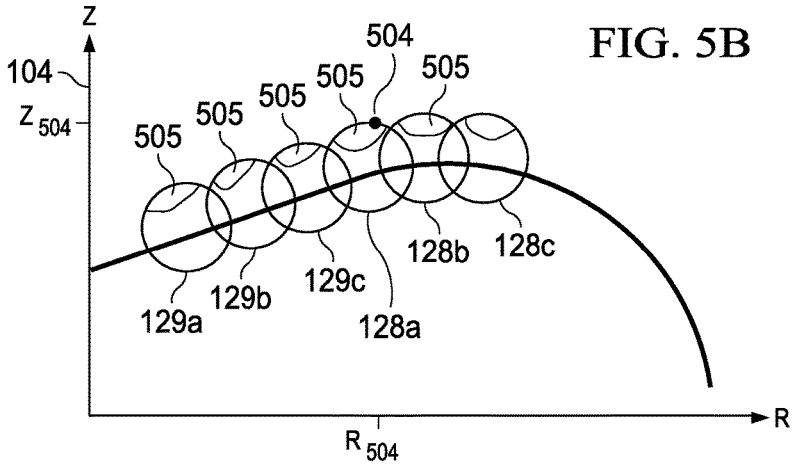
FIG. 5B illustrates the locations of cutting elements of the drill bit of FIG. 5A along the bit profile of the drill bit, in accordance with some embodiments of the present disclosure.

FIG. 5A illustrates the face of drill bit 101 that may be designed and manufactured according to the present disclosure to provide an improved depth of cut control. FIG. 5B illustrates the locations of cutting elements 128 and 129 of drill bit 101 along the bit profile of drill bit 101. As discussed in further detail below, drill bit 101 may include a DOCC 502 that may be configured to control the depth of cut of a cutting element according to the location of a cutting zone and the associated cutting edge of the cutting element. Additionally, DOCC 502 may be configured to control the depth of cut of cutting elements that overlap the rotational path of DOCC 502. In the same or alternative embodiments, DOCC 502 may be configured based on the cutting zones of cutting elements that overlap the rotational path of DOCC 502.

To provide a frame of reference, FIG. 5A includes an x-axis and a y-axis and FIG. 5B includes a z-axis that may be associated with rotational axis 104 of drill bit 101 and a radial axis (R) that indicates the orthogonal distance from the center of bit 101 in the xy-plane. Accordingly, a coordinate or position corresponding to the z-axis may be referred to as an axial coordinate or axial position of the bit face profile. Additionally, a location along the bit face may be described by x and y coordinates of an xy-plane substantially perpendicular to the z-axis. The distance from the center of drill bit 101 (e.g., rotational axis 104) to a point in the xy plane of the bit face may indicate the radial coordinate or radial position of the point on the bit face profile of drill bit 101. For example, the radial coordinate, r, of a point in the xy plane having an x coordinate, x, and a y coordinate, y, may be expressed by the following equation:

$$r=\sqrt{x^2+y^2}$$

Additionally, a point in the xy plane may have an angular coordinate that may be an angle between a line extending from the center of drill bit 101 (e.g., rotational axis 104) to the point and the x-axis. For example, the angular coordinate (θ) of a point in the xy plane having an x-coordinate, x, and a y-coordinate, y, may be expressed by the following equation:

$$\theta=\arctan(y/x)$$

As a further example, a point 504 located on the cutting edge of cutting element 128*a* (as depicted in FIGS. 5A and 5B) may have an x-coordinate ($X_{504}$) and a y-coordinate ($Y_{504}$) in the xy plane that may be used to calculate a radial coordinate ($R_{504}$) of point 504 (e.g., $R_{504}$ may be equal to the square root of $X_{504}$ squared plus $Y_{504}$ squared). $R_{504}$ may accordingly indicate an orthogonal distance of point 504 from rotational axis 104. Additionally, point 504 may have an angular coordinate ($\theta_{504}$) that may be the angle between the x-axis and the line extending from rotational axis 104 to point 504 (e.g., $\theta_{504}$ may be equal to arctan ($X_{504}/Y_{504}$)). Further, as depicted in FIG. 5B, point 504 may have an axial coordinate ($Z_{504}$) that may represent a position along the z-axis that may correspond to point 504. It is understood that the coordinates are used for illustrative purposes only, and that any other suitable coordinate system or configuration, may be used to provide a frame of reference of points along the bit face and bit face profile of drill bit 101. Additionally, any suitable units may be used. For example, the angular position may be expressed in degrees or in radians.

Drill bit 101 may include bit body 124 with a plurality of blades 126 positioned along bit body 124. In the illustrated embodiment, drill bit 101 may include blades 126*a*-126*c*, however it is understood that in other embodiments, drill bit 101 may include more or fewer blades 126. Blades 126 may include outer cutting elements 128 and inner cutting elements 129 disposed along blades 126. For example, blade 126*a* may include outer cutting element 128*a* and inner cutting element 129*a*, blade 126*b* may include outer cutting element 128*b* and inner cutting element 129*b* and blade 126*c* may include outer cutting element 128*c* and inner cutting element 129*c*.

As mentioned above, drill bit 101 may include one or more DOCCs 502. In the present illustration, only one DOCC 502 is depicted, however drill bit 101 may include more DOCCs 502. Drill bit 101 may rotate about rotational axis 104 in direction 506. Accordingly, DOCC 502 may be placed behind cutting element 128*a* on blade 126*a* with respect to the rotational direction 506. However, in alternative embodiments DOCC 502 may placed in front of cutting element 128*a* (e.g., on blade 126*b*) such that DOCC 502 is in front of cutting element 128*a* with respect to the rotational direction 506.

As drill bit 101 rotates, DOCC 502 may follow a rotational path indicated by radial swath 508 of drill bit 101. Radial swath 508 may be defined by radial coordinates $R_1$ and $R_2$. $R_1$ may indicate the orthogonal distance from rotational axis 104 to the inside edge of DOCC 502 (with respect to the center of drill bit 101). $R_2$ may indicate the orthogonal distance from rotational axis 104 to the outside edge of DOCC 502 (with respect to the center of drill bit 101).

As shown in FIGS. 5A and 5B, cutting elements 128 and 129 may each include a cutting zone 505. In the illustrated embodiment, cutting zones 505 of cutting elements 128 and 129 may not overlap at a specific depth of cut. This lack of overlap may occur for some bits with a small number of blades and a small number of cutting elements at a small depth of cut. The lack of overlap between cutting zones may also occur for cutting elements located within the cone zone of fixed cutter bits because the number of blades within the cone zone is usually small. In such instances, a DOCC 502 or a portion of a blade 126 may be designed and configured according to the location of the cutting zone 505 and cutting edge of a cutting element 128 or 129 with a depth of cut that may be controlled by the DOCC 502 or blade 126.

Figure 6A:
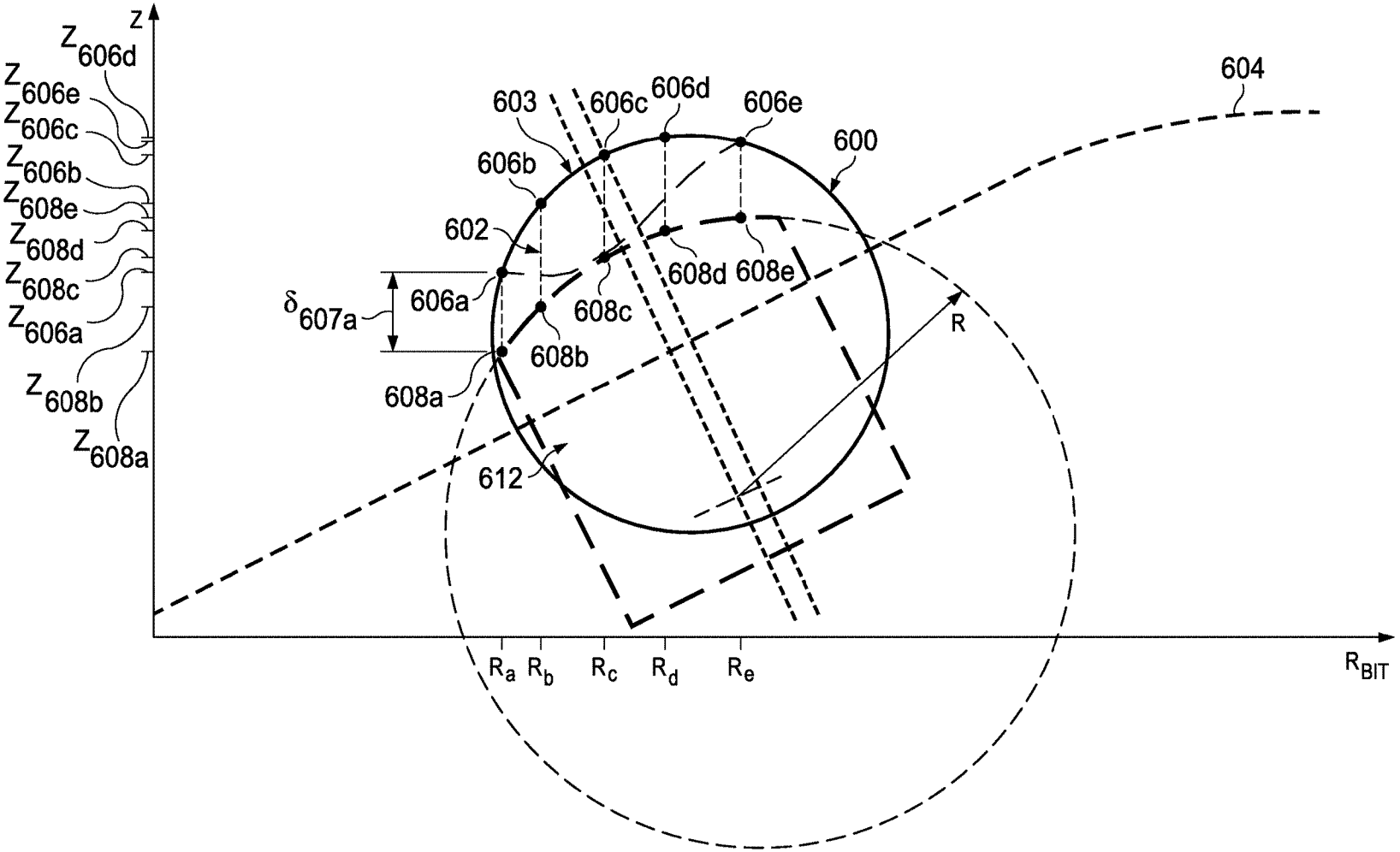
FIG. 6A illustrates a graph of the bit face profile of a cutting element having a cutting zone with a depth of cut that may be controlled by a depth of cut controller (DOCC) designed in accordance with some embodiments of the present disclosure.
Figure 6B:
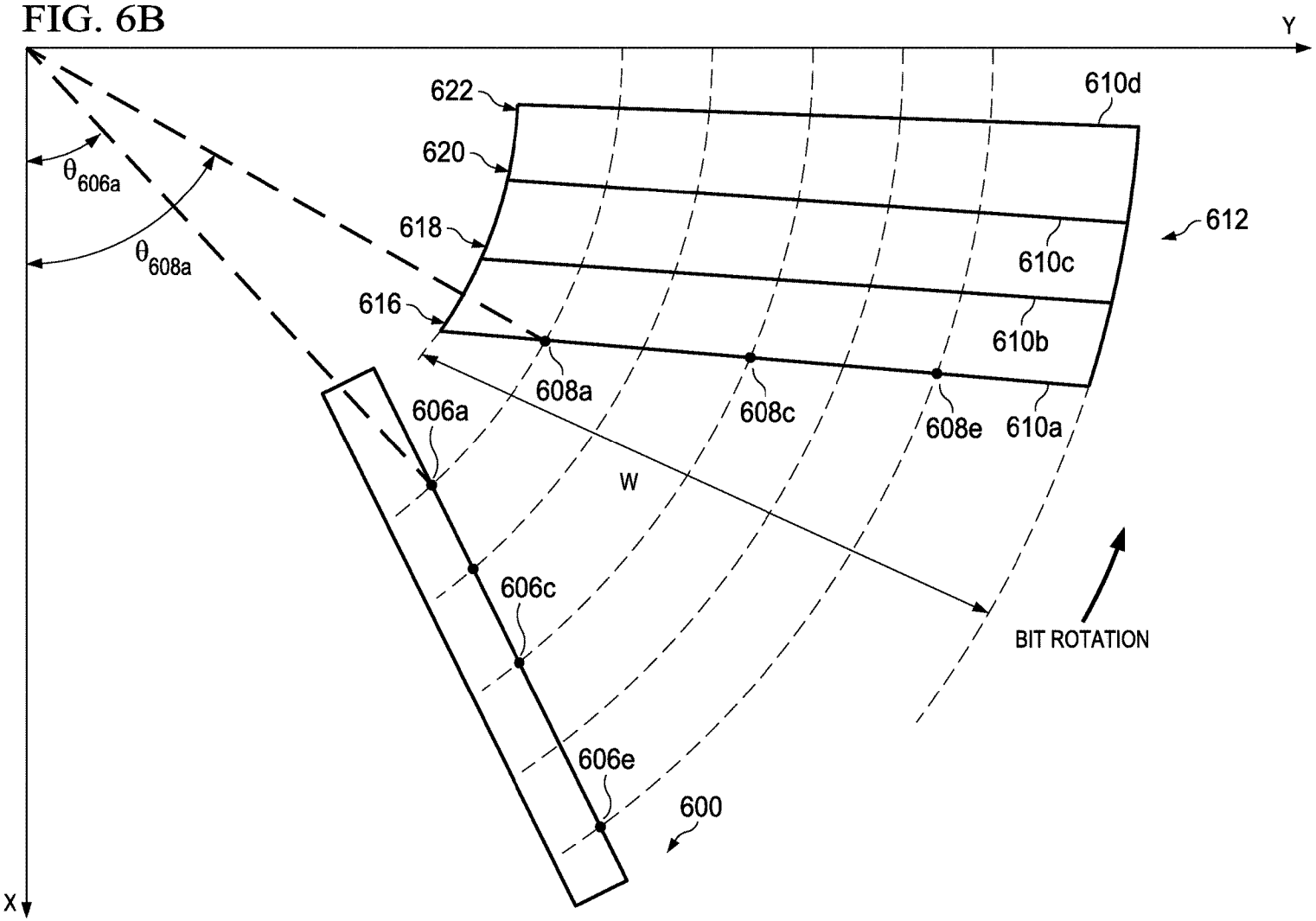
FIG. 6B illustrates a graph of the bit face illustrated in the bit face profile of FIG. 6A, in accordance with some embodiments of the present disclosure.
Figure 6C:
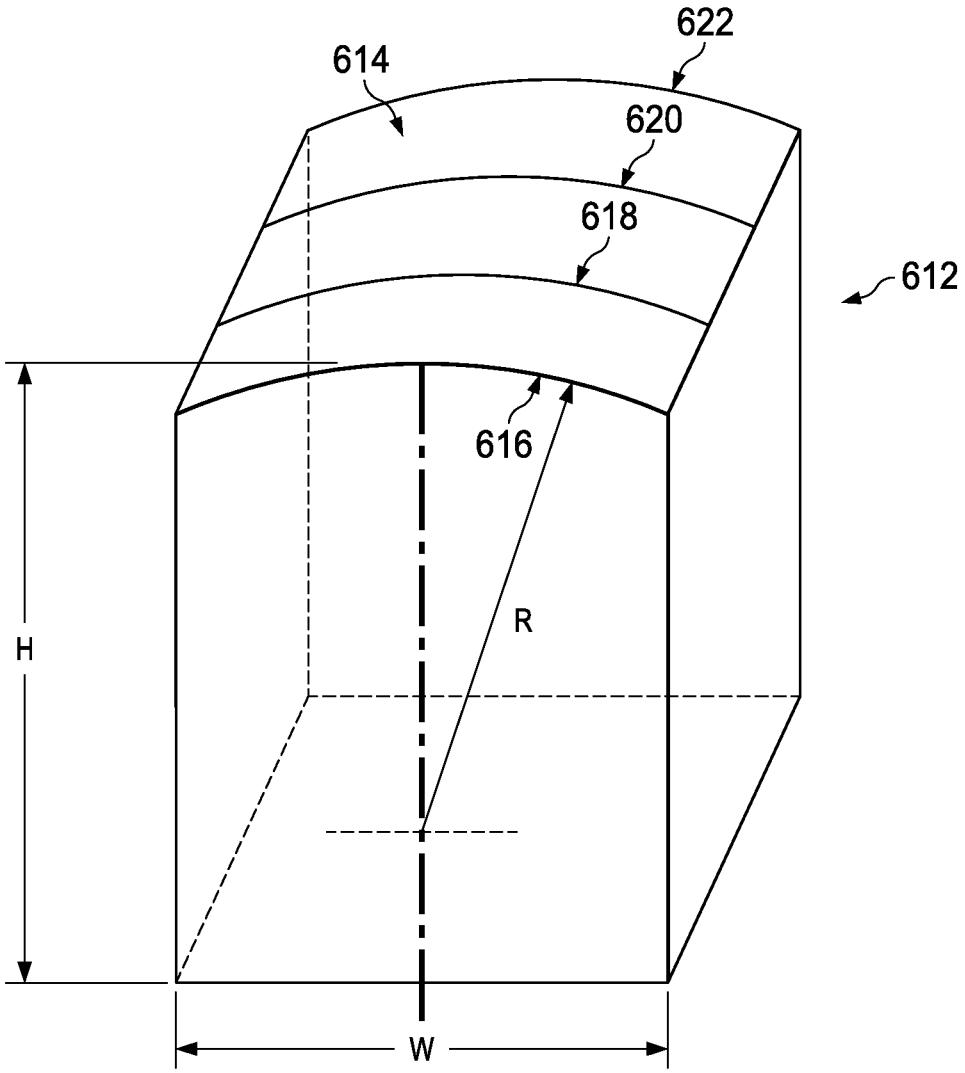
FIG. 6C illustrates the DOCC of FIG. 6A designed according to some embodiments of the present disclosure.
Figure 7:
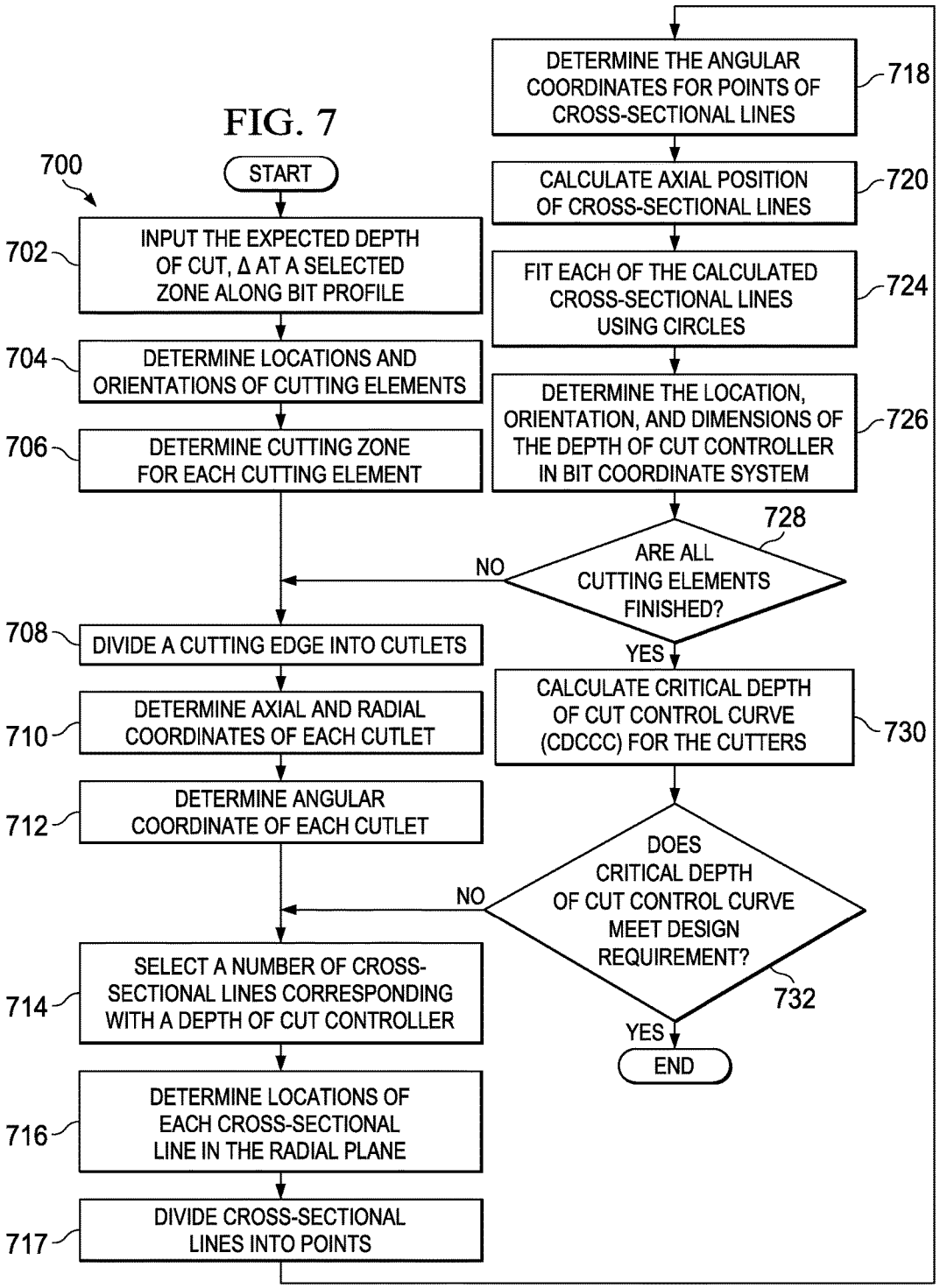
FIG. 7 illustrates a flow chart of an example method for designing one or more DOCCs according to the cutting zones of one or more cutting elements, in accordance with some embodiments of the present disclosure.

For example, cutting element 128*a* may include a cutting zone 505 and associated cutting edge that overlaps the rotational path of DOCC 502 such that DOCC 502 may be configured according to the location of the cutting edge of cutting element 128*a*, as described in detail with respect to FIGS. 6 and 7. In the same or alternative embodiments, the surface of a blade 126 (e.g., the surface of blade 126*b*) may also be configured according to the location of the cutting edge of cutting element 128*a* to control the depth of cut of cutting element 128*a*, as described in detail with respect to FIGS. 8 and 9.

Therefore, as discussed further below, DOCC 502 may be configured to control the depth of cut of cutting element 128*a* that may intersect or overlap radial swath 508. Additionally, as described in detail below, in the same or alternative embodiments, the surface of one or more blades 126 within radial swath 508 may be configured to control the depth of cut of cutting element 128*a* located within radial swath 508. Further, DOCC 502 and the surface of one or more blades 126 may be configured according to the location of the cutting zone and the associated cutting edge of cutting elements 128*a* that may be located within radial swath 508.

Modifications, additions or omissions may be made to FIGS. 5A and 5B without departing from the scope of the present disclosure. For example, the number of blades 126, cutting elements 128 and DOCCs 502 may vary according to the various design constraints and considerations of drill bit 101. Additionally, radial swath 508 may be larger or smaller than depicted or may be located at a different radial location, or any combination thereof.

FIGS. 6A-6C illustrate DOCC 612 that may be designed according to the location of a cutting zone 602 of a cutting element 600 of a drill bit such as that depicted in FIGS. 5A and 5B. The coordinate system used in FIGS. 6A-6C may be substantially similar to that described with respect to FIGS. 5A and 5B. Therefore, the rotational axis of the drill bit corresponding with FIGS. 6A-6C may be associated with the z-axis of a Cartesian coordinate system to define an axial position with respect to the drill bit. Additionally, an xy plane of the coordinate system may correspond with a plane of the bit face of the drill bit that is substantially perpendicular to the rotational axis. Coordinates on the xy plane may be used to define radial and angular coordinates associated with the drill bit of FIGS. 6A-6C.

FIG. 6A illustrates a graph of a bit face profile of a cutting element 600 that may be controlled by a depth of cut controller (DOCC) 612 located on a blade 604 and designed in accordance with some embodiments of the present disclosure. FIG. 6A illustrates the axial and radial coordinates of cutting element 600 and DOCC 612 configured to control the depth of cut of cutting element 600 based on the location of a cutting zone 602 (and its associated cutting edge 603) of cutting element 600. In some embodiments, DOCC 612 may be located on the same blade 604 as cutting element 600, and, in other embodiments, DOCC 612 may be located on a different blade 604 as cutting element 600. Cutting edge 603 of cutting element 600 that corresponds with cutting zone 602 may be divided according to cutlets 606*a*-606*e* that have radial and axial positions depicted in FIG. 6A. Additionally, FIG. 6A illustrates the radial and axial positions of control points 608*a*-608*e* that may correspond with a back edge 616 of DOCC 612, as described in further detail with respect to FIG. 6B.

As depicted in FIG. 6A, the radial coordinates of control points 608*a*-608*e* may be determined based on the radial coordinates of cutlets 606*a*-606*e* such that each of control points 608*a*-608*e* respectively may have substantially the same radial coordinates as cutlets 606*a*-606*e*. By basing the radial coordinates of control points 608*a*-608*e* on the radial coordinates of cutlets 606*a*-606*e*, DOCC 612 may be configured such that its radial swath substantially overlaps the radial swath of cutting zone 602 to control the depth of cut of cutting element 600. Additionally, as discussed in further detail below, the axial coordinates of control points 608*a*-608*e* may be determined based on a desired depth of cut, Δ, of cutting element 600 and a corresponding desired axial underexposure, $\delta_{607i}$, of control points 608*a*-608*e* with respect to cutlets 606*a*-606*e*. Therefore, DOCC 612 may be configured according to the location of cutting zone 602 and cutting edge 603.

FIG. 6B illustrates a graph of the bit face illustrated in the bit face profile of FIG. 6A. DOCC 612 may be designed according to calculated coordinates of cross-sectional lines 610 that may correspond with cross-sections of DOCC 612. For example, the axial, radial and angular coordinates of a back edge 616 of DOCC 612 may be determined and designed according to determined axial, radial and angular coordinates of cross-sectional line 610*a*. In the present disclosure, the term "back edge" may refer to the edge of a component that is the trailing edge of the component as a drill bit associated with the drill bit rotates. The term "front edge" may refer to the edge of a component that is the leading edge of the component as the drill bit associated with the component rotates. The axial, radial and angular coordinates of cross-sectional line 610*a* may be determined according to cutting edge 603 associated with cutting zone 602 of cutting element 600, as described below.

As mentioned above, cutting edge 603 may be divided into cutlets 606*a*-606*e* that may have various radial coordinates defining a radial swath of cutting zone 602. A location of cross-sectional line 610*a* in the xy plane may be selected such that cross-sectional line 610*a* is associated with a blade 604 where DOCC 612 may be disposed. The location of cross-sectional line 610*a* may also be selected such that cross-sectional line 610*a* intersects the radial swath of cutting edge 603. Cross-sectional line 610*a* may be divided into control points 608*a*-608*e* having substantially the same radial coordinates as cutlets 606*a*-606*e*, respectively. Therefore, in the illustrated embodiment, the radial swaths of cutlets 606*a*-606*e* and control points 608*a*-608*e*, respectively, may be substantially the same. With the radial swaths of cutlets 606*a*-606*e* and control points 608*a*-608*e* being substantially the same, the axial coordinates of control points 608*a*-608*e* at back edge 616 of DOCC 612 may be determined for cross-sectional line 610*a* to better obtain a desired depth of cut control of cutting edge 603 at cutlets 606*a*-606*e*, respectively. Accordingly, in some embodiments, the axial, radial and angular coordinates of DOCC 612 at back edge 616 may be designed based on calculated axial, radial and angular coordinates of cross-sectional line 610*a* such that DOCC 612 may better control the depth of cut of cutting element 600 at cutting edge 603.

The axial coordinates of each control point 608 of cross-sectional line 610*a* may be determined based on a desired axial underexposure $\delta_{607i}$ between each control point 608 and its respective cutlet 606. The desired axial underexposure $\delta_{607i}$ may be based on the angular coordinates of a control point 608 and its respective cutlet 606 and the desired depth of cut Δ of cutting element 600. For example, the desired axial underexposure $\delta_{607a}$ of control point 608*a* with respect to cutlet 606*a* (depicted in FIG. 6A) may be based on the angular coordinate ($\theta_{608a}$) of control point 608*a*, the angular coordinate ($\theta_{606a}$) of cutlet 606*a* and the desired depth of cut Δ of cutting element 600. The desired axial underexposure $\delta_{607a}$ of control point 608*a* may be expressed by the following equation:

$$\delta_{607a}=\Delta*(360-(\theta_{608a}-\theta_{606a}))/360$$

In this equation, the desired depth of cut Δ may be expressed as a function of rate of penetration (ROP, ft/hr) and bit rotational speed (RPM) by the following equation:

$$\Delta=ROP/(5*RPM)$$

The desired depth of cut Δ may have a unit of inches per bit revolution. The desired axial underexposures of control points 608*b*-608*e* ($\delta_{607b}$-$\delta_{607e}$, respectively) may be similarly determined. In the above equation, $\theta_{606a}$ and $\theta_{608a}$ may be expressed in degrees, and "360" may represent one full revolution of approximately 360 degrees. Accordingly, in instances where $\theta_{606a}$ and $\theta_{608a}$ may be expressed in radians, "360" may be replaced by "2π" Further, in the above equation, the resultant angle of "($\theta_{608a}-\theta_{606a}$)" ($\Delta_\theta$) may be defined as always being positive. Therefore, if resultant angle $\Delta_\theta$ is negative, then $\Delta_\theta$ may be made positive by adding 360 degrees (or 2π radians) to $\Delta_\theta$.

Additionally, the desired depth of cut (Δ) may be based on the desired ROP for a given RPM of the drill bit, such that DOCC 612 may be designed to be in contact with the formation at the desired ROP and RPM, and, thus, control the depth of cut of cutting element 600 at the desired ROP and RPM. The desired depth of cut Δ may also be based on the location of cutting element 600 along blade 604. For example, in some embodiments, the desired depth of cut Δ may be different for the cone portion, the nose portion, the shoulder portion the gage portion, or any combination thereof, of the bit profile portions. In the same or alternative embodiments, the desired depth of cut Δ may also vary for subsets of one or more of the mentioned zones along blade 604.

In some instances, cutting elements within the cone portion of a drill bit may wear much less than cutting elements within the nose and gauge portions. Therefore, the desired depth of cut Δ for a cone portion may be less than that for the nose and gauge portions. Thus, in some embodiments, when the cutting elements within the nose and/or gauge portions wear to some level, then DOCC 612 located in the nose and/or gauge portions may begin to control the depth of cut of the drill bit.

Once the desired underexposure $\delta_{607i}$ of each control point 608 is determined, the axial coordinate ($Z_{608i}$) of each control point 608 as illustrated in FIG. 6A may be determined based on the desired underexposure $\delta_i$ of the control point 608 with respect to the axial coordinate ($Z_{606i}$) of its corresponding cutlet 606. For example, the axial coordinate of control point 608*a* ($Z_{608a}$) may be determined based on the desired underexposure of control point 608*a* ($\delta_{607a}$) with respect to the axial coordinate of cutlet 606 ($Z_{606a}$), which may be expressed by the following equation:

$$Z_{608a}=Z_{606a}-\delta_{607a}$$

Once the axial, radial and angular coordinates for control points 608 are determined for cross-sectional line 610*a*, back edge 616 of DOCC 612 may be designed according to these points such that back edge 616 has approximately the same axial, radial and angular coordinates of cross-sectional line 610*a*. In some embodiments, the axial coordinates of control points 608 of cross-sectional line 610*a* may be smoothed by curve fitting technologies. For example, if an MDR is designed based on the calculated coordinates of control points 608, then the axial coordinates of control points 608 may be fit by one or more circular lines. Each of the circular lines may have a center and a radius that may be used to design the MDR. The surface of DOCC 612 at intermediate cross-sections 618 and 620 and at front edge 622 may be similarly designed based on determining radial, angular, and axial coordinates of cross-sectional lines 610*b*, 610*c*, and 610*d*, respectively.

Accordingly, the surface of DOCC 612 may be configured at least partially based on the locations of cutting zone 602 and cutting edge 603 of cutting element 600 to improve the depth of cut control of cutting element 600. Additionally, the height and width of DOCC 612 and its placement in the radial plane of the drill bit may be configured based on cross-sectional lines 610, as described in further detail with respect to FIG. 6C. Therefore, the axial, radial and angular coordinates of DOCC 612 may be such that the desired depth of cut control of cutting element 600 is improved. As shown in FIGS. 6A and 6B, configuring DOCC 612 based on the locations of cutting zone 602 and cutting edge 603 may cause DOCC 612 to be radially aligned with the radial swath of cutting zone 602 but may also cause DOCC 612 to be radially offset from the center of cutting element 600, which may differ from traditional DOCC placement methods.

FIG. 6C illustrates DOCC 612 designed according to the present disclosure. DOCC 612 may include a surface 614 with back edge 616, a first intermediate cross-section 618, a second intermediate cross-section 620 and a front edge 622. As discussed with respect to FIG. 6B, back edge 616 may correspond with cross-sectional line 610*a*. Additionally, first intermediate cross-section 618 may correspond with cross-sectional line 610*b*, second intermediate cross-section 620 may correspond with cross-sectional line 610*c* and front edge 622 may correspond with cross-sectional line 610*d*.

As mentioned above, the curvature of surface 614 may be designed according to the axial curvature made by the determined axial coordinates of cross-sectional lines 610. Accordingly, the curvature of surface 614 along back edge 616 may have a curvature that approximates the axial curvature of cross-sectional line 610*a*; the curvature of surface 614 along first intermediate cross-section 618 may approximate the axial curvature of cross-sectional line 610*b*; the curvature of surface 614 along second intermediate cross-section 620 may approximate the axial curvature of cross-sectional line 610*c*; and the curvature of surface 614 along front edge 622 may approximate the axial curvature of cross-sectional line 610*d*. In the illustrated embodiment and as depicted in FIGS. 6A and 6C, the axial curvature of cross-sectional line 610*a* may be approximated by the curvature of a circle with a radius "R," such that the axial curvature of back edge 616 may be substantially the same as the circle with radius "R."

The axial curvature of cross-sectional lines 610*a*-610*d* may or may not be the same, and accordingly the curvature of surface 614 along back edge 616, intermediate cross-sections 618 and 620, and front edge 622 may or may not be the same. In some instances where the curvature is not the same, the approximated curvatures of surface 614 along back edge 616, intermediate cross-sections 618 and 620, and front edge 622 may be averaged such that the overall curvature of surface 614 is the calculated average curvature. Therefore, the determined curvature of surface 614 may be substantially constant to facilitate manufacturing of surface 614. Additionally, although shown as being substantially fit by the curvature of a single circle, it is understood that the axial curvature of one or more cross-sectional lines 610 may be fit by a plurality of circles, depending on the shape of the axial curvature.

DOCC 612 may have a width W that may be large enough to cover the width of cutting zone 602 and may correspond to the length of a cross-sectional line 610. Additionally, the height H of DOCC 612, as shown in FIG. 6C, may be configured such that when DOCC 612 is placed on blade 604, the axial positions of surface 614 sufficiently correspond with the calculated axial positions of the cross-sectional lines used to design surface 614. The height H may correspond with the peak point of the curvature of surface 614 that corresponds with a cross-sectional line. For example, the height H of DOCC 612 at back edge 616 may correspond with the peak point of the curvature of DOCC 612 at back edge 616. Additionally, the height H at back edge 616 may be configured such that when DOCC 612 is placed at the calculated radial and angular positions on blade 604 (as shown in FIG. 6B), surface 614 along back edge 616 may have approximately the same axial, angular and radial positions as control points 608*a*-608*e* calculated for cross-sectional line 610*a*.

In some embodiments where the curvature of surface 614 varies according to different curvatures of the cross-sectional lines, the height H of DOCC 612 may vary according to the curvatures associated with the different cross-sectional lines. For example, the height with respect to back edge 616 may be different than the height with respect to front edge 622. In other embodiments where the curvature of the cross-sectional lines is averaged to calculate the curvature of surface 614, the height H of DOCC 612 may correspond with the peak point of the curvature of the entire surface 614.

In some embodiments, the surface of DOCC 612 may be designed using the three dimensional coordinates of the control points of all the cross-sectional lines. The axial coordinates may be smoothed using a two dimensional interpolation method such as a MATLAB® function called interp2.

Modifications, additions or omissions may be made to FIGS. 6A-6C without departing from the scope of the present disclosure. Although a specific number of cross-sectional lines, points along the cross-sectional lines and cutlets are described, it is understood that any appropriate number may be used to configure DOCC 612 to acquire the desired depth of cut control. In one embodiment, the number of cross-sectional lines may be determined by the size and the shape of a DOCC. For example, if a hemi-spherical component is used as a DOCC, (e.g., an MDR) then only one cross sectional line may be needed. If an impact arrestor (semi-cylinder like) is used, then more cross-sectional lines (e.g., at least two) may be used. Additionally, although the curvature of the surface of DOCC 612 is depicted as being substantially round and uniform, it is understood that the surface may have any suitable shape that may or may not be uniform, depending on the calculated surface curvature for the desired depth of cut. Further, although the above description relates to a DOCC designed according to the cutting zone of one cutting element, a DOCC may be designed according to the cutting zones of a plurality of cutting elements to control the depth of cut of more than one cutting element, as described in further detail below.

FIG. 7 illustrates a flow chart of an example method 700 for designing one or more DOCCs (e.g., DOCC 612 of FIGS. 6A-6C) according to the location of the cutting zone and its associated cutting edge of a cutting element. In the illustrated embodiment the cutting structures of the bit including at least the locations and orientations of all cutting elements may have been previously designed. However in other embodiments, method 700 may include steps for designing the cutting structure of the drill bit.

The steps of method 700 may be performed by various computer programs, models or any combination thereof, configured to simulate and design drilling systems, apparatuses and devices. The programs and models may include instructions stored on a computer readable medium and operable to perform, when executed, one or more of the steps described below. The computer readable media may include any system, apparatus or device configured to store and retrieve programs or instructions such as a hard disk drive, a compact disc, flash memory or any other suitable device. The programs and models may be configured to direct a processor or other suitable unit to retrieve and execute the instructions from the computer readable media. Collectively, the computer programs and models used to simulate and/or design drilling systems may be referred to as a "drilling engineering design system" or "engineering design system." Further, design parameters and/or results of any simulations and/or calculations performed by the engineering design system may be output to a visual display of the engineering design system.

Method 700 may start and, at step 702, the engineering design system may determine a desired depth of cut ("Δ") at a selected zone along a bit profile. As mentioned above, the desired depth of cut Δ may be based on the desired ROP for a given RPM, such that the DOCCs within the bit profile zone (e.g., cone zone, shoulder zone, etc.) may be designed to be in contact with the formation at the desired ROP and RPM, and, thus, control the depth of cut of cutting elements in the cutting zone at the desired ROP and RPM.

At step 704, the locations and orientations of cutting elements within the selected zone may be determined. At step 706, the engineering design system may create a 3D cutter/formation interaction model that may determine the cutting zone for each cutting element in the design based at least in part on the expected depth of cut Δ for each cutting element. As noted above, the cutting zone and cutting edge for each cutting element may be based on the axial and radial coordinates of the cutting element.

At step 708, using the engineering design system, the cutting edge within the cutting zone of each of the cutting elements may be divided into cutting points ("cutlets") of the bit face profile. For illustrative purposes, the remaining steps are described with respect to designing a DOCC with respect to one of the cutting elements, but it is understood that the steps may be followed for each DOCC of a drill bit, either at the same time or sequentially.

At step 710, the axial and radial coordinates for each cutlet along the cutting edge of a selected cutting element associated with the DOCC may be calculated with respect to the bit face (e.g., the axial and radial coordinates of cutlets 606 of FIGS. 6A and 6B may be determined). Additionally, at step 712, the angular coordinate of each cutlet may be calculated in the radial plane of the bit face.

At step 714, the locations of a number of cross-sectional lines in the radial plane corresponding to the placement and design of a DOCC associated with the cutting element may be determined (e.g., cross-sectional lines 610 associated with DOCC 612 of FIGS. 6A-6C). The cross-sectional lines may be placed within the radial swath of the cutting zone of the cutting element such that they intersect the radial swath of the cutting zone, and, thus have a radial swath that substantially covers the radial swath of the cutting zone. In some embodiments, the length of the cross-sectional lines may be based on the width of the cutting zone and cutting edge such that the radial swath of the cutting zone and cutting edge is substantially intersected by the cross-sectional lines. Therefore, as described above, the cross-sectional lines may be used to model the shape, size and configuration of the DOCC such that the DOCC controls the depth of cut of the cutting element at the cutting edge of the cutting element.

Further, the number of cross-sectional lines may be determined based on the desired size of the DOCC to be designed as well as the desired precision in designing the DOCC. For example, the larger the DOCC, the more cross-sectional lines may be used to adequately design the DOCC within the radial swath of the cutting zone and thus provide a more consistent depth of cut control for the cutting zone.

At step 716, the locations of the cross-sectional lines disposed on a blade may be determined (e.g., the locations of cross-sectional lines 610 in FIG. 6B) such that the radial coordinates of the cross-sectional lines substantially intersect the radial swath of the cutting zone of the cutting element. At step 717, each cross-sectional line may be divided into points with radial coordinates that substantially correspond with the radial coordinates of the cutlets determined in step 708 (e.g., cross-sectional line 610*a* divided into points 608 of FIGS. 6A-6C). At step 718, the engineering design system may be used to determine the angular coordinate for each point of each cross-sectional line in a plane substantially perpendicular to the bit rotational axis (e.g., the xy plane of FIGS. 6A-6C). At step 720, the axial coordinate for each point on each cross-sectional line may also be determined by determining a desired axial underexposure between the cutlets of the cutting element and each respective point of the cross-sectional lines corresponding with the cutlets, as described above with respect to FIGS. 6A-6C. After determining the axial underexposure for each point of each cross-sectional line, the axial coordinate for each point may be determined by applying the underexposure of each point to the axial coordinate of the cutlet associated with the point, also as described above with respect to FIGS. 6A-6C.

After calculating the axial coordinate of each point of each cross-sectional line based on the cutlets of a cutting zone of an associated cutting element, (e.g., the axial coordinates of points 608*a*-608*e* of cross-sectional line 610*a* based on cutlets 606*a*-606*e* of FIGS. 6A-6C) at step 720, method 700 may proceed to steps 724 and 726 where a DOCC may be designed according to the axial, angular, and radial coordinates of the cross-sectional lines.

In some embodiments, at step 724, for each cross-sectional line, the curve created by the axial coordinates of the points of the cross-sectional line may be fit to a portion of a circle. Accordingly, the axial curvature of each cross-sectional line may be approximated by the curvature of a circle. Thus, the curvature of each circle associated with each cross-sectional line may be used to design the three-dimensional surface of the DOCC to approximate a curvature for the DOCC that may improve the depth of cut control. In some embodiments, the surface of the DOCC may be approximated by smoothing the axial coordinates of the surface using a two dimensional interpolation method, such as a MATLAB® function called interp2.

In step 726, the width of the DOCC may also be configured. In some embodiments, the width of the DOCC may be configured to be as wide as the radial swath of the cutting zone of a corresponding cutting element. Thus, the cutting zone of the cutting element may be located within the rotational path of the DOCC such that the DOCC may provide the appropriate depth of cut control for the cutting element. Further, at step 726, the height of the DOCC may be designed such that the surface of the DOCC is approximately at the same axial position as the calculated axial coordinates of the points of the cross-sectional lines. Therefore, the engineering design system may be used to design a DOCC according to the location of the cutting zone and cutting edge of a cutting element.

After determining the location, orientation and dimensions of a DOCC at step 726, method 700 may proceed to step 728. At step 728, it may be determined if all the DOCCs have been designed. If all of the DOCCs have not been designed, method 700 may repeat steps 708-726 to design another DOCC based on the cutting zones of one or more other cutting elements.

At step 730, once all of the DOCCs are designed, a critical depth of cut control curve (CDCCC) may be calculated using the engineering design system. The CDCCC may be used to determine how even the depth of cut is throughout the desired zone. At step 732, using the engineering design system, it may be determined whether the CDCCC indicates that the depth of cut control meets design requirements. If the depth of cut control meets design requirements, method 700 may end. Calculation of the CDCCC is described in further detail with respect to FIGS. 10A-10C and FIG. 11.

If the depth of cut control does not meet design requirements, method 700 may return to step 714, where the design parameters may be changed. For example, the number of cross-sectional lines may be increased to better design the surface of the DOCC according to the location of the cutting zone and cutting edge. Further, the angular coordinates of the cross-sectional line may be changed. In other embodiments, if the depth of cut control does not meet design requirements, method 700 may return to step 708 to determine a larger number of cutlets for dividing the cutting edge, and thus better approximate the cutting edge. Additionally, as described further below, the DOCC may be designed according to the locations of the cutting zones and cutting edges of more than one cutting element that may be within the radial swath of the DOCC.

Additionally, method 700 may be repeated for configuring one or more DOCCs to control the depth of cut of cutting elements located within another zone along the bit profile by inputting another expected depth of cut, Δ, at step 702. Therefore, one or more DOCCs may be configured for the drill bit within one or more zones along the bit profile of a drill bit according to the locations of the cutting edges of the cutting elements to improve the depth of cut control of the drill bit.

Modifications, additions or omissions may be made to method 700 without departing from the scope of the disclosure. For example, the order of the steps may be changed. Additionally, in some instances, each step may be performed with respect to an individual DOCC and cutting element until that DOCC is designed for the cutting element and then the steps may be repeated for other DOCCs or cutting elements. In other instances, each step may be performed with respect to each DOCC and cutting element before moving onto the next step. Similarly, steps 716 through 724 may be done for one cross-sectional line and then repeated for another cross-sectional line, or steps 716 through 724 may be performed for each cross-sectional line at the same time, or any combination thereof. Further, the steps of method 700 may be executed simultaneously, or broken into more steps than those described. Additionally, more steps may be added or steps may be removed without departing from the scope of the disclosure.

Once one or more DOCCs are designed using method 700, a drill bit may be manufactured according to the calculated design constraints to provide a more constant and even depth of cut control of the drill bit. The constant depth of cut control may be based on the placement, dimensions and orientation of DOCCs, such as impact arrestors, in both the radial and axial positions with respect to the cutting zones and cutting edges of the cutting elements. In the same or alternative embodiments, the depth of cut of a cutting element may be controlled by a blade.

Figure 8A:
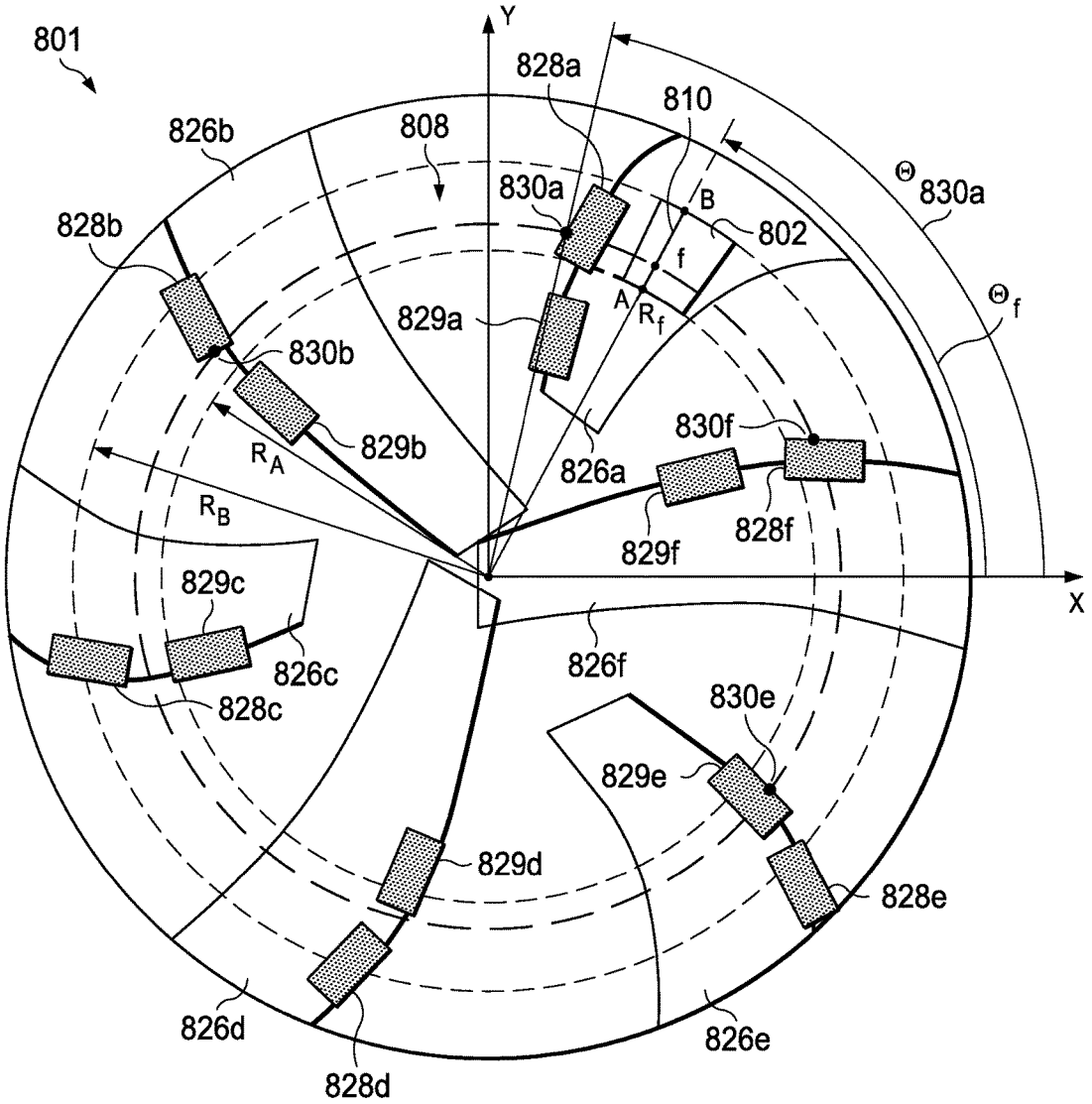
FIG. 8A illustrates the face of a drill bit with a DOCC configured in accordance with some embodiments of the present disclosure.
Figure 8B:
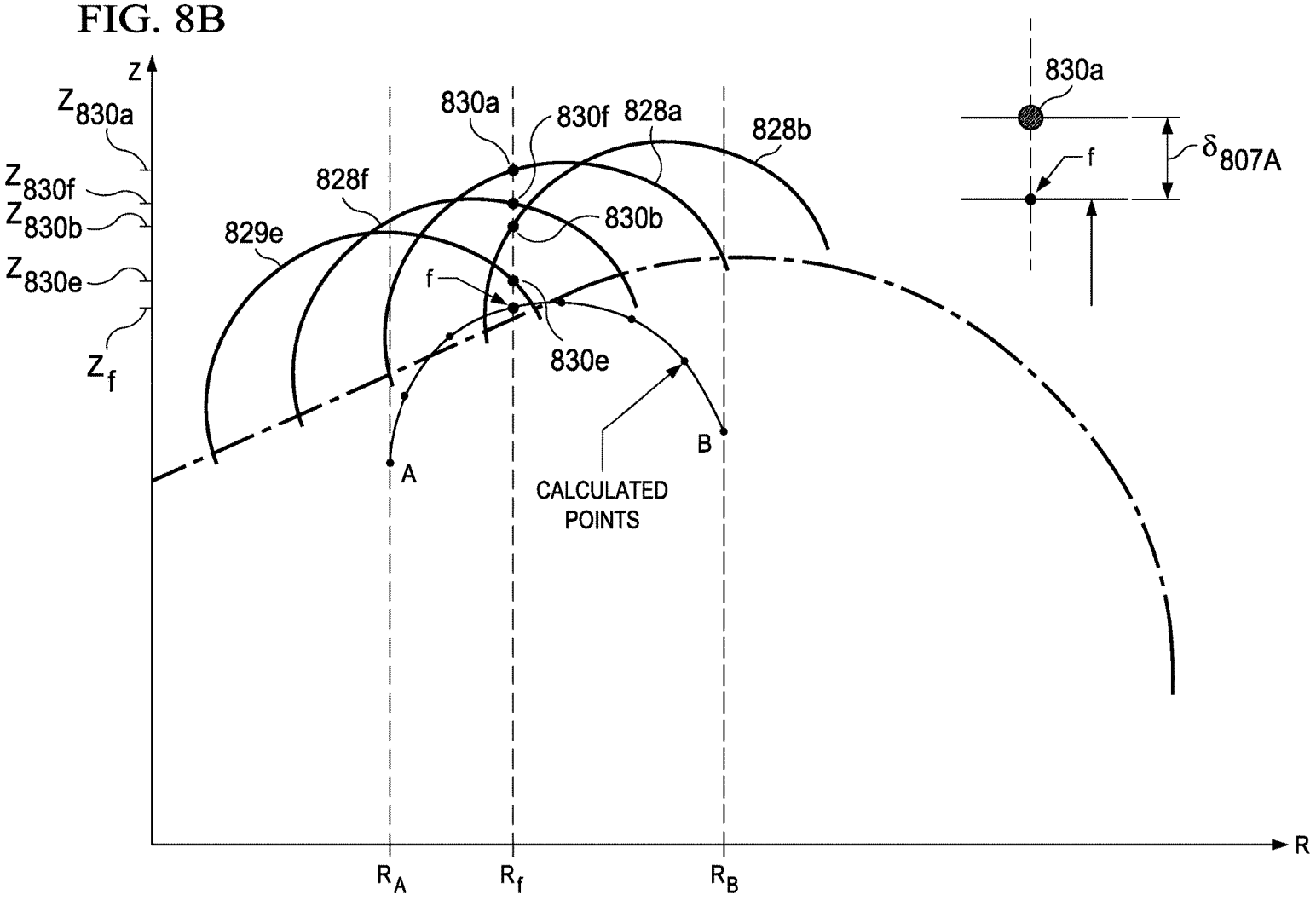
FIG. 8B illustrates a graph of a bit face profile of the bit face illustrated in FIG. 8A, in accordance with some embodiments of the present disclosure.
Figure 8C:
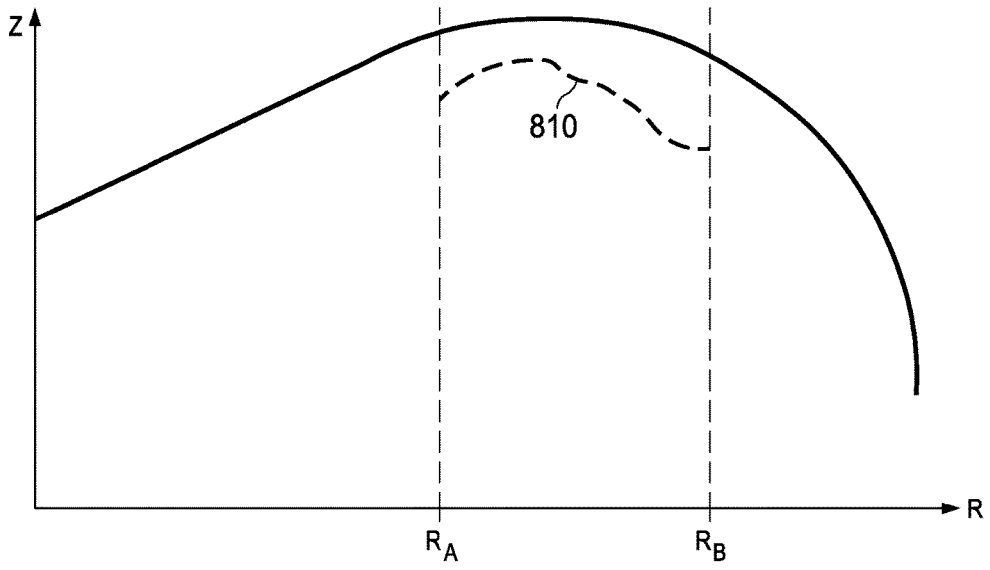
FIG. 8C illustrates an example of the axial coordinates and curvature of a cross-sectional line configured such that a DOCC may control the depth of cut of a drill bit to a desired depth of cut, in accordance with some embodiments of the present disclosure.

FIGS. 8A-8C illustrate a DOCC 802 configured to control the depth of cut of cutting elements 828 and 829 located within a swath 808 of drill bit 801. FIG. 8A illustrates the face of drill bit 801 that may include blades 826, outer cutting elements 828 and inner cutting elements 829 disposed on blades 826. In the illustrated embodiment, DOCC 802 is located on a blade 826*a* and configured to control the depth of cut of all cutting elements 828 and 829 located within swath 808 of drill bit 801.

A desired critical depth of cut $\Delta_1$ per revolution (shown in FIG. 8D) may be determined for the cutting elements 828 and 829 within radial swath 808 of drill bit 801. Radial swath 808 may be located between a first radial coordinate $R_A$ and a second radial coordinate $R_B$. $R_A$ and $R_B$ may be determined based on the available sizes that may be used for DOCC 802. For example, if an MDR is used as DOCC 802, then the width of radial swath 808 (e.g., $R_B-R_A$) may be equal to the diameter of the MDR. As another example, if an impact arrestor is selected as DOCC 802, then the width of radial swath 808 may be equal to the width of the impact arrestor. $R_A$ and $R_B$ may also be determined based on the dull conditions of previous bit runs. In some instances radial swath 808 may substantially include the entire bit face such that $R_A$ is approximately equal to zero and $R_B$ is approximately equal to the radius of drill bit 801.

Once radial swath 808 is determined, the angular location of DOCC 802 within radial swath 808 may be determined. In the illustrated embodiment where only one DOCC 802 is depicted, DOCC 802 may be placed on any blade (e.g., blade 826*a*) based on the available space on that blade for placing DOCC 802. In alternative embodiments, if more than one DOCC is used to provide a depth of cut control for cutting elements 828 and 829 located within swath 808 (e.g., all cutting elements 828 and 829 located within the swath 808), the angular coordinates of the DOCCs may be determined based on a "rotationally symmetric rule" in order to reduce frictional imbalance forces. For example, if two DOCCs are used, then one DOCC may be placed on blade 826*a* and another DOCC may be placed on blade 826*d*. If three DOCCs are used, then a first DOCC may be placed on blade 826*a*, a second DOCC may be placed on blade 826*c* and a third DOCC may be placed on blade 826*e*. The determination of angular locations of DOCCs is described below with respect to various embodiments.

Returning to FIG. 8A, once the radial and the angular locations of DOCC 802 are determined, the x and y coordinates of any point on DOCC 802 may also be determined. For example, the surface of DOCC 802 in the xy plane of FIG. 8A may be meshed into small grids. The surface of DOCC 802 in the xy plane of FIG. 8A may also be represented by several cross sectional lines. For simplicity, each cross sectional line may be selected to pass through the bit axis or the origin of the coordinate system. Each cross sectional line may be further divided into several points. With the location on blade 826*a* for DOCC 802 selected, the x and y coordinates of any point on any cross sectional line associated with DOCC 802 may be easily determined and the next step may be to calculate the axial coordinates, z, of any point on a cross sectional line.

In the illustrated embodiment, DOCC 802 may be placed on blade 826*a* and configured to have a width that corresponds to radial swath 808. Additionally, a cross sectional line 810 associated with DOCC 802 may be selected, and in the illustrated embodiment may be represented by a line "AB." In some embodiments, cross-sectional line 810 may be selected such that all points along cross-sectional line 810 have the same angular coordinates. The inner end "A" of cross-sectional line 810 may have a distance from the center of bit 801 in the xy plane indicated by radial coordinate $R_A$ and the outer end "B" of cross-sectional line 810 may have a distance from the center of drill bit 801 indicated by radial coordinate $R_B$, such that the radial position of cross-sectional line 810 may be defined by $R_A$ and $R_B$. Cross-sectional line 810 may be divided into a series of points between inner end "A" and outer end "B" and the axial coordinates of each point may be determined based on the radial intersection of each point with one or more cutting edges of cutting elements 828 and 829, as described in detail below. In the illustrated embodiment, the determination of the axial coordinate of a control point "f" along cross-sectional line 810 is described. However, it is understood that the same procedure may be applied to determine the axial coordinates of other points along cross-sectional line 810 and also to determine the axial coordinates of other points of other cross-sectional lines that may be associated with DOCC 802.

The axial coordinate of control point "f" may be determined based on the radial and angular coordinates of control point "f" in the xy plane. For example, the radial coordinate of control point "f" may be the distance of control point "f" from the center of drill bit 801 as indicated by radial coordinate $R_f$. Once $R_f$ is determined, intersection points 830 associated with the cutting edges of one or more cutting elements 828 and/or 829 having radial coordinate $R_f$ may be determined. Accordingly, intersection points 830 of the cutting elements may have the same rotational path as control point "f" and, thus, may have a depth of cut that may be affected by control point "f" of DOCC 802. In the illustrated embodiment, the rotational path of control point "f" may intersect the cutting edge of cutting element 828*a* at intersection point 830*a*, the cutting edge of cutting element 828*b* at intersection point 830*b*, the cutting edge of cutting element 829*e* at intersection point 830*e* and the cutting edge of cutting element 828*f* at intersection point 830*f*.

The axial coordinate of control point "f" may be determined according to a desired underexposure ($\delta_{807i}$) of control point "f" with respect to each intersection point 830. FIG. 8B depicts the desired underexposure $\delta_{807i}$ of control point "f" with respect to each intersection point 830. The desired underexposure $\delta_{807i}$ of control point "f" with respect to each intersection point 830 may be determined based on the desired critical depth of cut $\Delta_1$ and the angular coordinates of control point "f" ($\theta_f$) and each point 830 ($\theta_{830i}$). For example, the desired underexposure of control point "f" with respect to intersection point 830*a* may be expressed by the following equation:

$$\delta_{807a}=\Delta_1*(360-(\theta_f-\theta_{830a}))/360$$

In the above equation, $\theta_f$ and $\theta_{830a}$ may be expressed in degrees, and "360" may represent one full revolution of approximately 360 degrees. Accordingly, in instances where $\theta_f$ and $\theta_{830a}$ may be expressed in radians, "360" may be replaced by "2π." Further, in the above equation, the resultant angle of "($\theta_f-\theta_{830a}$)" ($\Delta_\theta$) may be defined as always being positive. Therefore, if resultant angle $\Delta_\theta$ is negative, then $\Delta_\theta$ may be made positive by adding 360 degrees (or 2π radians) to $\Delta_\theta$. The desired underexposure of control point "f" with respect to points 830*b*, 830*e* and 830*f*, ($\delta_{807b}$, $\delta_{807e}$, $\delta_{807f}$, respectively) may be similarly determined.

Once the desired underexposure of control point "f" with respect to each intersection point is determined ($\delta_{807i}$), the axial coordinate of control point "f" may be determined. The axial coordinate of control point "f" may be determined based on the difference between the axial coordinates of each intersection point 830 and the desired underexposure with respect to each intersection point 830. For example, in FIG. 8B, the axial location of each point 830 may correspond to a coordinate on the z-axis, and may be expressed as a z-coordinate ($Z_{830i}$). To determine the corresponding z-coordinate of control point "f" ($Z_f$), a difference between the z-coordinate $Z_{830i}$ and the corresponding desired underexposure $\delta_{807i}$ for each intersection point 830 may be determined. The maximum value of the differences between $Z_{830i}$ and $\delta_{807i}$ may be the axial or z-coordinate of control point "f" ($Z_f$). For the current example, $Z_f$ may be expressed by the following equation:

$$Z_f=\max[(Z_{830a}-\delta_{807a}),(Z_{830b}-\delta_{807b}),(Z_{830e}-\delta_{807e}),(Z_{830f}-\delta_{807f})]$$

Accordingly, the axial coordinate of control point "f" may be determined based on the cutting edges of cutting elements 828*a*, 828*b*, 829*e* and 828*f*. The axial coordinates of other points (not expressly shown) along cross-sectional line 810 may be similarly determined to determine the axial curvature and coordinates of cross-sectional line 810. FIG. 8C illustrates an example of the axial coordinates and curvature of cross-sectional line 810 such that DOCC 802 may control the depth of cut of drill bit 801 to the desired critical depth of cut $\Delta_1$ within the radial swath defined by $R_A$ and $R_B$.

The above mentioned process may be repeated to determine the axial coordinates and curvature of other cross-sectional lines associated with DOCC 802 such that DOCC 802 may be designed according to the coordinates of the cross-sectional lines. At least one cross sectional line may be used to design a three dimensional surface of DOCC 802. Additionally, in some embodiments, a cross sectional line may be selected such that all the points on the cross sectional line have the same angular coordinate. Accordingly, DOCC 802 may provide depth of cut control to substantially obtain the desired critical depth of cut $\Delta_1$ within the radial swath defined by $R_A$ and $R_B$.

To more easily manufacture DOCC 802, in some instances, the axial coordinates of cross-sectional line 810 and any other cross-sectional lines may be smoothed by curve fitting technologies. For example, if DOCC 802 is designed as an MDR based on calculated cross sectional line 810, then cross sectional line 810 may be fit by one or more circular lines. Each of the circular lines may have a center and a radius that are used to design the MDR. As another example, if DOCC 802 is designed as an impact arrestor, a plurality of cross-sectional lines 810 may be used. Each of the cross-sectional lines may be fit by one or more circular lines. Two fitted cross-sectional lines may form the two ends of the impact arrestor similar to that shown in FIG. 6C.

Figure 8D:
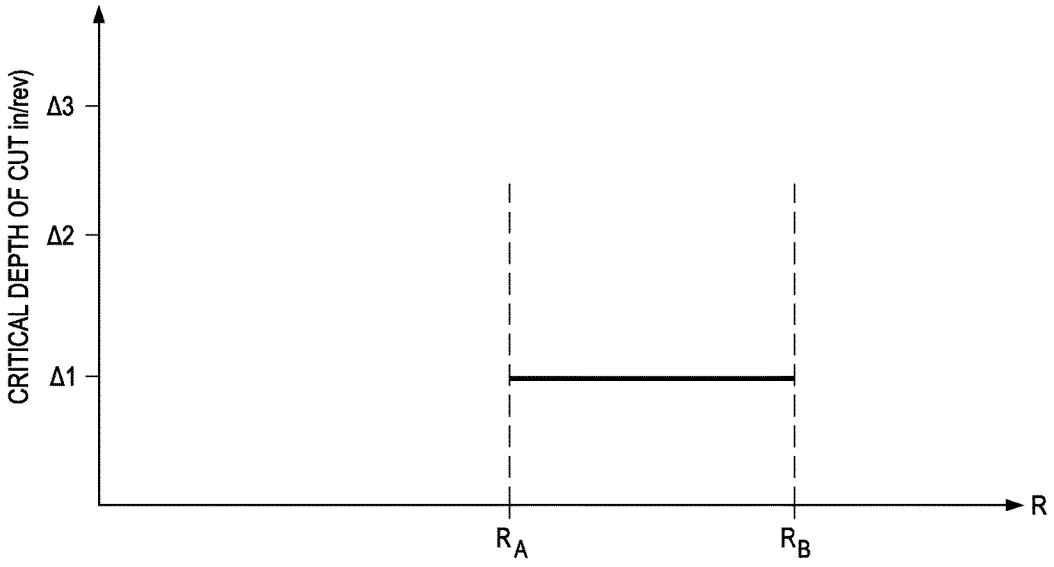
FIG. 8D illustrates a critical depth of cut control curve of the drill bit of FIGS. 8A-8C, in accordance with some embodiments of the present disclosure.

FIG. 8D illustrates a critical depth of cut control curve (described in further detail below) of drill bit 801. The critical depth of cut control curve indicates that the critical depth of cut of radial swath 808 between radial coordinates $R_A$ and $R_B$ may be substantially even and constant. Therefore, FIG. 8D indicates that the desired critical depth of cut ($\Delta_1$) of drill bit 801, as controlled by DOCC 802, may be substantially constant by taking in account all the cutting elements with depths of cut that may be affected by DOCC 802 and design DOCC 802 accordingly.

Modifications, additions, or omissions may be made to FIGS. 8A-8D without departing from the scope of the present disclosure. For example, although DOCC 802 is depicted as having a particular shape, DOCC 802 may have any appropriate shape. Additionally, it is understood that any number of cross-sectional lines and points along the cross-sectional lines may be selected to determine a desired axial curvature of DOCC 802. Further, as disclosed below with respect to FIGS. 12-14 and 16-17, although only one DOCC 802 is depicted on drill bit 801, drill bit 801 may include any number of DOCCs configured to control the depth of cut of the cutting elements associated with any number of radial swaths of drill bit 801. Further, the desired critical depth of cut of drill bit 801 may vary according to the radial coordinate (distance from the center of drill bit 801 in the radial plane).

Figure 9A:
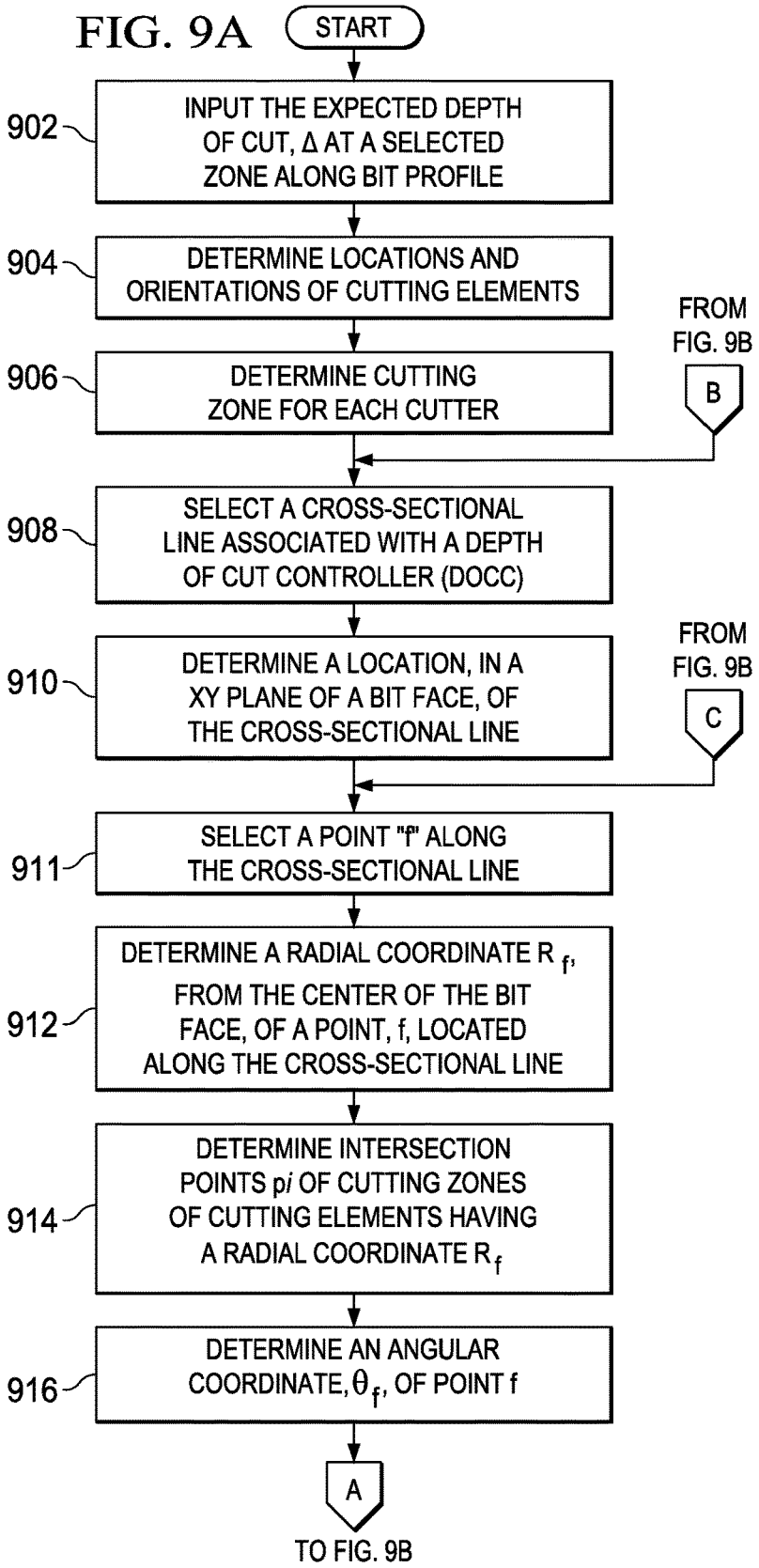
FIGS. 9A and 9B illustrate a flow chart of an example method for configuring a DOCC, in accordance with some embodiments of the present disclosure.
Figure 9B:
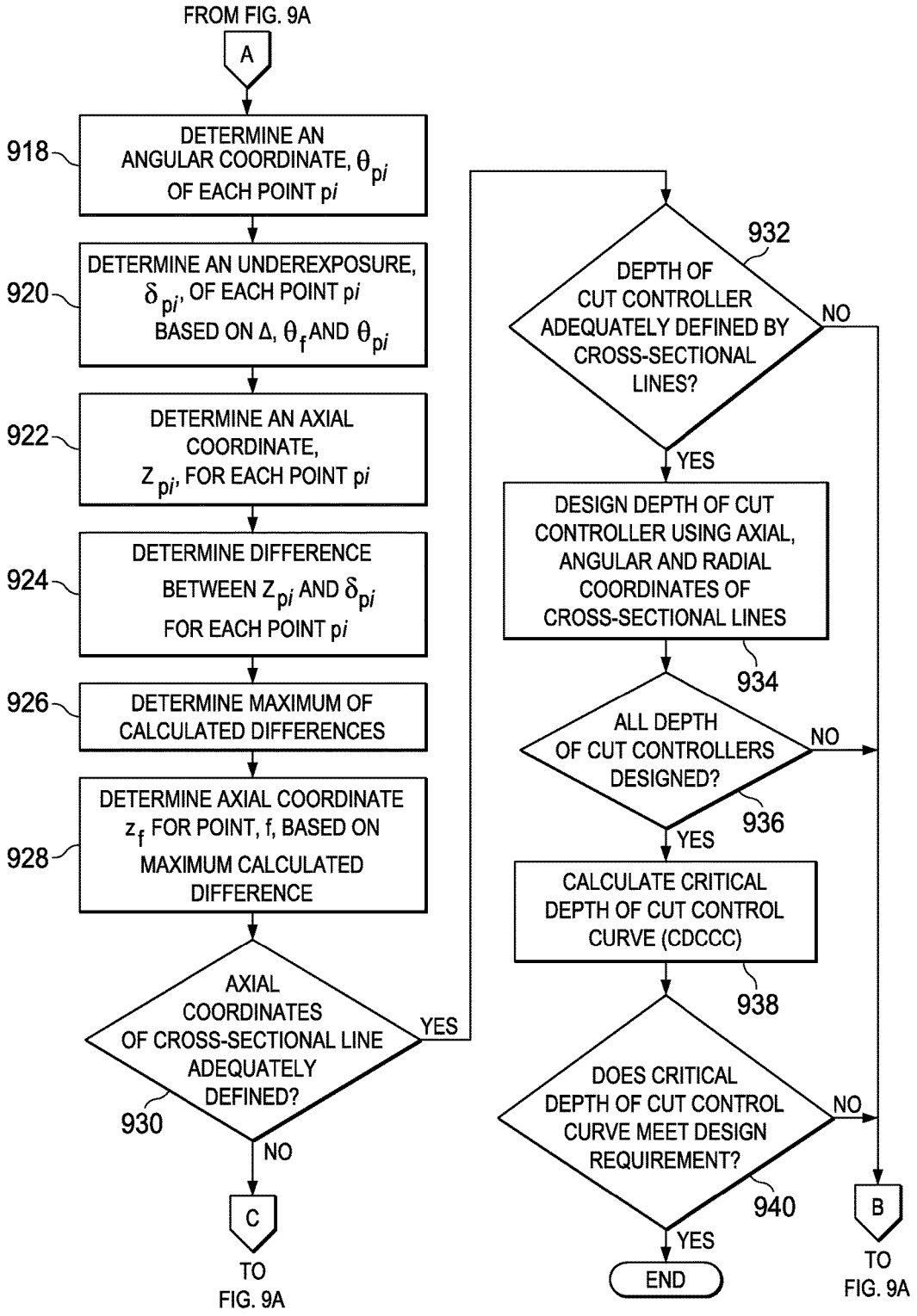

FIGS. 9A and 9B illustrate a flow chart of an example method 900 for designing a DOCC (e.g., DOCC 802 of FIGS. 8A-8B) according to the cutting zones of one or more cutting elements with depths of cut that may be affected by the DOCC. The steps of method 900 may be performed by an engineering design system. In the illustrated embodiment the cutting structures of the bit including at least the locations and orientations of all cutting elements may have been previously designed. However in other embodiments, method 900 may include steps for designing the cutting structure of the drill bit.

The steps of method 900 may be performed by various computer programs, models or any combination thereof, configured to simulate and design drilling systems, apparatuses and devices. The programs and models may include instructions stored on a computer readable medium and operable to perform, when executed, one or more of the steps described below. The computer readable media may include any system, apparatus or device configured to store and retrieve programs or instructions such as a hard disk drive, a compact disc, flash memory or any other suitable device. The programs and models may be configured to direct a processor or other suitable unit to retrieve and execute the instructions from the computer readable media. Collectively, the computer programs and models used to simulate and design drilling systems may be referred to as a "drilling engineering design system" or "engineering design system." Further, design parameters and/or results of any simulations and/or calculations performed by the engineering design system may be output to a visual display of the engineering design system.

Method 900 may start, and at step 902, the engineering design system may determine a desired critical depth of cut control ($\Delta$) at a selected zone (e.g., cone zone, nose zone, shoulder zone, gage zone, etc.) along a bit profile. The zone may be associated with a radial swath of the drill bit. At step 904, the locations and orientations of cutting elements located within the swath may be determined. Additionally, at step 906 the engineering design system may create a 3D cutter/formation interaction model that may determine the cutting zone and the cutting edge for each cutting element.

At step 908, the engineering design system may select a cross-sectional line (e.g., cross-sectional line 810) that may be associated with a DOCC that may be configured to control the depth of cut of a radial swath (e.g., radial swath 808 of FIGS. 8A-8B) of the drill bit. At step 910, the location of the cross-sectional line in a plane perpendicular to the rotational axis of the drill bit (e.g., the xy plane of FIG. 8A) may be determined. The location of the cross-sectional line may be selected such that the cross-sectional line intersects the radial swath and is located on a blade (e.g., cross-sectional line 810 intersects radial swath 808 and is located on blade 826*a* in FIG. 8A).

At step 911, a control point "f" along the cross-sectional line may be selected. Control point "f" may be any point that is located along the cross-sectional line and that may be located within the radial swath. At step 912, the radial coordinate $R_f$ of control point "f" may be determined. $R_f$ may indicate the distance of control point "f" from the center of the drill bit in the radial plane. Intersection points pi of the cutting edges of one or more cutting elements having radial coordinate $R_f$ may be determined at step 914. At step 916, an angular coordinate of control point "f" ($\theta_f$) may be determined and at step 918 an angular coordinate of each intersection point pi ($\theta_{pi}$) may be determined.

The engineering design system may determine a desired underexposure of each point pi ($\delta_{pi}$) with respect to control point "f" at step 920. As explained above with respect to FIG. 8, the underexposure $\delta_{pi}$ of each intersection point pi may be determined based on a desired critical depth of cut $\Delta$ of the drill bit in the rotational path of point "f." The underexposure $\delta_{pi}$ for each intersection point pi may also be based on the relationship of angular coordinate $\theta_f$ with respect to the respective angular coordinate $\theta_{pi}$.

At step 922, an axial coordinate for each intersection point pi ($Z_{pi}$) may be determined and a difference between $Z_{pi}$ and the respective underexposure $\delta_{pi}$ may be determined at step 924, similar to that described above in FIG. 8 (e.g., $Z_{pi}-\delta_{pi}$). In one embodiment, the engineering design system may determine a maximum of the difference between $Z_{pi}$ and $\delta_{pi}$ calculated for each intersection point pi at step 926. At step 928, the axial coordinate of control point "f" ($Z_f$) may be determined based on the maximum calculated difference, similar to that described above in FIG. 8.

At step 930, the engineering design system may determine whether the axial coordinates of enough control points of the cross-sectional line (e.g., control point "f") have been determined to adequately define the axial coordinate of the cross-sectional line. If the axial coordinates of more control points are needed, method 900 may return to step 911 where the engineering design system may select another control point along the cross-sectional line, otherwise, method 900 may proceed to step 932. The number of control points along a cross sectional line may be determined by a desired distance between two neighbor control points, (dr), and the length of the cross sectional line, (Lc). For example, if Lc is 1 inch, and dr is 0.1," then the number of control points may be Lc/dr+1=11. In some embodiments, dr may be between 0.01" to 0.2".

If the axial coordinates of enough cross-sectional lines have been determined, the engineering design system may proceed to step 932, otherwise, the engineering design system may return to step 911. At step 932, the engineering design system may determine whether the axial, radial and angular coordinates of a sufficient number of cross-sectional lines have been determined for the DOCC to adequately define the DOCC. The number of cross-sectional lines may be determined by the size and the shape of a DOCC. For example, if a hemi-spherical component (e.g., an MDR) is selected as a DOCC, then only one cross sectional line may be used. If an impact arrestor (semi-cylinder like) is selected, then a plurality of cross-sectional lines may be used. If a sufficient number have been determined, method 900 may proceed to step 934, otherwise method 900 may return to step 908 to select another cross-sectional line associated with the DOCC.

At step 934, the engineering design system may use the axial, angular and radial coordinates of the cross-sectional lines to configure the DOCC such that the DOCC has substantially the same axial, angular and radial coordinates as the cross-sectional lines. In some instances, the three dimensional surface of the DOCC that may correspond to the axial curvature of the cross-sectional lines may be designed by smoothing the axial coordinates of the surface using a two dimensional interpolation method such as the MATLAB® function called interp2.

At step 936, the engineering design system may determine whether all of the desired DOCCs for the drill bit have been designed. If no, method 900 may return to step 908 to select a cross-sectional line for another DOCC that is to be designed; if yes, method 900 may proceed to step 938, where the engineering design system may calculate a critical depth of cut control curve CDCCC for the drill bit, as explained in more detail below.

The engineering design system may determine whether the CDCCC indicates that the drill bit meets the design requirements at step 940. If no, method 900 may return to step 908 and various changes may be made to the design of one or more DOCCs of the drill bit. For example, the number of control points "f" may be increased, the number of cross-sectional lines for a DOCC may be increased, or any combination thereof. The angular locations of cross sectional lines may also be changed. Additionally, more DOCCs may be added to improve the CDCCC. If the CDCCC indicates that the drill bit meets the design requirements, method 900 may end. Consequently, method 900 may be used to design and configure a DOCC according to the cutting edges of all cutting elements within a radial swath of a drill bit such that the drill bit may have a substantially constant depth of cut as controlled by the DOCC.

Method 900 may be repeated for designing and configuring another DOCC within the same radial swath at the same expected depth of cut beginning at step 908. Method 900 may also be repeated for designing and configuring another DOCC within another radial swath of a drill bit by inputting another expected depth of cut, Δ, at step 902. Modifications, additions, or omissions may be made to method 900 without departing from the scope of the present disclosure. For example, each step may include additional steps. Additionally, the order of the steps as described may be changed. For example, although the steps have been described in sequential order, it is understood that one or more steps may be performed at the same time.

As mentioned above, the depth of cut of a drill bit may be analyzed by calculating a critical depth of cut control curve (CDCCC) for a radial swath of the drill bit as provided by the DOCCs, blade, or any combination thereof, located within the radial swath. The CDCCC may be based on a critical depth of cut associated with a plurality of radial coordinates.

Figure 10A:
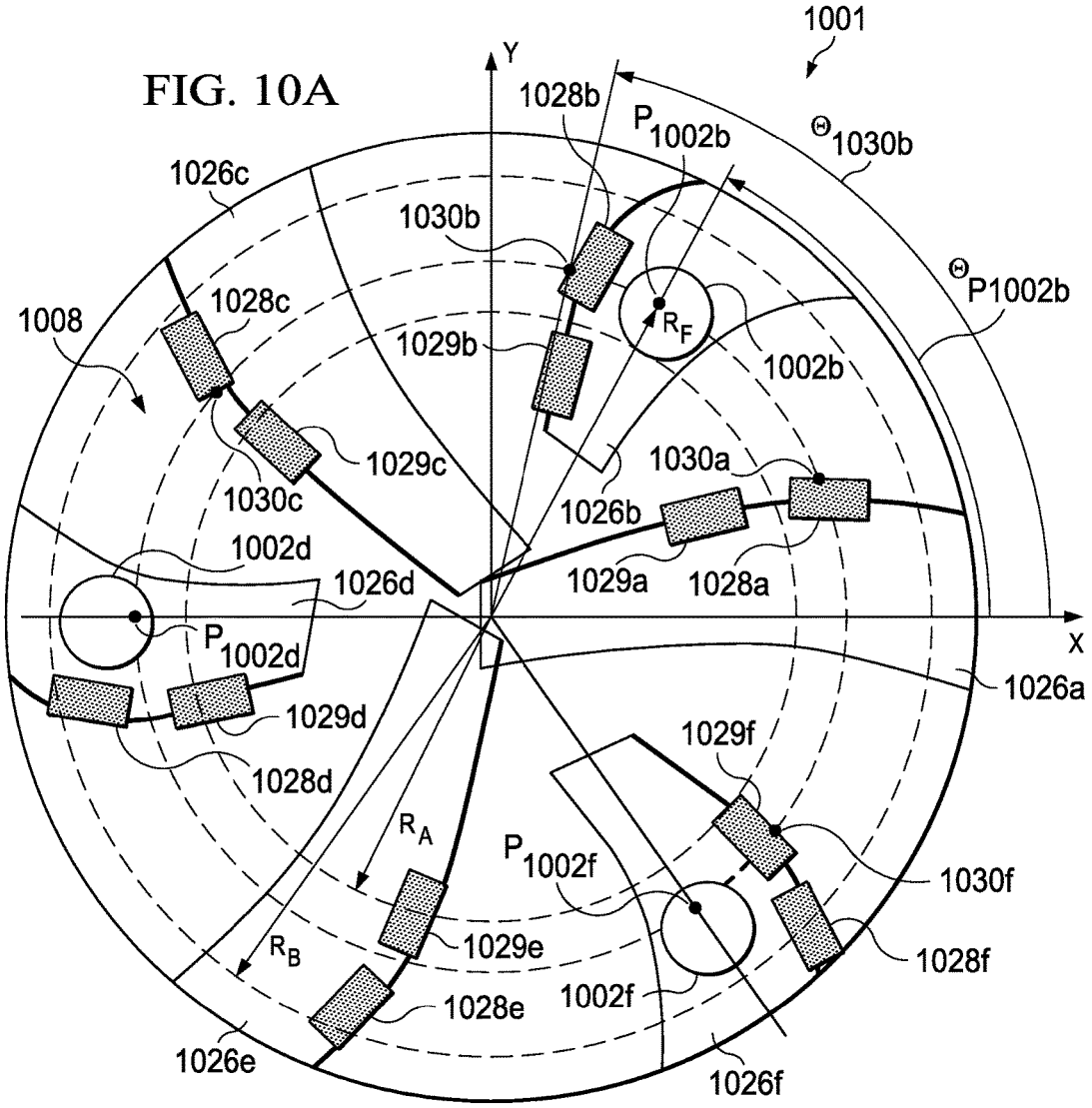
FIG. 10A illustrates the face of a drill bit for which a critical depth of cut control curve (CDCCC) may be determined, in accordance with some embodiments of the present disclosure.
Figure 10B:
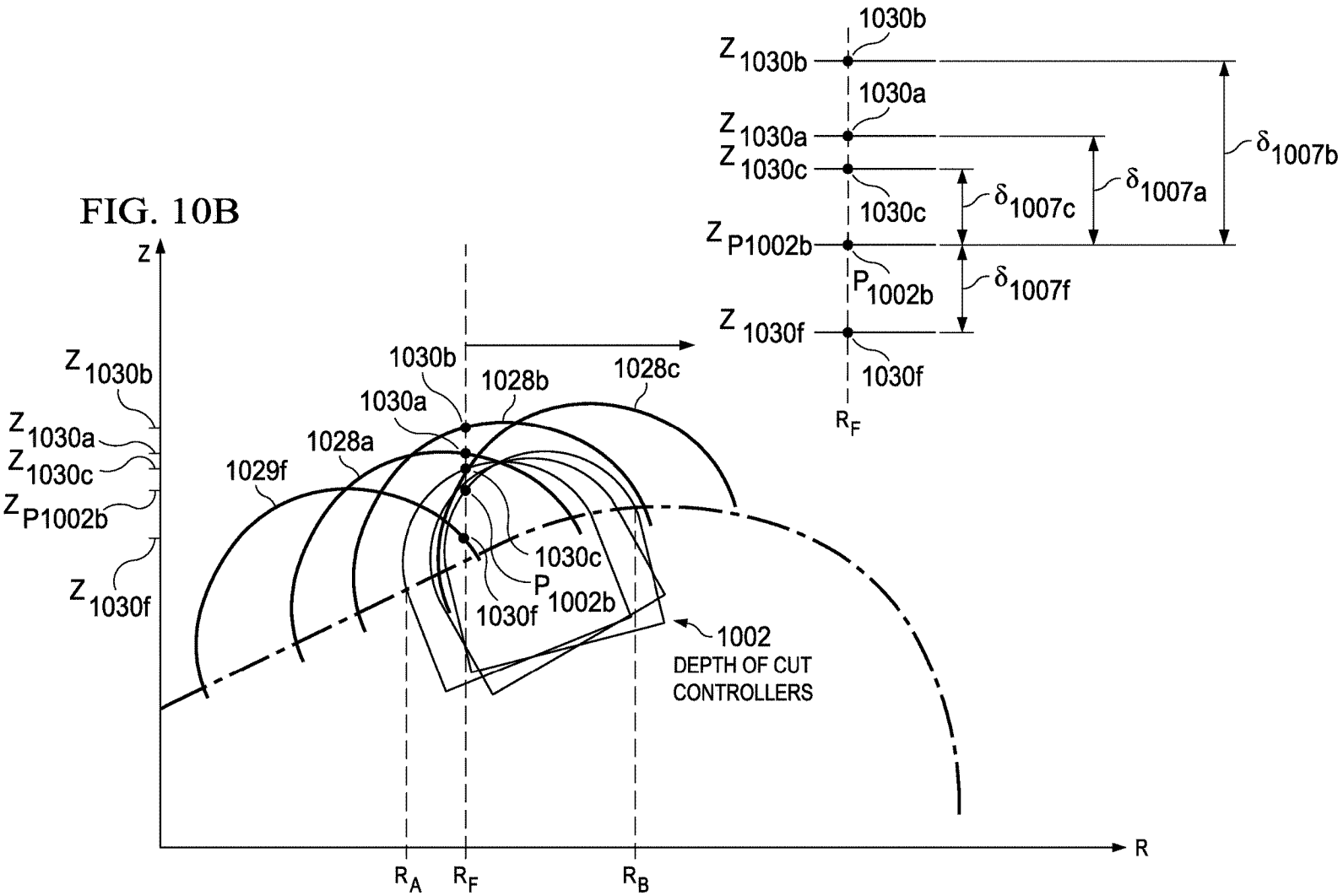
FIG. 10B illustrates a bit face profile of the drill bit depicted in FIG. 10A, in accordance with some embodiments of the present disclosure.

FIG. 10A illustrates the face of a drill bit 1001 for which a critical depth of cut control curve (CDCCC) may be determined, in accordance with some embodiments of the present disclosure. FIG. 10B illustrates a bit face profile of drill bit 1001 of FIG. 10A.

Drill bit 1001 may include a plurality of blades 1026 that may include cutting elements 1028 and 1029. Additionally, blades 1026*b*, 1026*d* and 1026*f* may include DOCC 1002*b*, DOCC 1002*d* and DOCC 1002*f*, respectively, that may be configured to control the depth of cut of drill bit 1001. DOCCs 1002*b*, 1002*d* and 1002*f* may be configured and designed according to the desired critical depth of cut of drill bit 1001 within a radial swath intersected by DOCCs 1002*b*, 1002*d* and 1002*f* as described in detail above.

As mentioned above, the critical depth of cut of drill bit 1001 may be determined for a radial location along drill bit 1001. For example, drill bit 1001 may include a radial coordinate $R_F$ that may intersect with DOCC 1002*b* at a control point $P_{1002b}$, DOCC 1002*d* at a control point $P_{1002d}$, and DOCC 1002*f* at a control point $P_{1002f}$. Additionally, radial coordinate $R_F$ may intersect cutting elements 1028*a*, 1028*b*, 1028*c*, and 1029*f* at cutlet points 1030*a*, 1030*b*, 1030*c*, and 1030*f*, respectively, of the cutting edges of cutting elements 1028*a*, 1028*b*, 1028*c*, and 1029*f*, respectively.

The angular coordinates of control points $P_{1002b}$, $P_{1002d}$ and $P_{1002f}$ ($\theta_{P1002b}$, $\theta_{P1002d}$ and $\theta_{P1002f}$, respectively) may be determined along with the angular coordinates of cutlet points 1030*a*, 1030*b*, 1030*c* and 1030*f* ($\theta_{1030a}$, $\theta_{1030b}$, $\theta_{1030c}$ and $\theta_{1030f}$, respectively). A depth of cut control provided by each of control points $P_{1002b}$, $P_{1002d}$ and $P_{1002f}$ with respect to each of cutlet points 1030*a*, 1030*b*, 1030*c* and 1030*f* may be determined. The depth of cut control provided by each of control points $P_{1002b}$, $P_{1002d}$ and $P_{1002f}$ may be based on the underexposure ($\delta_{1007i}$, depicted in FIG. 10B) of each of points $P_{1002i}$ with respect to each of cutlet points 1030 and the angular coordinates of points $P_{1002i}$ with respect to cutlet points 1030.

For example, the depth of cut of cutting element 1028*b* at cutlet point 1030*b* controlled by point $P_{1002b}$ of DOCC 1002*b* ($\Delta_{1030b}$) may be determined using the angular coordinates of point $P_{1002b}$ and cutlet point 1030*b* ($\theta_{P1002b}$ and $\theta_{1030b}$, respectively), which are depicted in FIG. 10A. Additionally, $\Delta_{1030b}$ may be based on the axial underexposure ($\delta_{1007b}$) of the axial coordinate of point $P_{1002b}$ ($Z_{P1002b}$) with respect to the axial coordinate of intersection point 1030*b* ($Z_{1030b}$), as depicted in FIG. 10B. In some embodiments, $\Delta_{1030b}$ may be determined using the following equations:

$$\Delta_{1030b}=\delta_{1007b}*360/(360-(\theta_{P1002b}-\theta_{1030b}));\text{ and}$$

$$\delta_{1007b}=Z_{1030b}-Z_{P1002b}.$$

In the first of the above equations, $\theta_{P1002b}$ and $\theta_{1030b}$ may be expressed in degrees and "360" may represent a full rotation about the face of drill bit 1001. Therefore, in instances where $\theta_{P1002b}$ and $\theta_{1030b}$ are expressed in radians, the numbers "360" in the first of the above equations may be changed to "2π." Further, in the above equation, the resultant angle of "($\theta_{P1002b}-\theta_{1030b}$)" ($\Delta_\theta$) may be defined as always being positive. Therefore, if resultant angle $\Delta_\theta$ is negative, then $\Delta_\theta$ may be made positive by adding 360 degrees (or 2π radians) to $\Delta_\theta$. Similar equations may be used to determine the depth of cut of cutting elements 1028*a*, 1028*c*, and 1029*f* as controlled by control point $P_{1002b}$ at cutlet points 1030*a*, 1030*c* and 1030*f*, respectively ($\Delta_{1030a}$, $\Delta_{1030c}$ and $\Delta_{1030f}$, respectively).

The critical depth of cut provided by point $P_{1002b}$ ($\theta_{P1002b}$) may be the maximum of $\Delta_{1030a}$, $\Delta_{1030b}$, $\Delta_{1030c}$ and $\Delta_{1030f}$ and may be expressed by the following equation:

$$\Delta_{P1002b}=\max[(\Delta_{1030a},\Delta_{1030b},\Delta_{1030c},\Delta_{1030f}].$$

The critical depth of cut provided by points $P_{1002d}$ and $P_{1002f}$ ($\Delta_{P1002d}$ and $\Delta_{P1002f}$, respectively) at radial coordinate $R_F$ may be similarly determined. The overall critical depth of cut of drill bit 1001 at radial coordinate $R_F$ ($\Delta_{RF}$) may be based on the minimum of $\Delta_{P1002b}$, $\Delta_{P1002d}$ and $\Delta_{P1002f}$ and may be expressed by the following equation:

$$\Delta_{RF}=\min[(\Delta_{P1002b},\Delta_{P1002d},\Delta_{P1002f}].$$

Accordingly, the overall critical depth of cut of drill bit 1001 at radial coordinate $R_F$ ($\Delta_{RF}$) may be determined based on the points where DOCCs 1002 and cutting elements 1028/1029 intersect $R_F$. Although not expressly shown here, it is understood that the overall critical depth of cut of drill bit 1001 at radial coordinate $R_F$ ($\Delta_{RF}$) may also be affected by control points $P_{1026i}$ (not expressly shown in FIGS. 10A and 10B) that may be associated with blades 1026 configured to control the depth of cut of drill bit 1001 at radial coordinate $R_F$. In such instances, a critical depth of cut provided by each control point $P_{1026i}$ ($\Delta_{P1026i}$) may be determined. Each critical depth of cut $\Delta_{P1026i}$ for each control point $P_{1026i}$ may be included with critical depth of cuts $\Delta_{P1002i}$ in determining the minimum critical depth of cut at $R_F$ to calculate the overall critical depth of cut $\Delta_{RF}$ at radial location $R_F$.

To determine a critical depth of cut control curve of drill bit 1001, the overall critical depth of cut at a series of radial locations $R_f$ ($\Delta_{Rf}$) anywhere from the center of drill bit 1001 to the edge of drill bit 1001 may be determined to generate a curve that represents the critical depth of cut as a function of the radius of drill bit 1001. In the illustrated embodiment, DOCCs 1002*b*, 1002*d*, and 1002*f* may be configured to control the depth of cut of drill bit 1001 for a radial swath 1008 defined as being located between a first radial coordinate $R_A$ and a second radial coordinate $R_B$. Accordingly, the overall critical depth of cut may be determined for a series of radial coordinates $R_f$ that are within radial swath 1008 and located between $R_A$ and $R_B$, as disclosed above. Once the overall critical depths of cuts for a sufficient number of radial coordinates $R_f$ are determined, the overall critical depth of cut may be graphed as a function of the radial coordinates $R_f$.

Figure 10C:
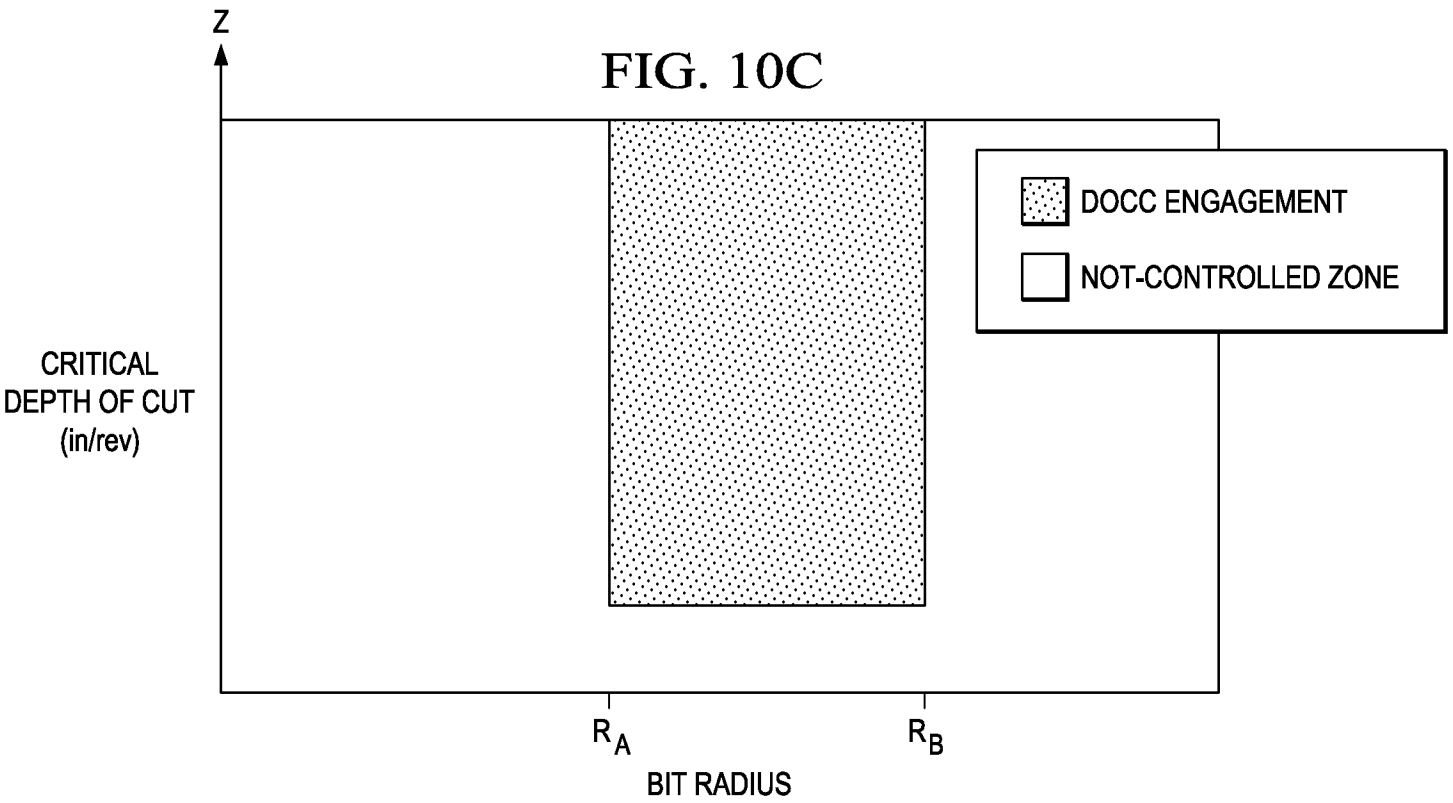
FIG. 10C illustrates a critical depth of cut control curve for a drill bit, in accordance with some embodiments of the present disclosure.

FIG. 10C illustrates a critical depth of cut control curve for drill bit 1001, in accordance with some embodiments of the present disclosure. FIG. 10C illustrates that the critical depth of cut between radial coordinates $R_A$ and $R_B$ may be substantially uniform, indicating that DOCCs 1002*b*, 1002*d* and 1002*f* may be sufficiently configured to provide a substantially even depth of cut control between $R_A$ and $R_B$.

Modifications, additions or omissions may be made to FIGS. 10A-10C without departing from the scope of the present disclosure. For example, as discussed above, blades 1026, DOCCs 1002 or any combination thereof may affect the critical depth of cut at one or more radial coordinates and the critical depth of cut may be determined accordingly.

Figure 11:
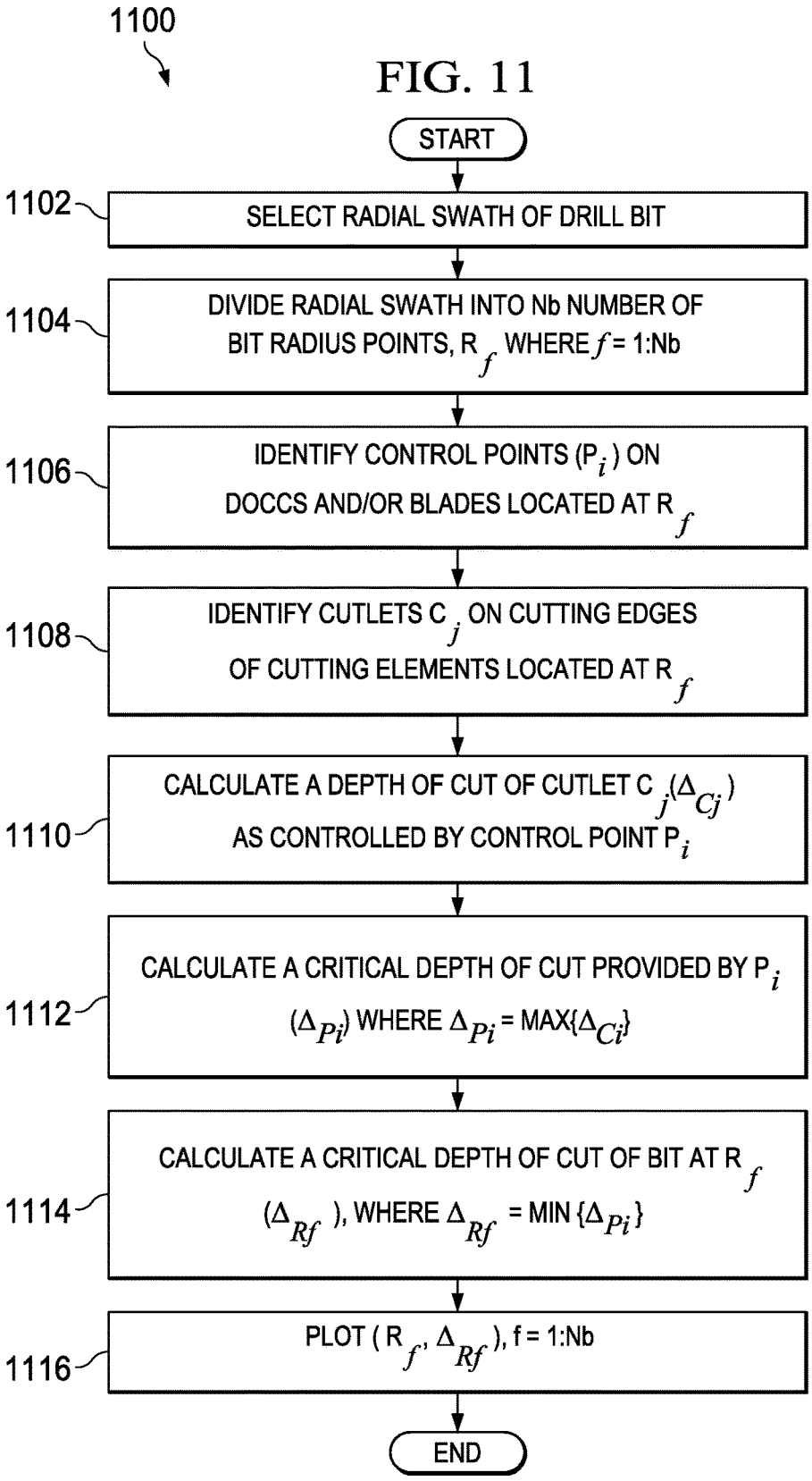
FIG. 11 illustrates an example method of determining and generating a critical depth of cut control curve, in accordance with some embodiments of the present disclosure.

FIG. 11 illustrates an example method 1100 of determining and generating a CDCCC in accordance with some embodiments of the present disclosure. In the illustrated embodiment, the cutting structures of the bit, including at least the locations and orientations of all cutting elements and DOCCs, may have been previously designed. However in other embodiments, method 1100 may include steps for designing the cutting structure of the drill bit. For illustrative purposes, method 1100 is described with respect to drill bit 1001 of FIGS. 10A-10C; however, method 1100 may be used to determine the CDCCC of any suitable drill bit.

The steps of method 1100 may be performed by various computer programs, models or any combination thereof, configured to simulate and design drilling systems, apparatuses and devices. The programs and models may include instructions stored on a computer readable medium and operable to perform, when executed, one or more of the steps described below. The computer readable media may include any system, apparatus or device configured to store and retrieve programs or instructions such as a hard disk drive, a compact disc, flash memory or any other suitable device. The programs and models may be configured to direct a processor or other suitable unit to retrieve and execute the instructions from the computer readable media. Collectively, the computer programs and models used to simulate and design drilling systems may be referred to as a "drilling engineering design system" or "engineering design system." Further, design parameters and/or results of any simulations and/or calculations performed by the engineering design system may be output to a visual display of the engineering design system.

Method 1100 may start, and at step 1102, the engineering design system may select a radial swath of drill bit 1001 for analyzing the critical depth of cut within the selected radial swath. In some instances the selected radial swath may include the entire face of drill bit 1001 and in other instances the selected radial swath may be a portion of the face of drill bit 1001. For example, the engineering design system may select radial swath 1008 as defined between radial coordinates $R_A$ and $R_B$ and controlled by DOCCs 1002*b*, 1002*d* and 1002*f*, shown in FIGS. 10A-10C.

At step 1104, the engineering design system may divide the selected radial swath (e.g., radial swath 1008) into a number, Nb, of radial coordinates ($R_f$) such as radial coordinate $R_F$ described in FIGS. 10A and 10B. For example, radial swath 1008 may be divided into nine radial coordinates such that Nb for radial swath 1008 may be equal to nine. The variable "f" may represent a number from one to Nb for each radial coordinate within the radial swath. For example, "$R_1$" may represent the radial coordinate of the inside edge of a radial swath. Accordingly, for radial swath 1008, "$R_1$" may be approximately equal to $R_A$. As a further example, "$R_{Nb}$" may represent the radial coordinate of the outside edge of a radial swath. Therefore, for radial swath 1008, "$R_{Nb}$" may be approximately equal to $R_B$.

At step 1106, the engineering design system may select a radial coordinate $R_f$ and may identify control points ($P_i$) that may be located at the selected radial coordinate $R_f$ and associated with a DOCC and/or blade. For example, the engineering design system may select radial coordinate $R_F$ and may identify control points $P_{1002i}$ and $P_{1026i}$ associated with DOCCs 1002 and/or blades 1026 and located at radial coordinate $R_F$, as described above with respect to FIGS. 10A and 10B.

At step 1108, for the radial coordinate $R_f$ selected in step 1106, the engineering design system may identify cutlet points ($C_j$) each located at the selected radial coordinate $R_f$ and associated with the cutting edges of cutting elements. For example, the engineering design system may identify cutlet points 1030*a*, 1030*b*, 1030*c* and 1030*f* located at radial coordinate $R_F$ and associated with the cutting edges of cutting elements 1028*a*, 1028*b*, 1028*c*, and 1029*f*, respectively, as described and shown with respect to FIGS. 10A and 10B.

At step 1110, the engineering design system may select a control point $P_i$ and may calculate a depth of cut for each cutlet $C_j$ as controlled by the selected control point $P_i$ ($\Delta_{Cj}$), as described above with respect to FIGS. 10A and 10B. For example, the engineering design system may determine the depth of cut of cutlets 1030*a*, 1030*b*, 1030*c*, and 1030*f* as controlled by control point $P_{1002b}$ ($\Delta_{1030a}$, $\Delta_{1030b}$, $\Delta_{1030c}$, and $\Delta_{1030f}$, respectively) by using the following equations:

$$\Delta_{1030a}=\delta_{1007a}*360/(360-(\theta_{P1002b}-\theta_{1030a}));$$

$$\delta_{1007a}=Z_{1030a}-Z_{P1002b};$$

$$\Delta_{1030b}=\delta_{1007b}*360/(360-(\theta_{P1002b}-\theta_{1030b}));$$

$$\delta_{1007b}=Z_{1030b}-Z_{P1002b};$$

$$\Delta_{1030c}=\delta_{1007c}*360/(360-(\theta_{P1002b}-\theta_{1030c}));$$

$$\delta_{1007c}=Z_{1030a}=Z_{P1002b};$$

$$\Delta_{1030f}=\delta_{1007f}*360/(360-(\theta_{P1002b}-\theta_{1030f}));\text{ and}$$

$$\delta_{1007f}=Z_{1030f}-Z_{P1002b}.$$

At step 1112, the engineering design system may calculate the critical depth of cut provided by the selected control point ($\Delta_{Pi}$) by determining the maximum value of the depths of cut of the cutlets $C_j$ as controlled by the selected control point $P_i$ ($\Delta_{Cj}$) and calculated in step 1110. This determination may be expressed by the following equation:

$$\Delta_{Pi}=\max\{\Delta_{Cj}\}.$$

For example, control point $P_{1002b}$ may be selected in step 1110 and the depths of cut for cutlets 1030*a*, 1030*b*, 1030*c*, and 1030*f* as controlled by control point $P_{1002b}$ ($\Delta_{1030a}$, $\Delta_{1030b}$, $\Delta_{1030c}$, and $\Delta_{1030f}$, respectively) may also be determined in step 1110, as shown above. Accordingly, the critical depth of cut provided by control point $P_{1002b}$ ($\Delta_{P1002b}$) may be calculated at step 1112 using the following equation:

$$\Delta_{P1002b}=\max[\Delta_{1030a},\Delta_{1030b},\Delta_{1030c},\Delta_{1030f}].$$

The engineering design system may repeat steps 1110 and 1112 for all of the control points $P_i$ identified in step 1106 to determine the critical depth of cut provided by all control points $P_i$ located at radial coordinate $R_f$. For example, the engineering design system may perform steps 1110 and 1112 with respect to control points $P_{1002d}$ and $P_{1002f}$ to determine the critical depth of cut provided by control points $P_{1002d}$ and $P_{1002f}$ with respect to cutlets 1030*a*, 1030*b*, 1030*c*, and 1030*f* at radial coordinate $R_F$ shown in FIGS. 10A and 10B (e.g., $\Delta_{P1002d}$ and $\Delta_{P1002f}$, respectively).

At step 1114, the engineering design system may calculate an overall critical depth of cut at the radial coordinate $R_f$ ($\Delta_{Rf}$) selected in step 1106. The engineering design system may calculate the overall critical depth of cut at the selected radial coordinate $R_f$ ($\Delta_{Rf}$) by determining a minimum value of the critical depths of cut of control points $P_i$ ($\Delta_{Pi}$) determined in steps 1110 and 1112. This determination may be expressed by the following equation:

$$\Delta_{Rf}=\min\{\Delta_{Pi}\}.$$

For example, the engineering design system may determine the overall critical depth of cut at radial coordinate $R_F$ of FIGS. 10A and 10B by using the following equation:

$$\Delta_{RF}=\min[\Delta_{P1002b},\Delta_{P1002d},\Delta_{P1002f}].$$

The engineering design system may repeat steps 1106 through 1114 to determine the overall critical depth of cut at all the radial coordinates $R_f$ generated at step 1104.

At step 1116, the engineering design system may plot the overall critical depth of cut ($\Delta_{Rf}$) for each radial coordinate $R_f$, as a function of each radial coordinate $R_f$. Accordingly, a critical depth of cut control curve may be calculated and plotted for the radial swath associated with the radial coordinates $R_f$. For example, the engineering design system may plot the overall critical depth of cut for each radial coordinate $R_f$ located within radial swath 1008, such that the critical depth of cut control curve for swath 1008 may be determined and plotted, as depicted in FIG. 10C. Following step 1116, method 1100 may end. Accordingly, method 1100 may be used to calculate and plot a critical depth of cut control curve of a drill bit. The critical depth of cut control curve may be used to determine whether the drill bit provides a substantially even control of the depth of cut of the drill bit. Therefore, the critical depth of cut control curve may be used to modify the DOCCs and/or blades of the drill bit configured to control the depth of cut of the drill bit.

Modifications, additions, or omissions may be made to method 1100 without departing from the scope of the present disclosure. For example, the order of the steps may be performed in a different manner than that described and some steps may be performed at the same time. Additionally, each individual step may include additional steps without departing from the scope of the present disclosure.

As described above with reference to FIGS. 10A-C and 11, the critical depth of cut control curve may be used to modify the DOCCs and/or blades of the drill bit configured to control the depth of cut of the drill bit. As described in further detail below, the DOCC-based critical depth of cut control curve may also be compared to a substrate-based depth of cut control curve (SCDCCC) associated with the substrate of a cutting element to determine whether the substrate of the cutting element may come into contact with the formation during drilling at a given ROP and RPM.

Figure 12A:
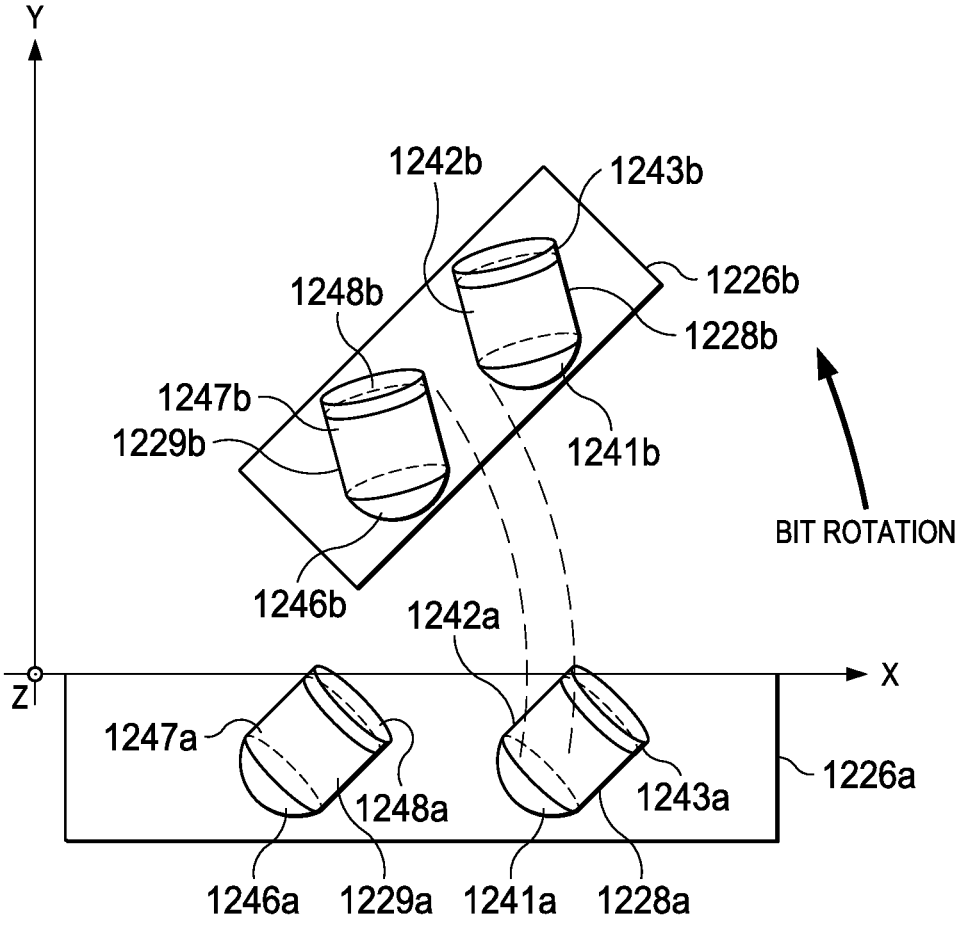
FIG. 12A illustrates an example orientation of cutting elements on blades of a drill bit, in accordance with some embodiments of the present disclosure.

FIG. 12A illustrates an example orientation of cutting elements on blades of a drill bit, in accordance with some embodiments of the present disclosure. For example, outer cutting elements 1228 and inner cutting elements 1229 may be disposed on blades 1226. Outer cutting elements 1228 may include hard cutting layer 1243, substrate 1242 forming a body of cutting element 1228, and pocket extension 1241 with which cutting element 1228 may be fit to a pocket within blade 1226. Likewise, inner cutting elements 1229 may include hard cutting layer 1248, substrate 1247 forming a body of cutting element 1229, and pocket extension 1246 with which cutting element 1229 may be fit to a pocket within blade 1226.

As shown in FIG. 12A, hard cutting layer 1243 and substrate 1242 may be exposed to contact with a formation during drilling of a wellbore depending in part on the orientation of cutting element 1228 on blade 1226 with respect to the direction of bit rotation. For example, as cutting element 1228*a* rotates about the z-axis (i.e., the bit-rotational axis), on an xy-plane formed by the x-axis and the y-axis, substrate 1242*a* and hard cutting layer 1243*a* may each contact formation during drilling of a wellbore. Hard cutting layer 1243 may be formed by a material (e.g., polycrystalline diamond material) having a high level of hardness and wear-resistance, thus making hard cutting layer 1243 suitable for cutting formation during drilling of a wellbore. In some embodiments, substrate 1242 may be less hard and less wear-resistant than hard cutting layer 1243. In order to prevent the potential loss of cutting elements due to the substrate contacting formation during a drilling operation, prevent excess friction heat due to substrate contacting formation, and prevent a reduction of the maximum ROP for a drill bit, the placement of cutting elements 1228 in a drill bit design may be adjusted in a manner that prevents substrate 1242 from contacting formation during drilling.

As explained in greater detail below with reference to FIGS. 14A-B and 15, a drill bit may be designed to prevent the substrate of one or more cutting elements from contacting formation by ensuring that the critical depth of cut for a given radial location on the drill bit is smaller than the substrate-based critical depth of cut, which depends in part on the underexposure of substrates 1242 with respect to corresponding segments of the cutting edges of cutting elements 1228. For example, drill bit design parameters, such as the back rake angle and the side rake angle of cutting elements 1228, may be adjusted to increase the underexposure of substrate 1242 with respect to the cutting edges of cutting elements 1228, thus increasing the substrate-based critical depth of cut. Other design parameters, including but not limited to the placement of DOCCs, the density of cutting elements, the density of back-up cutting elements, and/or the underexposure of those back-up cutting elements, may be designed to achieve a desired critical depth of cut for a given radial location, thus setting the minimum substrate-based critical depth of cut that may be allowed for the given radial location.

Figure 12B:
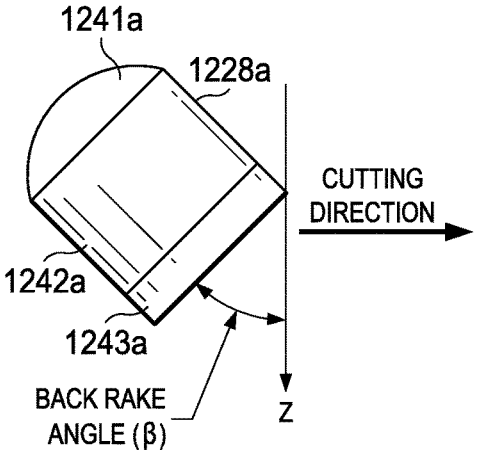
FIG. 12B illustrates a side view of a cutting element depicted in FIG. 12A, in accordance with some embodiments of the present disclosure.
Figure 12C:
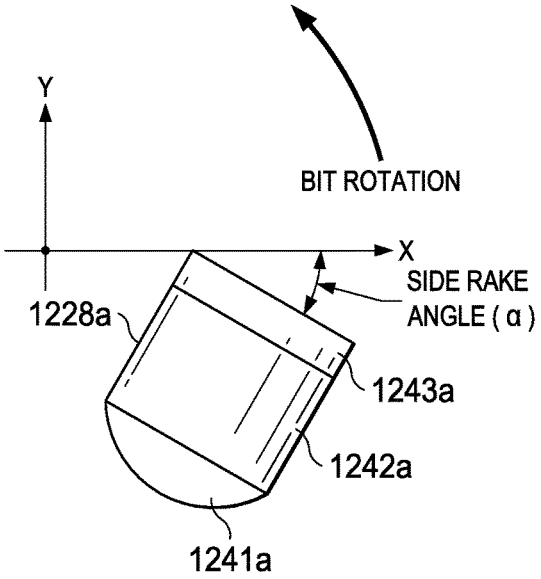
FIG. 12C illustrates a bottom view of a cutting element depicted in FIG. 12A, in accordance with some embodiments of the present disclosure.

FIG. 12B illustrates a side view of cutting element 1228 depicted in FIG. 12A. As shown in FIG. 12B, the back rake angle (β) of cutting element 1228 is the angle at which cutting element 1228 is oriented as compared to the z-axis (i.e., the bit-rotational axis). FIG. 12C illustrates a bottom view of cutting element 1228 depicted in FIG. 12A. As shown in FIG. 12C, the side rake angle (α) of cutting element 1228 is the angle at which cutting element 1228 is oriented as compared to the x-axis or y-axis of the xy-plane.

Figure 13:
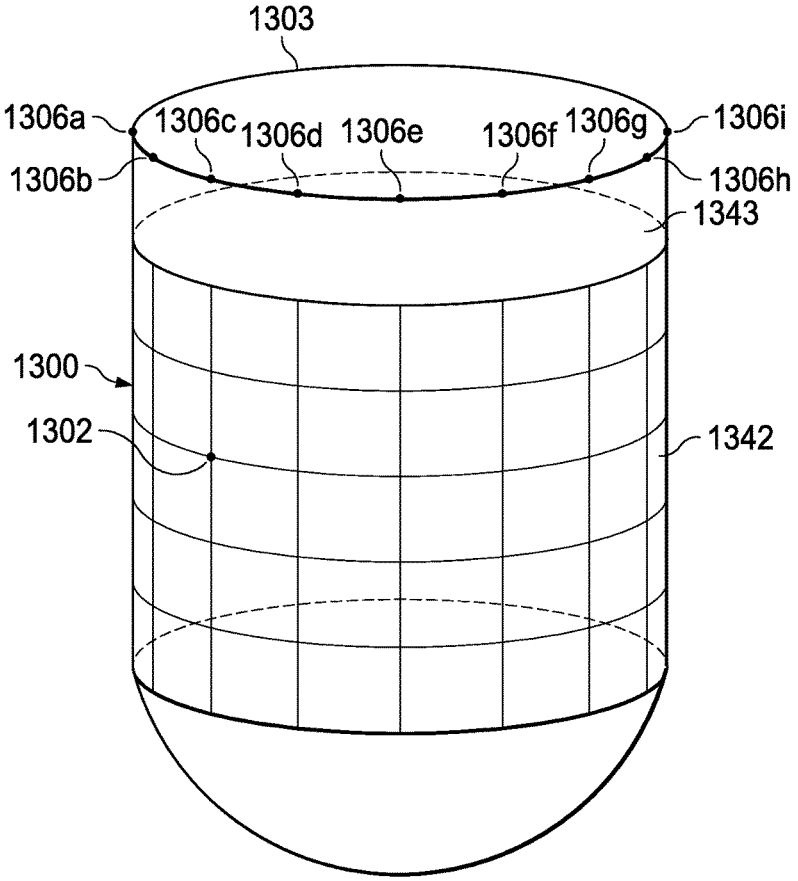
FIG. 13 illustrates a profile of a cutting element having a substrate, in accordance with some embodiments of the present disclosure.

FIG. 13 illustrates a profile of a cutting element having a substrate, in accordance with some embodiments of the present disclosure. The substrate-based depth of cut of a drill bit may be analyzed by calculating a substrate-based depth of cut control curve (SCDCCC) for the drill bit. To facilitate the calculation of a SCDCCC, the surface of the substrate of a cutting element may be meshed in order to identify surface points on the substrate from which the substrate-based depth of cut control curve can be calculated. As shown in FIG. 13, cutting element 1300 may have hard cutting layer 1343 and substrate 1342. The surface of substrate 1342 may be meshed in order to identify substrate surface points (e.g., substrate surface control point 1302) that correspond to cutlets 1306*a*-1306*i* on cutting edge 1303 of hard cutting layer 1343.

As explained in detail below with reference to FIGS. 14A-B and 15, the axial and radial coordinates of substrate surface points (e.g., substrate surface control point 1302) may be used to calculate substrate-based depth of cut control curve (SCDCCC), which may in turn be compared to a threshold critical depth of cut control curve (CDCCC) to determine radial locations at which the substrate of a cutting element may contact formation during drilling. The threshold critical depth of control curve may be a given critical depth of cut control curve based on a desired critical depth of cut, or a separately calculated DOCC-based critical depth of cut control curve. Upon determination of any radial locations on the drill bit at which the substrate of a cutting element may contact formation during drilling, the design of the drill bit may be adjusted to prevent the substrate contacting formation. For example, the back rake and/or side rake of a cutting element may be adjusted. As another example, the design of existing DOCCs may be adjusted or further DOCCs may be added to the drill bit.

Figure 14A:
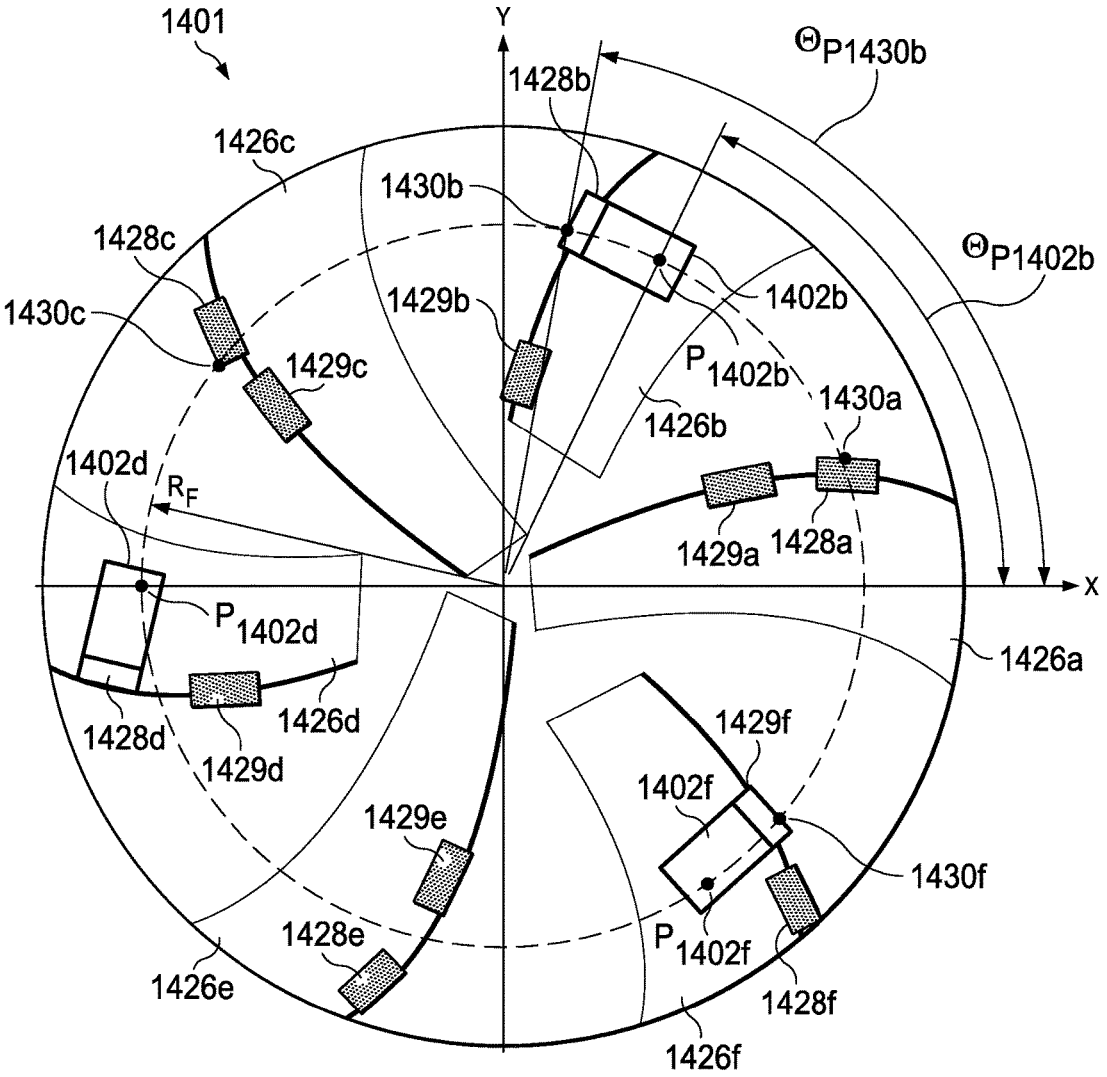
FIG. 14A illustrates the face of a drill bit for which a substrate-based critical depth of cut control curve (SCD-CCC) may be determined, in accordance with some embodiments of the present disclosure.

FIG. 14A illustrates the face of drill bit 1401 for which a substrate-based critical depth of cut control curve (SCDCCC) may be determined, in accordance with some embodiments of the present disclosure. FIG. 14B illustrates a bit face profile of drill bit 1401 of FIG. 14A.

Drill bit 1401 may include a plurality of blades 1426 that may include cutting elements 1428 and 1429. Each of the cutting elements 1428 and 1429 may include a substrate and a cutting edge, but for the purpose of simplifying FIG. 14A, the substrates of only certain cutting elements are shown. For example, cutting elements 1428*b*, 1428*d*, and 1428*f* may include substrate 1402*b*, substrate 1402*d*, and substrate 1402*f* respectively.

The substrate-based critical depth of cut of drill bit 1401 may be determined for a radial location along drill bit 1401. For example, drill bit 1401 may include a radial coordinate $R_F$ that may intersect with substrate 1402*b* at a control point $P_{1402b}$, substrate 1402*d* at a control point $P_{1402d}$, and substrate 1402*f* at a control point $P_{1402f}$. Additionally, radial coordinate $R_F$ may intersect cutting elements 1428*a*, 1428*b*, 1428*c*, and 1429*f* at cutlet points 1430*a*, 1430*b*, 1430*c*, and 1430*f*, respectively, of the cutting edges of cutting elements 1428*a*, 1428*b*, 1428*c*, and 1429*f*, respectively.

Although the substrate of a cutting element may not physically control the depth of cut in the same manner as a depth of cut controller (DOCC), drill bit 1401 may be designed such that substrates of the cutting elements do not contact formation during drilling. Accordingly, control points located on the substrates may be described herein as controlling the depth of cuts of cutting elements in the same way that control points on DOCCs, described above with reference to FIGS. 10A, 10B, 10C, and 11, are described as controlling the depth of cuts of cutting elements.

The angular coordinates of control points $P_{1402b}$, $P_{1402d}$ and $P_{1402f}$ ($\theta_{P1402b}$, $\theta_{P1402d}$ and $\theta_{P1402f}$, respectively) may be determined along with the angular coordinates of cutlet points 1430*a*, 1430*b*, 1430*c* and 1430*f* ($\theta_{1430a}$, $\theta_{1430b}$, $\theta_{1430c}$ and $\theta_{1430f}$, respectively). A substrate-based depth of cut provided by each of control points $P_{1402b}$, $P_{1402d}$ and $P_{1402f}$ with respect to each of cutlet points 1430*a*, 1430*b*, 1430*c* and 1430*f* may be determined. The substrate-based depth of cut at each of control points $P_{1402b}$, $P_{1402d}$ and $P_{1402f}$ may be based on the underexposure ($\delta_{1407i}$, depicted in FIG. 14B) of each of points $P_{1402i}$ with respect to each of cutlet points 1430 and the angular coordinates of points $P_{1402i}$ with respect to cutlet points 1430.

For example, the depth of cut of cutting element 1428*b* at cutlet point 1430*b* as controlled by point $P_{1402b}$ of substrate 1402*b* ($\Delta_{1430b}$) may be determined using the angular coordinates of point $P_{1402b}$ and cutlet point 1430*b* ($\theta_{P1402b}$ and $\theta_{1430b}$, respectively), which are depicted in FIG. 14A. Additionally, $\Delta_{1430b}$ may be based on the axial underexposure ($\delta_{1407b}$) of the axial coordinate of point $P_{1402b}$ ($Z_{P1402b}$) with respect to the axial coordinate of intersection point 1430*b* ($Z_{1430b}$), as depicted in FIG. 14B. In some embodiments, $\Delta_{1430b}$ may be determined using the following equations:

$$\Delta_{1430b}=\delta_{1407b}*360/(360-(\theta_{P1402b}-\theta_{1430b}));\text{ and}$$

$$\delta_{1407b}=Z_{1430b}-Z_{P1402b}.$$

In the first of the above equations, $\theta_{P1402b}$ and $\theta_{1430b}$ may be expressed in degrees and "360" may represent a full rotation about the face of drill bit 1401. Therefore, in instances where $\theta_{P1402b}$ and $\theta_{1430b}$ are expressed in radians, the numbers "360" in the first of the above equations may be changed to "2π." Further, in the above equation, the resultant angle of "$(\theta_{P1402b}-\theta_{1430b})$" ($\Delta_\theta$) may be defined as always being positive. Therefore, if resultant angle $\Delta_\theta$ is negative, then $\Delta_\theta$ may be made positive by adding 360 degrees (or 2π radians) to $\Delta_\theta$. Similar equations may be used to determine the depth of cut of cutting elements 1428*a*, 1428*c*, and 1429*f* as controlled by control point $P_{1402b}$ at cutlet points 1430*a*, 1430*c* and 1430*f*, respectively ($\Delta_{1430a}$, $\Delta_{1430c}$ and $\Delta_{1430f}$, respectively).

The substrate-based critical depth of cut at point $P_{1402b}$ ($\Delta_{P1402b}$) may be the maximum of $\Delta_{1430a}$, $\Delta_{1430b}$, $\Delta_{1430c}$ and $\Delta_{1430f}$ and may be expressed by the following equation:

$$\Delta_{P1402b}=\max[\Delta_{1430a},\Delta_{1430b},\Delta_{1430c},\Delta_{1430f}].$$

The substrate-based critical depth of cut at points $P_{1402d}$ and $P_{1402f}$ ($\Delta_{P1402d}$ and $\Delta_{P1402f}$, respectively) at radial coordinate $R_F$ may be similarly determined. The overall substrate-based critical depth of cut of drill bit 1401 at radial coordinate $R_F$ ($\Delta_{RF}$) may be based on the minimum of $\Delta_{P1402b}$, $\Delta_{P1402d}$ and $\Delta_{P1402f}$ and may be expressed by the following equation:

$$\Delta_{RF}=\min[\Delta_{P1402b},\Delta_{P1402d},\Delta_{P1402f}].$$

Accordingly, the overall substrate-based critical depth of cut of drill bit 1401 at radial coordinate $R_F$ ($\Delta_{RF}$) may be determined based on the points where substrates 1402 and cutting elements 1428/1429 intersect $R_F$. Each substrate-based critical depth of cut $\Delta_{P1426i}$ for each control point $P_{1426i}$ may be included with substrate-based critical depth of cuts $\Delta_{P1402i}$ in determining the minimum substrate-based critical depth of cut at $R_F$ to calculate the overall substrate-based critical depth of cut $\Delta_{RF}$ at radial location $R_F$.

To determine a substrate-based critical depth of cut control curve of drill bit 1401, the overall substrate-based critical depth of cut at a series of radial locations $R_f$ ($\Delta_{Rf}$) anywhere from the center of drill bit 1401 to the edge of drill bit 1401 may be determined to generate a curve that represents the substrate-based critical depth of cut as a function of the radius of drill bit 1401. Once the overall substrate-based critical depths of cuts for a sufficient number of radial coordinates $R_f$ are determined, the overall critical depth of cut may be graphed as a function of the radial coordinates $R_f$.

Figure 14B:
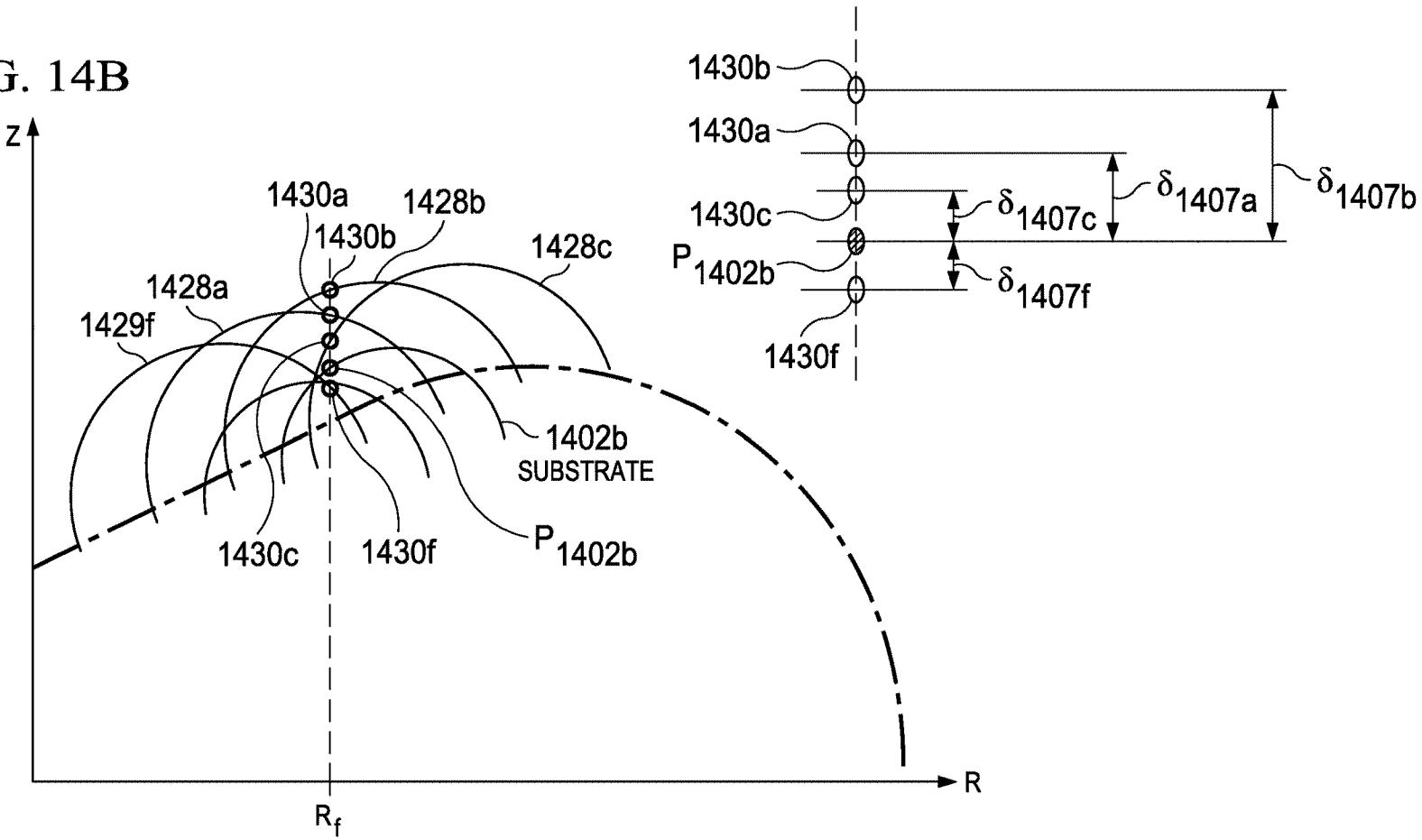
FIG. 14B illustrates a bit face profile of the drill bit depicted in FIG. 14A, in accordance with some embodiments of the present disclosure.

Modifications, additions or omissions may be made to FIGS. 14A-14B without departing from the scope of the present disclosure. For example, as discussed above, blades 1426, substrates 1402 or any combination thereof may affect the substrate-based critical depth of cut at one or more radial coordinates and the substrate-based critical depth of cut may be determined accordingly.

Figure 15:
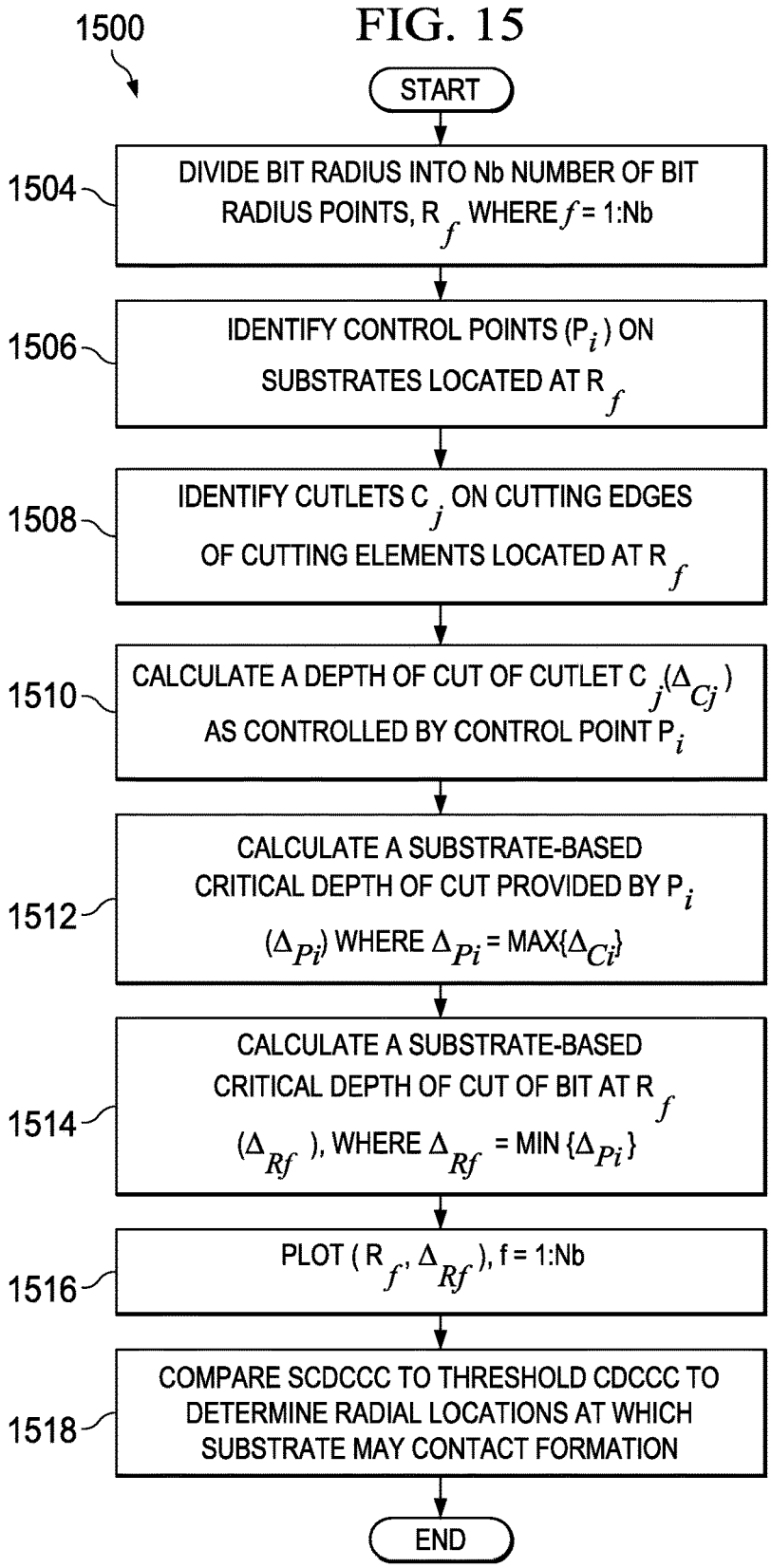
FIG. 15 illustrates an example method of determining and generating a substrate-based critical depth of cut control curve, in accordance with some embodiments of the present disclosure.

FIG. 15 illustrates an example method 1500 of determining and generating a SCDCCC, in accordance with some embodiments of the present disclosure. In the illustrated embodiment, the cutting structures of the bit, including at least the locations and orientations of all cutting elements and substrates, may have been previously designed. However in other embodiments, method 1500 may include steps for designing the cutting structure of the drill bit. For illustrative purposes, method 1500 is described with respect to drill bit 1401 of FIGS. 14A-14B; however, method 1500 may be used to determine the SCDCCC of any suitable drill bit.

The steps of method 1500 may be performed by various computer programs, models or any combination thereof, configured to simulate and design drilling systems, apparatuses and devices. The programs and models may include instructions stored on a computer readable medium and operable to perform, when executed, one or more of the steps described below. The computer readable media may include any system, apparatus or device configured to store and retrieve programs or instructions such as a hard disk drive, a compact disc, flash memory or any other suitable device. The programs and models may be configured to direct a processor or other suitable unit to retrieve and execute the instructions from the computer readable media. Collectively, the computer programs and models used to simulate and design drilling systems may be referred to as a "drilling engineering design system" or "engineering design system." Further, design parameters and/or results of any simulations and/or calculations performed by the engineering design system may be output to a visual display of the engineering design system.

Method 1500 may start, and at step 1504, the engineering design system may divide the bit radius into a number, Nb, of radial coordinates ($R_f$) such as radial coordinate $R_F$ described in FIGS. 14A and 14B. For example, the bit radius ($R_b$) may be divided by dr (for example, dr=0.01") such that Nb is the integer of ($R_b$/dr). The variable "f" may represent a number from one to Nb for each radial coordinate within the bit radius. For example, "$R_1$" may represent the radial coordinate of the inside edge of the bit radius. As a further example, "$R_{Nb}$" may represent the radial coordinate of the outside edge of the bit radius.

At step 1506, the engineering design system may select a radial coordinate $R_f$ and may identify control points ($P_i$) that may be located at the selected radial coordinate $R_f$ and associated with a substrate. For example, the engineering design system may select radial coordinate $R_F$ and may identify control point $P_{1402i}$ associated with substrates 1402 and located at radial coordinate $R_F$, as described above with respect to FIGS. 14A and 14B.

At step 1508, for the radial coordinate $R_f$ selected in step 1506, the engineering design system may identify cutlet points ($C_j$) each located at the selected radial coordinate $R_f$ and associated with the cutting edges of cutting elements. For example, the engineering design system may identify cutlet points 1430*a*, 1430*b*, 1430*c* and 1430*f* located at radial coordinate $R_F$ and associated with the cutting edges of cutting elements 1428*a*, 1428*b*, 1428*c*, and 1429*f*, respectively, as described and shown with respect to FIGS. 14A and 14B.

At step 1510, the engineering design system may select a control point $P_i$ and may calculate a depth of cut for each cutlet $C_j$ as controlled by the selected control point $P_i$ ($\Delta_{Cj}$), as described above with respect to FIGS. 14A and 14B. For example, the engineering design system may determine the depth of cut of cutlets 1430*a*, 1430*b*, 1430*c*, and 1430*f* as controlled by control point $P_{1402b}$ ($\Delta_{1430a}$, $\Delta_{1430b}$, $\Delta_{1430c}$, and $\Delta_{1430f}$, respectively) by using the following equations:

$$\Delta_{1430a}=\delta_{1407a}*360/(360-(\theta_{P1402b}-\theta_{1430a}));$$

$$\delta_{1407a}=Z_{1430a}-Z_{P1402b};$$

$$\Delta_{1430b}=\delta_{1407b}*360/(360-(\theta_{P1402b}-\theta_{1430b}));$$

$$\delta_{1407b}=Z_{1430b}-Z_{P1402b};$$

$$\Delta_{1430c}=\delta_{1407c}*360/(360-(\theta_{P1402b}-\theta_{1430c}));$$

$\delta_{1407c}=Z_{1430c}-Z_{P1402b}$;

$\Delta_{1430f}=\delta_{1407f}*360/(360-(\theta_{P1402b}-\theta_{1430f}))$; and $\delta_{1407f}=Z_{1430f}-Z_{P1402b}$.

At step 1512, the engineering design system may calculate the critical depth of cut provided by the selected control point ($\Delta_{Pi}$) by determining the maximum value of the depths of cut of the cutlets $C_j$ as controlled by the selected control point $P_i$ ($\Delta_{Cj}$) and calculated in step 1510. This determination may be expressed by the following equation:

$\Delta_{Pi}=\max\{\Delta_{Cj}\}$.

For example, control point $P_{1402b}$ may be selected in step 1510 and the depths of cut for cutlets 1430*a*, 1430*b*, 1430*c*, and 1430*f* as controlled by control point $P_{1402b}$ ($\Delta_{1430a}$, $\Delta_{1430b}$, $\Delta_{1430c}$, and $\Delta_{1430f}$, respectively) may also be determined in step 1510, as shown above. Accordingly, the substrate-based critical depth of cut at a control point $P_{1402b}$ ($\Delta_{P1402b}$) may be calculated at step 1512 using the following equation:

$\Delta_{P1402b}=\max[\Delta_{1430a},\Delta_{1430b},\Delta_{1430c},\Delta_{1430f}]$.

The engineering design system may repeat steps 1510 and 1512 for all of the control points $P_i$ identified in step 1506 to determine the substrate-based critical depth of cut at all control points $P_i$ located at radial coordinate $R_f$. For example, the engineering design system may perform steps 1510 and 1512 with respect to control points $P_{1402d}$ and $P_{1402f}$ to determine the substrate-based critical depth of cut at control points $P_{1402d}$ and $P_{1402f}$ with respect to cutlets 1430*a*, 1430*b*, 1430*c*, and 1430*f* at radial coordinate $R_F$ shown in FIGS. 14A and 14B (e.g., $\Delta_{P1402d}$ and $\Delta_{P1402f}$, respectively).

At step 1514, the engineering design system may calculate an overall substrate-based critical depth of cut at the radial coordinate $R_f$ ($\Delta_{Rf}$) selected in step 1506. The engineering design system may calculate the overall substrate-based critical depth of cut at the selected radial coordinate $R_f$ ($\Delta_{Rf}$) by determining a minimum value of the substrate-based critical depths of cut of control points $P_i$ ($\Delta_{Pi}$) determined in steps 1510 and 1512. This determination may be expressed by the following equation:

$\Delta_{Rf}=\min\{\Delta_{Pi}\}$.

For example, the engineering design system may determine the overall substrate-based critical depth of cut at radial coordinate $R_F$ of FIGS. 14A and 14B by using the following equation:

$\Delta_{RF}=\min[\Delta_{P1402b},\Delta_{P1402d},\Delta_{P1402f}]$.

The engineering design system may repeat steps 1506 through 1514 to determine the overall substrate-based critical depth of cut at all the radial coordinates $R_f$ generated at step 1504.

At step 1516, the engineering design system may plot the overall substrate-based critical depth of cut ($\Delta_{Rf}$) for each radial coordinate $R_f$, as a function of each radial coordinate $R_f$. Accordingly, a substrate-based critical depth of cut control curve may be calculated and plotted for the bit radius.

At step 1518, the substrate-based critical depth of cut control curve (SCDCCC) may be compared to a threshold critical depth of cut control curve (CDCCC). The threshold critical depth of control curve may be a given critical depth of cut control curve based on a desired critical depth of cut, or a separately calculated DOCC-based critical depth of cut control curve. For example, the substrate-based critical depth of cut control curve generated in steps 1504-1516 of method 1500 may be compared to a threshold DOCC-based critical depth of cut control curve calculated in method 1100. Any radial location at which the substrate-based critical depth of cut is smaller than the threshold critical depth of cut may represent a radial location at which a substrate of a cutting element may come into contact with formation during drilling.

Following step 1518, method 1500 may end. Accordingly, method 1500 may be used to calculate and plot a substrate-based critical depth of cut control curve of a drill bit. As described above, the substrate-based critical depth of cut control curve may be used to determine whether the substrate of any cutting elements contact formation during drilling.

Modifications, additions, or omissions may be made to method 1500 without departing from the scope of the present disclosure. For example, the order of the steps may be performed in a different manner than that described and some steps may be performed at the same time. Additionally, each individual step may include additional steps without departing from the scope of the present disclosure.

As mentioned above, upon determination of any radial locations at which the substrate of a cutting element may contact formation during drilling, the design of the drill bit may be adjusted to prevent such substrate contact. For example, further DOCCs may be added to the drill bit, or the design of existing DOCCs may be adjusted, in order to decrease the threshold critical depth of cut at a given radial location such that the threshold critical depth of cut is smaller than the substrate-based critical depth of cut at that location. In some embodiments, additional cutting elements and/or back-up cutting elements may be added to the design of the drill bit to similarly decrease the threshold critical depth of cut. As a result, the DOCCs, additional cutting elements, and/or additional back-up cutting elements, may contact formation before the substrates of any cutting elements, and thus preventing the substrates of any cutting elements from contacting formation during drilling.

As another example, the back rake angle and/or side rake angle of a cutting element may be adjusted in order to increase the substrate-based critical depth of cut for a given radial location. For example, the side rake angle of a cutting element may be decreased (e.g., from 10 degrees to 5 degrees) and/or the back rake angle of a cutting element may be increased (e.g., from 14.5 degrees to 25 degrees). As a result, the substrate-based critical depth of cut for a given radial location may be increased to a level that is greater than the threshold critical depth of cut, thus preventing the substrates of any cutting elements at that radial location from contacting formation during drilling.

Although the present disclosure has been described with several embodiments, various changes and modifications may be suggested to one skilled in the art. For example, although the present disclosure describes the configurations of blades, cutting elements, and DOCCs with respect to drill bits, the same principles may be used to control the depth of cut of any suitable drilling tool according to the present disclosure. It is intended that the present disclosure encompasses such changes and modifications as fall within the scope of the appended claims.

What is claimed is:

1. A method of designing a drill bit, comprising:

determining a location on a drill bit for each of a plurality of cutting elements at a plurality of radial coordinates of the drill bit;

determining a substrate-based critical depth of cut, at each of the plurality of radial coordinates, for a substrate of each of the plurality of cutting elements;

generating a substrate-based critical depth of cut control curve based on the substrate-based critical depth of cut at each of the plurality of radial coordinates;

comparing the substrate-based critical depth of cut control curve to a threshold critical depth of cut control curve; and adjusting a drill bit design parameter in response to the substrate-based critical depth of cut control curve being less than or equal to the threshold critical depth of cut control curve at a radial coordinate.

2. The method of claim 1, wherein adjusting the drill bit design parameter comprises adjusting at least one of a back rake angle and a side rake angle of a cutting element at the identified radial coordinate of the drill bit.

3. The method of claim 1, wherein adjusting the drill bit design parameter comprises decreasing the threshold critical depth of cut control curve at the identified radial location by decreasing a depth of cut of a cutting element controlled by a depth of cut controller (DOCC) at the identified radial coordinate of the drill bit.

4. The method of claim 1, wherein adjusting the drill bit design parameter comprises increasing the number of depth of cut controllers (DOCCs) on the drill bit.

5. The method of claim 1, wherein adjusting the drill bit design parameter comprises increasing one of a number of cutting elements and a number of back-up cutters on the drill bit.

6. The method of claim 1, further comprising displaying the substrate-based critical depth of cut control curve on a visual display.

7. A method of determining a substrate-based critical depth of cut, comprising:

identifying a plurality of cutting elements disposed on a bit face of a drill bit that intersect a radial coordinate on the drill bit, each of the plurality of cutting elements having a substrate;

identifying the substrate of one cutting element of the plurality of cutting elements that intersects the radial coordinate on the drill bit;

calculating a substrate-based critical depth of cut associated with the radial coordinate based on a depth of cut associated with each portion of the plurality of cutting elements intersecting the radial coordinate and controlled by the identified substrate of the one cutting element; and adjusting a drill bit design parameter based on the substrate-based critical depth of cut associated with the radial coordinate.

8. The method of claim 7, further comprising comparing the substrate-based critical depth of cut to a threshold critical depth of cut.

9. The method of claim 8, further comprising:

identifying a depth of cut controller (DOCC) disposed on the bit face of the drill bit; and calculating the threshold critical depth of cut based on a DOCC-controlled depth of cut associated with each portion of the plurality of cutting elements intersecting the radial coordinate and controlled by the DOCC.

10. The method of claim 7, further comprising:

calculating an axial underexposure between the identified substrate and each of the plurality of cutting elements that intersect the radial coordinate; and calculating the depth of cut associated with each portion of the plurality of cutting elements intersecting the radial coordinate and controlled by the identified substrate based on the axial underexposure between the identified substrate and each of the plurality of cutting elements.

11. The method of claim 7, further comprising:

identifying a control point associated with the identified substrate and the radial coordinate;

determining a control-point angular coordinate associated with the control point, the control-point angular coordinate and the radial coordinate being defined in a plane that is substantially perpendicular to a bit rotational axis;

determining cutlet points associated with the plurality of cutting elements, the cutlet points having approximately the same radial coordinate as the control point;

determining a cutlet-point angular coordinate associated with each of the cutlet points; and calculating a cutlet-point depth of cut associated with each cutlet point and controlled by the control point of the substrate based on the control-point angular coordinate and the cutlet-point angular coordinates.

12. The method of claim 11, further comprising:

determining a maximum cutlet-point depth-of-cut value based on the cutlet-point depth of cuts associated with each respective cutlet point; and determining a control-point substrate-based critical depth of cut based on the maximum cutlet-point depth-of-cut value.

13. The method of claim 7, further comprising:

identifying a plurality of substrates intersecting the radial coordinate; and calculating a plurality of substrate-based critical depth of cuts, each of the plurality of substrate-based critical depth of cuts associated with one of the plurality of identified substrates and based on the depth of cut associated with each portion of the plurality of cutting elements intersecting the radial coordinate and controlled by the one of the plurality of substrates.

14. The method of claim 13, further comprising:

determining a minimum value for the plurality of substrate-based critical depth of cuts; and calculating an overall substrate-based critical depth of cut associated with the radial coordinate based on the minimum value for the plurality of substrate-based critical depth of cuts.

15. The method of claim 14, further comprising comparing the overall substrate-based critical depth of cut to a threshold critical depth of cut.

16. A drill bit comprising:

a bit body;

a plurality of blades on the bit body forming a bit face;

a plurality of cutting elements on the plurality of blades, each of the plurality of cutting elements including a substrate intersecting a radial coordinate of the bit face, the substrate controlling a substrate-based critical depth of cut associated with the radial coordinate; and a depth of cut controller (DOCC) disposed on one of the plurality of blades and configured to control a threshold critical depth of cut associated with the radial coordinate, the threshold critical depth of cut associated with the radial coordinate being less than the substrate-based critical depth of cut associated with the radial coordinate.

17. The drill bit of claim 16, wherein the threshold critical depth of cut is based on a depth of cut associated with each portion of the plurality of cutting elements intersecting the radial coordinate and controlled by the DOCC.

18. The drill bit of claim 16, wherein the substrate-based critical depth of cut is based on a depth of cut associated with each portion of the plurality of cutting elements intersecting the radial coordinate and controlled by the substrate of one of the plurality of cutting elements.

19. The drill bit of claim 18, wherein the substrate-based critical depth of cut is further based on an axial underexposure between the substrate and each of the portions of the plurality of cutting elements intersecting the radial coordinate.

20. The drill bit of claim 19, wherein the axial underexposure is based on a back rake angle and a side rake angle of the one of the plurality of cutting elements.

* * * * *